US008553059B2

(12) United States Patent
Ono et al.

(10) Patent No.: US 8,553,059 B2
(45) Date of Patent: Oct. 8, 2013

(54) THERMAL PRINTER HEAD AND MANUFACTURING METHOD THEREOF

(75) Inventors: Shigeyoshi Ono, Kyoto (JP); Yasuhiro Yoshikawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 13/327,368

(22) Filed: Dec. 15, 2011

(65) Prior Publication Data

US 2012/0154504 A1 Jun. 21, 2012

(30) Foreign Application Priority Data

Dec. 16, 2010 (JP) ..... 2010-280486

(51) Int. Cl.
*B41J 2/335* (2006.01)

(52) U.S. Cl.
USPC ..... 347/202

(58) Field of Classification Search
USPC ..... 347/200–211
See application file for complete search history.

(56) References Cited

U.S. PATENT DOCUMENTS 5,231,420 A * 7/1993 Yamamoto et al. ..... 347/200
5,367,320 A * 11/1994 Taniguchi et al. ..... 347/202
8,384,749 B2 * 2/2013 Morooka et al. ..... 347/200

FOREIGN PATENT DOCUMENTS

JP 04-347661 12/1992

* cited by examiner

*Primary Examiner* — Kristal Feggins
(74) *Attorney, Agent, or Firm* — Hamre, Schumann, Mueller & Larson, P.C.

(57) ABSTRACT

A thermal printer head that is highly efficient to manufacture is provided, which includes: a first substrate (11), including a first main surface (110), a first inclined surface (111) that is inclined relative to the first main surface (110), and a second inclined surface (112) that is inclined relative to the first main surface (110); an electrode layer (3), laminated on the first main surface (110), the first inclined surface (111), and the second inclined surface (112); a resistor layer (4), having a plurality of heat dissipation portions (41) respectively laminated on the first inclined surface (111) and crossing separated parts in the electrode layer (3); a driving integrated circuit (IC), for controlling the current passing through each heat dissipation portion (41); and a plurality of wires (81), respectively joined to the driving IC and joined to the second inclined surface (112) through the electrode layer (3).

24 Claims, 51 Drawing Sheets

THERMAL PRINTER HEAD AND MANUFACTURING METHOD THEREOF

BACKGROUND OF THE INVENTION

1. Field of the Invention

The present invention relates to a thermal printer head and a manufacturing method thereof.

2. Description of the Related Art

FIG. 51 is a side view of a conventional thermal printer head (for example, referring to Patent Document 1). The thermal printer head 900 includes a substrate 91, a glaze layer 92, a heat dissipation portion 94, and a driving IC 95. The substrate 91 is formed of, for example, $Al_2O_3$. The substrate 91 includes a surface 911, a surface 912, and an inclined surface 913. The driving IC 95 is disposed on the surface 911. The surface 912 is located between the surface 911 and the inclined surface 913, and is coplanar with the surface 911. The inclined surface 913 is inclined relative to the surfaces 911 and 912. The glaze layer 92 is formed on the inclined surface 913. The heat dissipation portion 94 is laminated on the glaze layer 92. The driving IC 95 controls the heat dissipation state of the heat dissipation portion 94.

Generally, the thermal printer head 900 further includes an electrode layer, a plurality of wires, and a protection resin (not shown). The electrode layer is laminated on the surface 911, the surface 912, and the inclined surface 913. The wires are joined to the driving IC 95 and the electrode layer. The driving IC 95 is conducted to the heat dissipation portion 94 through the electrode layer and the wires. The protection resin is covered on the driving IC 95 and the wires. The thermal printer head 900 is assembled in a printer, and used for printing a print medium 901 under proper heat dissipation effect of the heat dissipation portion 94.

In recent years, the print medium 901 is sometimes made of a material that cannot be easily bent. For example, the print medium 901 may be a plastic card. In this case, the feed path of the print medium 901 is linear. In order to successfully feed the print medium 901, preferably the feed of the print medium 901 is not hindered by the wires (or the protection resin). Therefore, preferably, in the thermal printer head 900, the inclined surface 913 fanned with the heat dissipation portion 94 is inclined relative to the surface 911 joined with the wires. In this case, even if the print medium 901 is made of a material that cannot be easily bent, the thermal printer head 900 may still be successfully fed the print medium 901.

When the thermal printer head 900 is manufactured, parts of the anti-corrosion layer of the electrode layer in the thermal printer head 900 fanned on the surfaces 911 and 912 and parts of the anti-corrosion layer formed on the inclined surface 913 are exposed respectively in different exposure steps. Therefore, the thermal printer head 900 is undesirably inefficient to manufacture.

[Documents Of The Prior Art]

[Patent Documents]

[Patent Document 1] Japanese Patent Publication No. H04-347661

SUMMARY OF THE INVENTION

The present invention has been proposed under the circumstances described above. It is therefore an objective of the present invention to provide a thermal printer head that is highly efficient to manufacture.

In a first aspect of the present invention, a thermal printer head includes: a first substrate, having a first main surface expanded in a first direction and a second direction intersecting the first direction, a first inclined surface located on one side of the first direction relative to the first main surface and inclined relative to the first main surface in a manner of being distant from the first main surface and facing an opposite direction as the first main surface, and a second inclined surface located on another side of the first direction relative to the first main surface and inclined relative to the first main surface in a manner of being distant from the first main surface and facing an opposite direction as the first main surface; an electrode layer, laminated on the first main surface, the first inclined surface, and the second inclined surface; a resistor layer, having a plurality of heat dissipation portions respectively laminated on the first inclined surface and crossing separated parts in the electrode layer; a driving integrated circuit (IC), for controlling the current passing through each heat dissipation portion; and a plurality of wires, respectively joined to the driving IC and joined to the second inclined surface through the electrode layer.

In a preferred embodiment of the present invention, the thermal printer head further includes a first glaze layer, located between the heat dissipation portions and the first inclined surface; and a second glaze layer, located between the electrode layer and the second inclined surface.

In a preferred embodiment of the present invention, the thermal printer head further includes an intermediate glass layer that is laminated on the first main surface, the first inclined surface, and the second inclined surface and crosses the first glaze layer and the second glaze layer.

In a preferred embodiment of the present invention, the thermal printer head further includes a second substrate having a second main surface disposed with the driving IC, and the second inclined surface is located in a thickness direction of the second substrate and on one side of the second main surface that faces the driving IC relative to the second main surface.

In a preferred embodiment of the present invention, the thermal printer head further includes a sealing resin covered on the driving IC and the wires.

In a preferred embodiment of the present invention, the thermal printer head further includes a heat dissipation plate installed with the first substrate and the second substrate, the first substrate further has a rear surface facing an opposite direction as the first main surface; and seen from the thickness direction of the second substrate, the rear surface overlaps with the second inclined surface and has a part that connects against the heat dissipation plate.

In a preferred embodiment of the present invention, the thermal printer head further includes protection portions covered on the heat dissipation portions and having insulation property, and the protection portions overlap with the first substrate in the first direction.

In a preferred embodiment of the present invention, the first substrate further includes a substrate lateral facing another side of the first direction, and the second glaze layer has an end surface coplanar with the substrate lateral.

In a preferred embodiment of the present invention, the second glaze layer is located between the electrode layer and the first main surface.

In a preferred embodiment of the present invention, the first inclined surface and the second inclined surface are both inclined relative to the first main surface by an angle of 1° to 15°.

In a preferred embodiment of the present invention, in a third direction orthogonal to the first direction and the second direction, an end portion of the first inclined surface on one side of the first direction and an end portion of the second inclined surface on another side of the first direction are both separated from the first main surface by 150 μm to 200 μm.

In a preferred embodiment of the present invention, the resistor layer is located between the electrode layer and the first substrate.

In a preferred embodiment of the present invention, the resistor layer is located between the electrode layer and the first main surface and between the electrode layer and the second inclined surface.

In a preferred embodiment of the present invention, the intermediate glass layer has a first curved surface facing the same direction as the first main surface and overlapping with a boundary of the first main surface and the first inclined surface.

In a preferred embodiment of the present invention, the intermediate glass layer has a second curved surface facing the same direction as the first main surface and overlapping with a boundary of the first main surface and the second inclined surface.

In a preferred embodiment of the present invention, the second inclined surface and the second main surface form an angle of 0° to 5°.

In a preferred embodiment of the present invention, the second inclined surface is parallel with the second main surface.

In a preferred embodiment of the present invention, the electrode layer is located between the resistor layer and the first substrate.

In a preferred embodiment of the present invention, the electrode layer includes a common electrode, a plurality of relay electrodes, and a plurality of individual electrodes; the common electrode has a plurality of common electrode stripe portions separated from and conducted with each other in the second direction; each relay electrode includes two relay electrode stripe portions separated from each other in the second direction and a relay electrode connecting portion connected to the two relay electrode stripe portions; each individual electrode includes an individual electrode stripe portion; and each common electrode stripe portion is separated from one of the two relay electrode stripe portions in the first direction by any of the heat dissipation portions, and each individual electrode stripe portion is separated from any of the common electrode stripe portions in the second direction and separated from the other one of the two relay electrode stripe portions in the first direction by any of the heat dissipation portions.

In a preferred embodiment of the present invention, the common electrode further includes branch portions connected to adjacent ones among the common electrode stripe portions and extended in the first direction.

In a second aspect of the present invention, a manufacturing method of a thermal printer head includes: forming a plurality of grooves that are separated from each other in a first direction and respectively extended in a second direction intersecting the first direction on a base material, so as to divide a surface of the base material into a plurality of main surfaces extended in the second direction; laminating an electrode layer on the main surfaces, a plurality of first inclined surfaces respectively connected to an end edge of any of the main surfaces on one side of the first direction and defined any of the grooves, and a plurality of second inclined surfaces respectively connected to an end edge of any of the main surfaces on another side of the first direction and defined any of the a plurality of grooves; laminating a resistor layer at least on the first inclined surfaces; laminating an anti-corrosion layer on the electrode layer; exposing parts of the anti-corrosion layer laminated on the first inclined surfaces, the second inclined surfaces, and the main surfaces at the same time; etching the electrode layer after the exposure; and cutting the base material along the grooves and the first direction to generate a plurality of fixed plates.

In a preferred embodiment of the present invention, the manufacturing method further includes forming a first glaze layer on each first inclined surface and a second glaze layer on each second inclined surface before forming the electrode layer.

In a preferred embodiment of the present invention, the electrode layer is laminated after laminating the resistor layer, and the electrode layer and the resistor layer are etched together when the electrode layer is etched.

In a preferred embodiment of the present invention, the exposure is performed after laminating the electrode layer and in a state such that the electrode layer is laminated on the resistor layer.

Other features and advantages of the present invention are illustrated clearly as follows along with the accompanying drawings.

BRIEF DESCRIPTION OF THE DRAWINGS

The invention will be described according to the appended drawings in which.

PREFERRED EMBODIMENT OF THE PRESENT INVENTION

[First Embodiment]

The first embodiment of the present invention is illustrated with reference to FIG. 1 to FIG. 26.

Figure 1:
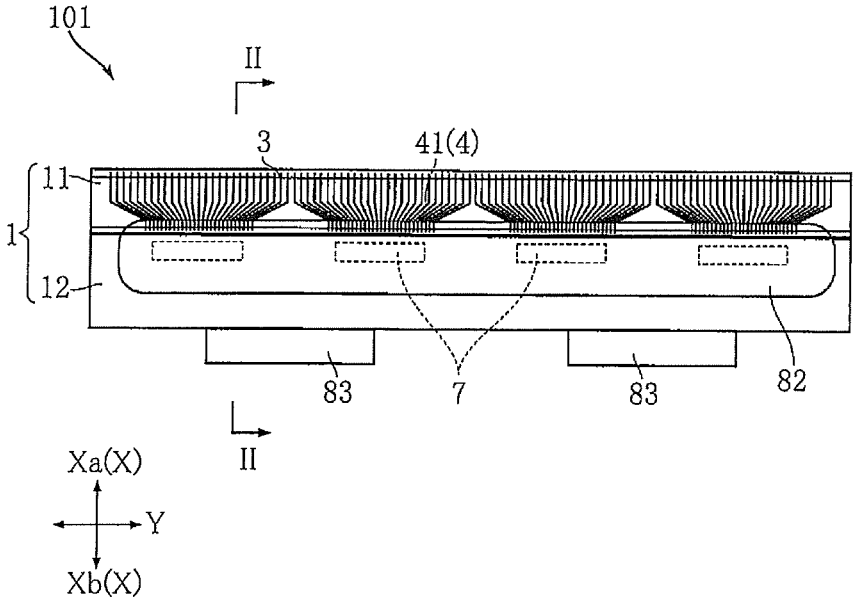
FIG. 1 is a top view of a thermal printer head according to a first embodiment of the present invention.
Figure 2:
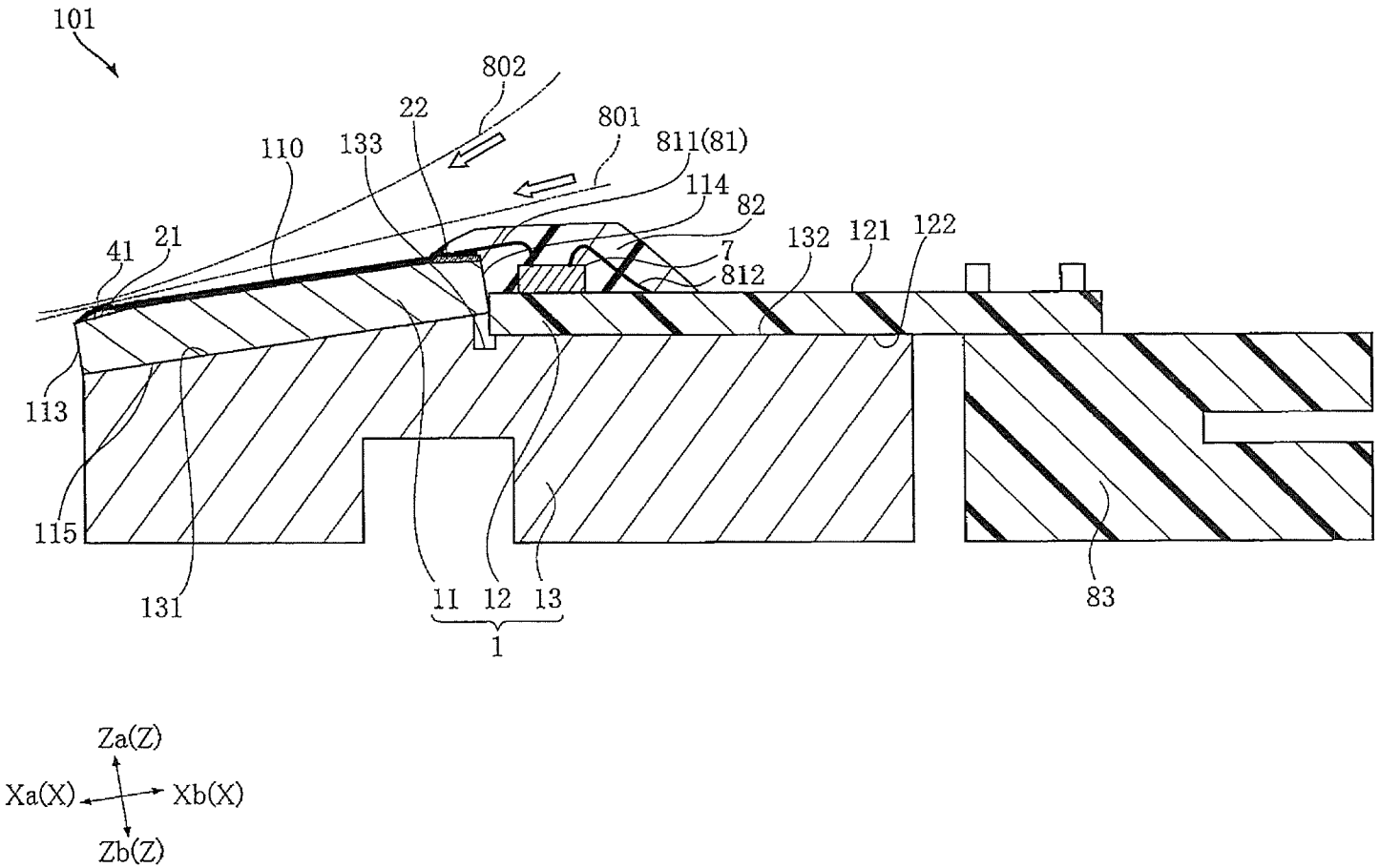
FIG. 2 is a cross-sectional view along Line II-II in FIG. 1.
Figure 3:
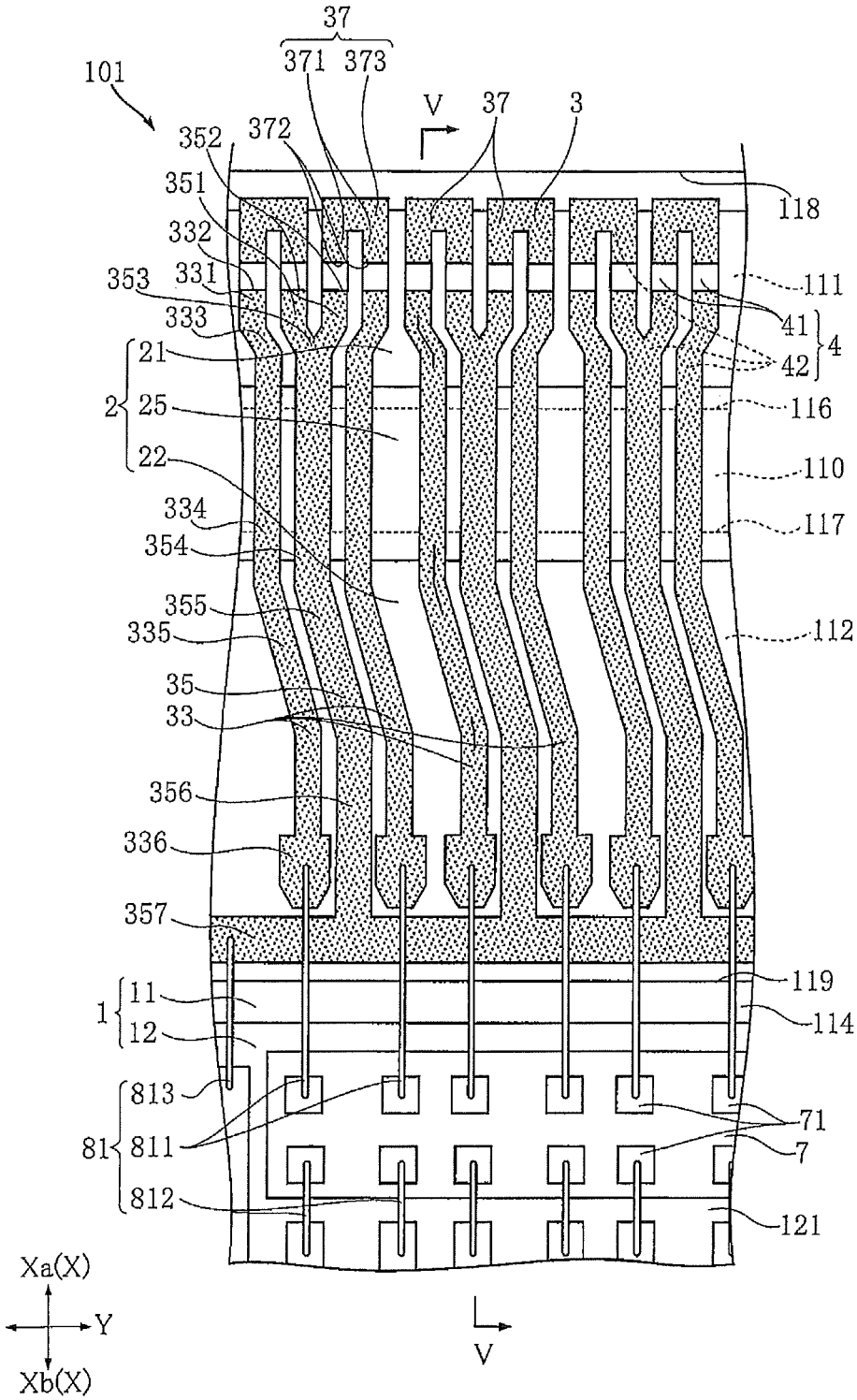
FIG. 3 is a top view of main parts of the thermal printer head shown in FIG. 1.
Figure 4:
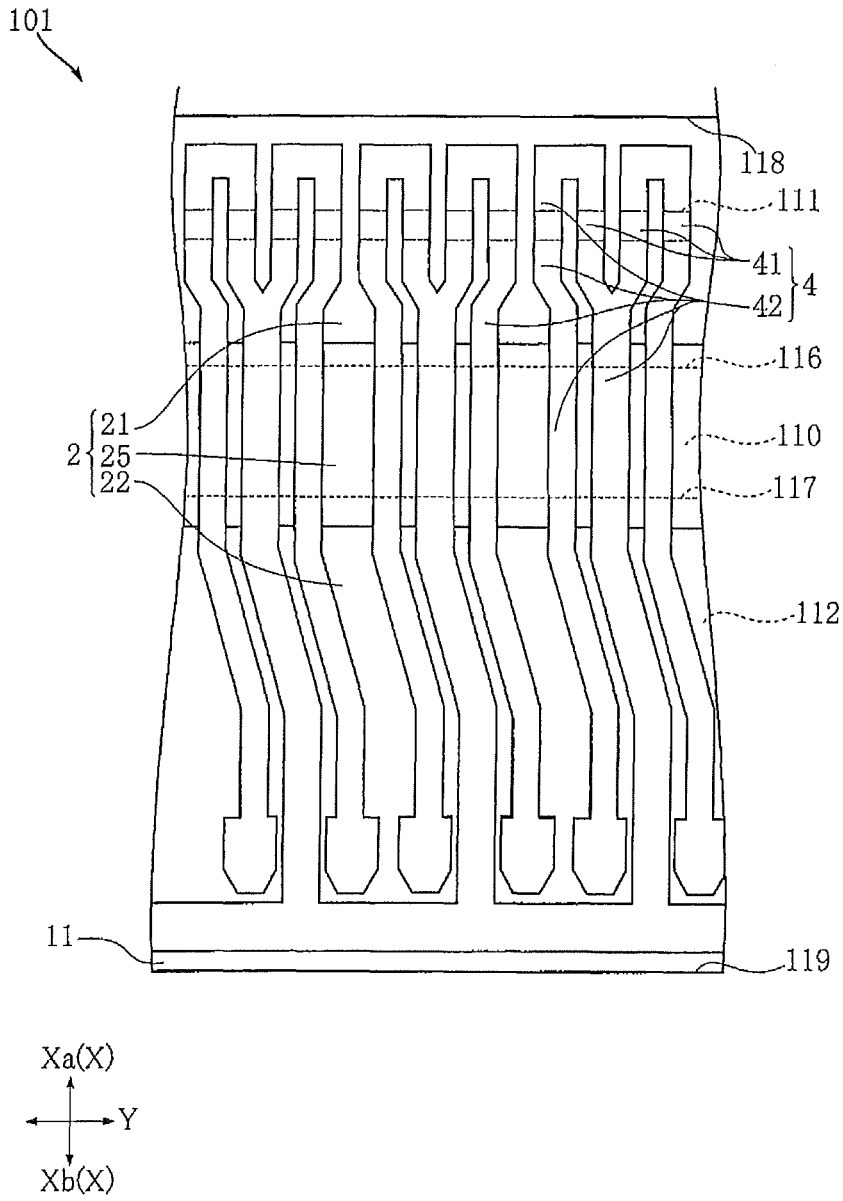
FIG. 4 is a top view of the main parts of the thermal printer head shown in FIG. 3 with a part being omitted.
Figure 5:
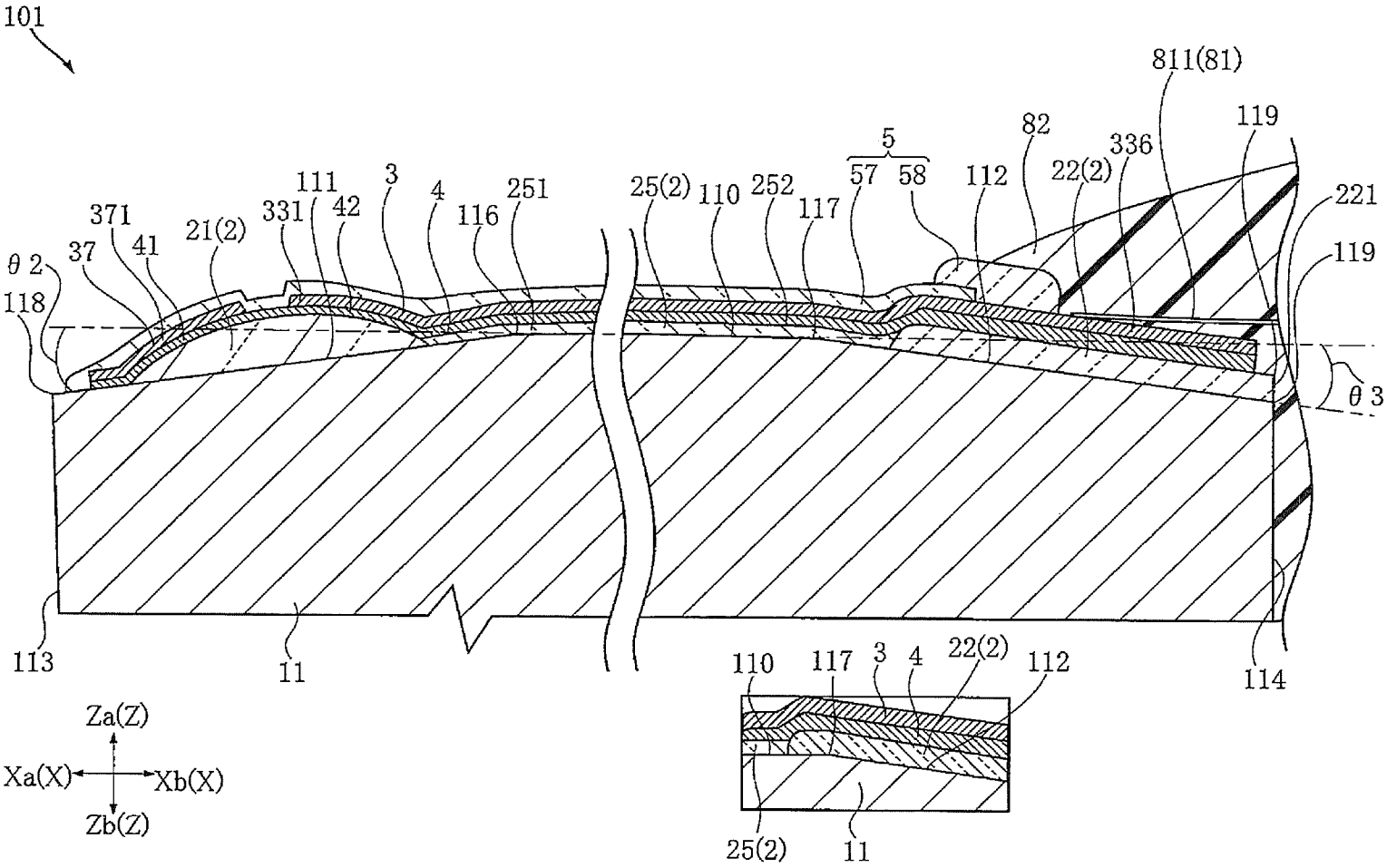
FIG. 5 is a cross-sectional view of the main parts along Line V-V in FIG. 3 and a partial enlarged view of another embodiment of the thermal printer head.
Figure 6:
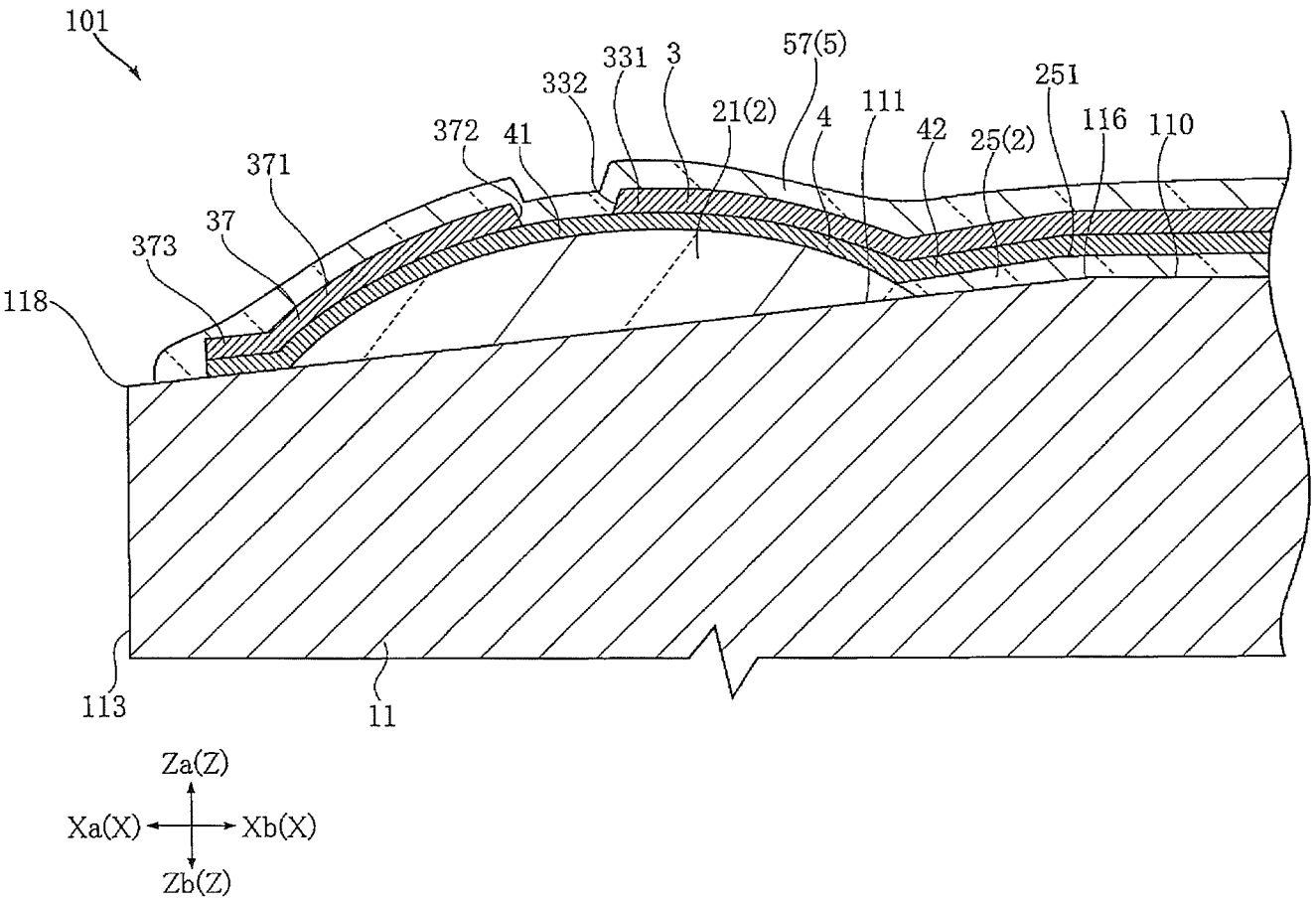
FIG. 6 is a partial enlarged view of the thermal printer head shown in FIG. 5.
Figure 7:
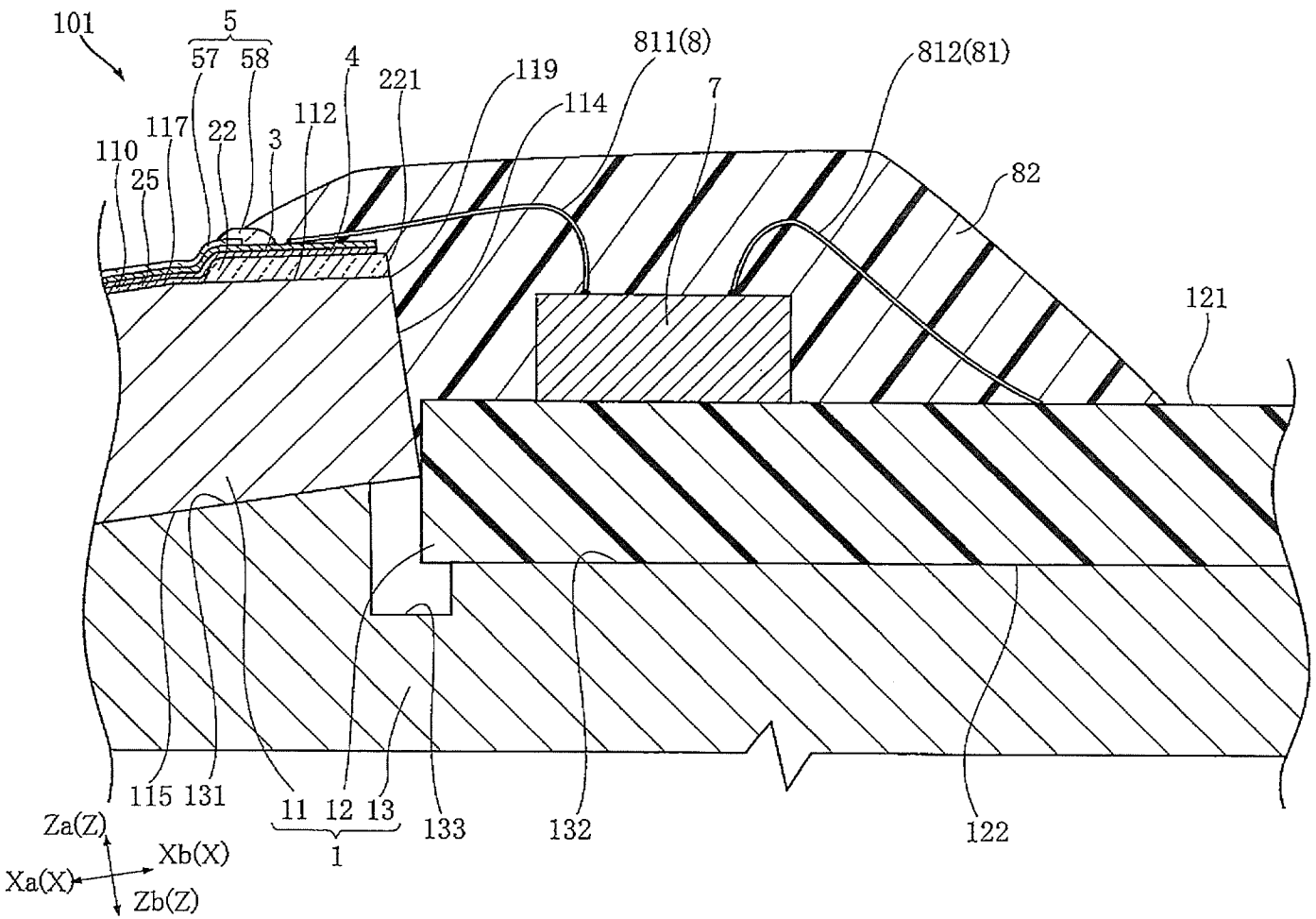
FIG. 7 is a partial enlarged view of the thermal printer head shown in FIG. 2.

FIG. 1 is a top view of a thermal printer head according to the first embodiment of the present invention. FIG. 2 is a cross-sectional view along Line II-II in FIG. 1. FIG. 3 is a top view of main parts of the thermal printer head shown in FIG. 1. FIG. 4 is a top view of the main parts of the thermal printer head shown in FIG. 3 with an electrode layer, a driving IC, and wires being omitted. FIG. 5 is a cross-sectional view of the main parts along Line V-V in FIG. 3. FIG. 5 is also a partial enlarged view of another embodiment of the thermal printer head in this embodiment. FIG. 6 is a partial enlarged view of the thermal printer head shown in FIG. 5. FIG. 7 is a partial enlarged view of the thermal printer head shown in FIG. 2.

Referring to the figures, the thermal printer head 101 includes a support portion 1, a glass layer 2, an electrode layer 3, a resistor layer 4, a protection layer 5, a driving IC 7, a plurality of wires 81, a sealing resin 82, and a connector 83. The thermal printer head 101 is assembled in a printer for printing a print medium 801. The print medium 801 may be thermal paper that can be made into bar-code paper or receipts. In this embodiment, the print medium 801 may be a plastic card that cannot be easily bent. Further, for ease of understanding, in FIG. 1, the protection layer 5 is omitted. In FIG. 3, the protection layer 5 and the sealing resin 82 are omitted.

Referring to FIG. 1, FIG. 2, and FIG. 7, the support portion 1 is a basic part of the thermal printer head 101. The support portion 1 includes a first substrate 11, a second substrate 12, and a heat dissipation plate 13. The first substrate 11 has a ceramic material such as $Al_2O_3$. The thickness of the first substrate 11 is, for example, around 0.6 mm to 1.0 mm. As shown in FIG. 1, the first substrate 11 is a flat plate extended in a direction Y. As shown in FIG. 5 to FIG. 7, the first substrate 11 includes a first main surface 110, a first inclined surface 111, a second inclined surface 112, a substrate lateral 113, a substrate lateral 114, and a rear surface 115. The width of the first substrate 11 (the size of the first substrate 11 in a direction X) is, for example, 3 mm to 20 mm. The size of the first substrate 11 in the direction Y is, for example, 10 mm to 300 mm. The thickness of the first substrate 11 (a distance from the first main surface 110 to the rear surface 115) is, for example, 0.6 mm to 1.0 mm.

The first main surface 110 is in a plane expanded in the direction X as the first direction and the direction Y as the second direction intersecting the first direction. The first main surface 110 extends longitudinally along the direction Y. The first main surface 110 faces a thickness direction Z of the first substrate 11 (hereinafter referred to as a direction Za, which is an upward direction in FIG. 5 and FIG. 6). The width of the first main surface 110 (the size thereof in the direction X) is, for example, 2 mm to 18 mm.

The first inclined surface 111 is located on one side of the direction X relative to the first main surface 110 (hereinafter referred to as a direction Xa). The first inclined surface 111 is in a plane longitudinally extending along the direction Y. The first inclined surface 111 is connected to the first main surface 110 through the boundary 116. The first inclined surface 111 is inclined relative to the first main surface 110 in a manner of being distant from the first main surface 110 and facing an opposite direction (hereinafter referred to as a direction Zb, which is a downward direction in FIG. 5 and FIG. 6) as the first main surface 110. The first inclined surface 111 is inclined relative to the first main surface 110 by an angle of, for example, 1° to 15°. Referring to FIG. 5, in this embodiment, an inclined angle of the first inclined surface 111 relative to the first main surface 110 is set to an inclined angle θ2. An end portion 118 of the first inclined surface 111 in the direction Xa is separated from the first main surface 110 in the direction Z by, for example, 150 μm to 200 μm. That is, the size of the first inclined surface 111 in the direction Z is 150 μm to 200 μm.

The second inclined surface 112 is located on another side of the direction X relative to the first main surface 110 (hereinafter referred to as a direction Xb). The first main surface 110 is located on between the second inclined surface 112 and the first inclined surface 111. The second inclined surface 112 is in a plane longitudinally extending along the direction Y. The second inclined surface 112 is connected to the first main surface 110 through the boundary 117. The second inclined surface 112 is inclined relative to the first main surface 110 in a direction opposite to the direction of the first main surface 110 (the direction Zb). The second inclined surface 112 is inclined relative to the first main surface 110 by an angle of, for example, 1° to 15°. Referring to FIG. 5, in this embodiment, an inclined angle of the second inclined surface 112 relative to the first main surface 110 is set to an inclined angle θ3. An end portion 119 of the second inclined surface 112 in the direction Xb is separated from the first main surface 110 in the direction Z by, for example, 150 μm to 200 μm. That is, the size of the second inclined surface 112 in the direction Z is 150 μm to 200 μm.

The substrate lateral 113 is in a plane extended in the direction Xa. In this embodiment, the substrate lateral 113 is in a plane expanded in the direction Y and the direction Z. The substrate lateral 113 is connected to the end portion 118 of the first inclined surface 111. The subsequent protection layer 5 is not formed on the substrate lateral 113, and the whole surface of the substrate lateral 113 is exposed. The substrate lateral 114 is in a plane extended in the direction Xb. In this embodiment, the substrate lateral 114 is in a plane expanded in the direction Y and the direction Z. The substrate lateral 114 is connected to the end portion 119 of the second inclined surface 112. The rear surface 115 faces a direction opposite to the direction of the first main surface 110 (the direction Zb). In this embodiment, the rear surface 115 is in a plane expanded in the direction X and the direction Y. That is, the rear surface 115 is parallel with the first main surface 110. The rear surface 115 is connected to either the substrate lateral 113 or the substrate lateral 114.

Referring to FIG. 2 and FIG. 7, the second substrate 12 is, for example, a printed circuit board (PCB). The second substrate 12 is laminated with a base material layer and a wiring layer (not shown). The base material layer is formed of, for example, an epoxy glass resin. The wiring layer is farmed of, for example, Cu. The second substrate 12 rests on a boundary of the substrate lateral 114 and the rear surface 115 in the first substrate 11. The second substrate 12 includes a second main surface 121 and a rear surface 122. The second main surface 121 and the rear surface 122 face opposite directions. The second main surface 121 is preferably parallel with the second inclined surface 112. That is, the second main surface 121 preferably forms an angle of, for example, 0° to 5° with the second inclined surface 112. The second main surface 121 is further preferably completely parallel with the second inclined surface 112. That is, the second main surface 121 preferably forms an angle of 0° with the second inclined surface 112. In this embodiment, referring to FIG. 7, the second main surface 121 is located below the boundary 117. That is, in a thickness direction of the second substrate 12, the boundary 117 is located on one side of the second main surface 121 facing the driving IC 7 relative to the second main surface 121. Further, in this embodiment, in the thickness direction of the second substrate 12, the whole second inclined surface 112 is located on one side of the second main surface 121 facing the driving IC 7 (illustrated in the following) relative to the second main surface 121. In addition, different from this embodiment, the second main surface 121 may also be located at a position coplanar with the second inclined surface 112.

Referring to FIG. 2 and FIG. 7, the heat dissipation plate 13 is used for dissipating heat from the first substrate 11. The heat dissipation plate 13 is formed of a metal such as Al. The heat dissipation plate 13 is installed with the first substrate 11 and the second substrate 12. The heat dissipation plate 13 includes surfaces 131 and 132. The surface 131 is inclined relative to the surface 132. The surface 131 rests on the rear surface 115 of the first substrate 11. Seen from the thickness direction of the second substrate 12, the rear surface 115 overlaps with the second inclined surface 112 and has a part that connects against the heat dissipation plate 13. The surface 132 rests on the rear surface 122 of the second substrate 12. The heat dissipation plate 13 is formed with a recessed portion 133 located between the surface 131 and the surface 132. The recessed portion 133 faces a contact part of the first substrate 11 and the second substrate 12.

Referring to FIG. 5 to FIG. 7, the glass layer 2 is formed on the first substrate 11. The glass layer 2 is laminated on the first main surface 110, the first inclined surface 111, and the second inclined surface 112. The glass layer 2 includes a first glaze layer 21, a second glaze layer 22, and an intermediate glass layer 25.

The first glaze layer 21 is laminated on the first inclined surface 111. The first glaze layer 21 is used for accumulating heat generated by the heat dissipation portion 41 (illustrated in the following). The first glaze layer 21 provides a smooth surface suitable for fondling the resistor layer 4. The first glaze layer 21 directly contacts the first inclined surface 111. The first glaze layer 21 extends along the direction Y. A cross-section of the first glaze layer 21 in a plane perpendicular to the direction Y is in the direction of the first inclined surface 111 (an upper-left direction in FIG. 5 and FIG. 6), and is raised from the first inclined surface 111. Thereby, the first glaze layer 21 enables a part of the protection layer 5 covered on the heat dissipation portion 41 to appropriately rest on the print medium 801. The first glaze layer 21 is formed of a glass material such as amorphous glass. The softening point of the glass material is, for example, 800° C. to 850° C. The thickness of the first glaze layer 21 (a distance from the top of the first glaze layer 21 to the first inclined surface 111) is, for example, 10 μm to 80 μm.

The second glaze layer 22 is laminated on the second inclined surface 112. The second glaze layer 22 provides a smooth surface suitable for forming the resistor layer 4. The second glaze layer 22 directly contacts the second inclined surface 112. The second glaze layer 22 extends along the direction Y. The second glaze layer 22 is formed of a glass material such as amorphous glass. The softening point of the glass material is, for example, 800° C. to 850° C. The thickness of the second glaze layer 22 is, for example, 40 μm to 60 μm. The second glaze layer 22 has an end surface 221. The end surface 221 is coplanar with the substrate lateral 114.

The intermediate glass layer 25 is laminated on the first inclined surface 111, the first main surface 110, and the second inclined surface 112. The intermediate glass layer 25 provides a smooth surface suitable for forming the resistor layer 4. The intermediate glass layer 25 directly contacts the first inclined surface 111, the first main surface 110, and the second inclined surface 112. The intermediate glass layer 25 crosses the first glaze layer 21 and the second glaze layer 22. The intermediate glass layer 25 is covered on an area in the first substrate 11 between the first glaze layer 21 and the second glaze layer 22. The intermediate glass layer 25 extends along the direction Y. The intermediate glass layer 25 is formed of a glass material. The softening point of the glass material for forming the intermediate glass layer 25 is lower than the softening point of the glass material for forming the first glaze layer 21 or the second glaze layer 22. The softening point of the glass material for forming the intermediate glass layer 25 is, for example, around 680° C. The thickness of the intermediate glass layer 25 is, for example, around 2 μM.

Referring to FIG. 5 and FIG. 6, the intermediate glass layer 25 in this embodiment has curved surfaces 251 and 252. The curved surface 251 is a surface of the intermediate glass layer 25 facing the direction Za, and overlaps with the boundary 116. The curved surface 251 successfully connects the surface of the intermediate glass layer 25 covered on the first main surface 110 to the surface of the intermediate glass layer 25 covered on the first inclined surface 111. Therefore, in most cases, no step is formed in a part covered on the boundary 116 of the surface of the intermediate glass layer 25 facing the direction Za. The curved surface 252 is a surface of the intermediate glass layer 25 facing the direction Za, and overlaps with the boundary 117. The curved surface 252 successfully connects the surface of the intermediate glass layer 25 covered on the first main surface 110 to the surface of the intermediate glass layer 25 covered on the second inclined surface 112. Therefore, in most cases, no step is formed in a part covered on the boundary 117 of the surface of the intermediate glass layer 25 facing the direction Za.

Further, different from this embodiment, the glass layer 2 may also have a single layer structure with the first glaze layer 21, the second glaze layer 22, and the intermediate glass layer 25 formed of the same material.

Referring to FIG. 5 to FIG. 7, the electrode layer 3 forms a path for powering the resistor layer 4. The electrode layer 3 is formed of a conductor material such as Al. The electrode layer 3 is laminated on the first main surface 110, the first inclined surface 111, and the second inclined surface 112. The electrode layer 3 is laminated on the glass layer 2 (the first glaze layer 21, the second glaze layer 22, and the intermediate glass layer 25). The first glaze layer 21 is located between the electrode layer 3 and the first inclined surface 111, and the second glaze layer 22 is located between the electrode layer 3 and the second inclined surface 112. The intermediate glass layer 25 is located between the electrode layer 3 and the first inclined surface 111, the first main surface 110, or the second inclined surface 112. The second glaze layer 22 may also be located between the electrode layer 3 and the first main surface 110 (referring to the partial enlarged view of FIG. 5). In this embodiment, the electrode layer 3 is laminated on the resistor layer 4. For ease of understanding, the electrode layer 3 in FIG. 3 is hatched. In this embodiment, referring to FIG. 3, the electrode layer 3 includes a plurality of individual electrodes 33 (six are shown in the figure), a common electrode 35, and a plurality of relay electrodes 37 (six are shown in the figure). Detailed description is provided below.

The individual electrodes 33 are not conducted with each other. Therefore, when the printer assembled with the thermal printer head 101 is used, the individual electrodes 33 may be respectively designated with different potentials. Each individual electrode 33 includes an individual electrode stripe portion 331, a bent portion 333, a straight portion 334, an oblique portion 335, and a joint portion 336. Each individual electrode stripe portion 331 extends along the direction X. Each individual electrode stripe portion 331 is laminated on the first glaze layer 21. An opposite edge 332 of each individual electrode stripe portion 331 extends along the direction Y. The bent portion 333 is connected to the individual electrode stripe portion 331, and is inclined relative to either the direction Y or the direction X. In this embodiment, the bent portion 333 is formed on the first glaze layer 21. The straight portion 334 extends in parallel with the direction X. The straight portion 334 is mostly laminated on the intermediate glass layer 25, and has an end portion laminated on the first glaze layer 21 and another end portion laminated on the second glaze layer 22. The oblique portion 335 extends in a direction inclined relative to either the direction Y or the direction X, and is laminated on the second glaze layer 22. The joint portion 336 is a part joined to wires 811, and is laminated on the second glaze layer 22. In this embodiment, the width of the individual electrode stripe portion 331, the bent portion 333, the straight portion 334, and the oblique portion 335 is, for example, around 47.5 μm, and the width of the joint portion 336 is, for example, around 80 μm.

The common electrode 35 is a part electrically changing to a polarity opposite to the individual electrodes 33 when the printer assembled with the thermal printer head 101 is used. The common electrode 35 includes a plurality of common electrode stripe portions 351, a plurality of branch portions 353, a plurality of straight portions 354, a plurality of oblique portions 355, a plurality of extending portions 356, and a base portion 357. Each common electrode stripe portion 351 extends in the direction X. In each common electrode 35, the common electrode stripe portions 351 are separated from and conducted with each other in the direction Y. Each common electrode stripe portion 351 is laminated on the first glaze layer 21. An opposite edge 352 of the common electrode stripe portion 351 extends along the direction Y. The common electrode stripe portions 351 are separated from the individual electrode stripe portions 331 in the direction Y. In this embodiment, every adjacent two common electrode stripe portions 351 are located between two individual electrode stripe portions 331. The common electrode stripe portions 351 and the individual electrode stripe portions 331 are arranged along the direction Y. The branch portion 353 is a part connecting two common electrode stripe portions 351 with one straight portion 354, and is Y-shaped. The branch portions 353 are formed on the first glaze layer 21. The straight portions 354 extend in parallel with the direction X. The straight portion 354 is mostly laminated on the intermediate glass layer 25, and has an end portion laminated on the first glaze layer 21 and another end portion laminated on the second glaze layer 22. The oblique portions 355 extend in a direction inclined relative to either the direction Y or the direction X, and are laminated on the second glaze layer 22. The extending portions 356 are connected to the oblique portions 355, and extend along the direction X. The base portion 357 is stripe-shaped and extends in the direction Y, and is connected to the extending portions 356. In this embodiment, the width of the common electrode stripe portion 351, the straight portion 354, the oblique portion 355, and the extending portion 356 is, for example, around 47.5 μm.

The relay electrodes 37 are respectively electrically located between one of the individual electrodes 33 and the common electrode 35. Each relay electrode 37 includes two relay electrode stripe portions 371 and a connecting portion 373. Each relay electrode stripe portion 371 extends in the direction X. The relay electrode stripe portions 371 are separated from each other in the direction Y. Each relay electrode stripe portion 371 is laminated on the first glaze layer 21. The relay electrode stripe portions 371 are disposed in the direction X at one side opposite to the stripe portions 331, 351 on the first glaze layer 21. An opposite edge 372 of each relay electrode stripe portion 371 extends along the direction Y. One of the two relay electrode stripe portions 371 in each relay electrode 37 is separated from any of the common electrode stripe portions 351 in the direction X. That is, an opposite edge 372 of the two relay electrode stripe portions 371 in each relay electrode 37 is spaced from and opposite to any opposite edge 352 of the common electrode stripe portions 351 in the direction X. The other one of the two relay electrode stripe portions 371 in each relay electrode 37 is separated from any of the individual electrode stripe portions 331 in the direction X. That is, the other opposite edge 372 of the two relay electrode stripe portions 371 in each relay electrode 37 is spaced from and opposite to any opposite edge 332 of the individual electrode stripe portions 331 in the direction X. The connecting portions 373 respectively extend along the direction Y. Each connecting portion 373 is connected to the two relay electrode stripe portions 371 in each relay electrode 37. Therefore, the two relay electrode stripe portions 371 in each relay electrode 37 are conducted with each other.

Further, the electrode layer 3 does not necessarily have the relay electrodes 37, and may also include a plurality of individual electrodes and a common electrode adjacently connected to the individual electrodes.

Referring to FIG. 3 to FIG. 6, parts in the resistor layer 4 that the current from the electrode layer 3 passes through dissipate heat. Print dots are formed by the heat dissipation. The resistor layer 4 is made of a material having a resistivity greater than that of the electrode layer 3. Such material may be $TaSiC_2$ or TaN. The thickness of the resistor layer 4 is, for example, around 0.05 μm to 0.2 μm as a thin film. In this embodiment, the resistor layer 4 is located between the electrode layer 3 and the first substrate 11. Specifically, the resistor layer 4 is located between the electrode layer 3 and the first main surface 110, between the electrode layer 3 and the first inclined surface 111, and between the electrode layer 3 and the second inclined surface 112. The resistor layer 4 includes a plurality of heat dissipation portions 41 and a plurality of non-heat dissipation portions 42.

Referring to FIG. 4, the heat dissipation portions 41 are arranged along the direction Y. Each heat dissipation portion 41 is laminated on the first glaze layer 21. Referring to FIG. 6, the first glaze layer 21 is located between the heat dissipation portions 41 and the first inclined surface 111. Each heat dissipation portion 41 crosses separated parts in the electrode layer 3. Specifically, each heat dissipation portion 41 crosses the common electrode stripe portion 351 and the relay electrode stripe portion 371, or crosses the individual electrode stripe portion 331 and the relay electrode stripe portion 371. Each heat dissipation portion 41 is located on the first glaze layer 21, and covers a space between the opposite edge 332 and the opposite edge 372 or covers a space between the opposite edge 352 and the opposite edge 372.

Referring to FIG. 4 to FIG. 6, each non-heat dissipation portion 42 is connected to the heat dissipation portion 41. Each non-heat dissipation portion 42 is located between the electrode layer 3 and the glass layer 2 (the first glaze layer 21, the intermediate glass layer 25, or the second glaze layer 22). In this embodiment, each non-heat dissipation portion 42 is joined to and covered by any of all the relay electrodes 37, all the individual electrode stripe portions 331, all the bent portions 333, all the branch portions 353, and all the straight portions 334 and 354.

Referring to FIG. 5 to FIG. 7, the protection layer 5 is covered on the electrode layer 3 and the resistor layer 4, and used for protecting the electrode layer 3 and the resistor layer 4. The protection layer 5 includes a first protection portion 57 and a second protection portion 58. The first protection portion 57 is made of an insulating material, and overlaps with the first inclined surface 111, the first main surface 110, and the second inclined surface 112. The electrode layer 3 is located between the first protection portion 57 and the resistor layer 4. The first protection portion 57 is formed of, for example, $SiO_2$. Referring to FIG. 5 and FIG. 6, the first protection portion 57 is not covered on the substrate lateral 113, and the whole first protection portion 57 overlaps with the first substrate 11 in the direction X. That is, an end portion of the first protection portion 57 in the direction Xa is closer to the direction Xb than the substrate lateral 113, and an end portion of the first protection portion 57 in the direction Xb is closer to the direction Xa than the substrate lateral 114. The second protection portion 58 is covered on the first protection portion 57 and the electrode layer 3. The second protection portion 58 is formed of, for example, an epoxy resin.

Referring to FIG. 2, FIG. 3, and FIG. 7, the driving IC 7 respectively designates a potential to each individual electrode 33, and controls the current passing through each heat dissipation portion 41. Since each individual electrode 33 is designated with a potential, a voltage is applied between the common electrode 35 and each individual electrode 33, and the current selectively passes through each heat dissipation portion 41. The driving IC 7 is disposed on the second main surface 121 of the second substrate 12. Referring to FIG. 3, the driving IC 7 includes a plurality of pads 71. The pads 71 are arranged, for example, in two rows.

Referring to FIG. 2, FIG. 3, FIG. 5, and FIG. 7, the wires 81 are made of a conductor material such as Au. The wires 811 in the wires 81 are respectively joined to the driving IC 7, and are joined to the second inclined surface 112 through the electrode layer 3. Specifically, each wire 811 is joined to the pad 71 in the driving IC 7, and is joined to the joint portion 336. Thereby, the driving IC 7 is conducted to each individual electrode 33. Referring to FIG. 3, the wires 812 in the wires 81 are respectively joined to the pads 71 in the driving IC 7, and are joined to the wiring layer in the second substrate 12. Thereby, the driving IC 7 is conducted to the connector 83 through the wiring layer. As shown in the figure, the wires 813 in the wires 81 are joined to the base portion 357 in the common electrode 35, and are joined to the wiring layer in the second substrate 12. In this manner, the common electrode 35 is conducted to the wiring layer.

Referring to FIG. 2, FIG. 5, and FIG. 7, the sealing resin 82 is formed of, for example, a black resin. The sealing resin 82 is covered on the driving IC 7, the wires 81, and the second protection portion 58 of the protection layer 5, and used for protecting the driving IC 7 and the wires 81. The sealing resin 82 overlaps with the second inclined surface 112 and the second main surface 121. Since the protection layer 5 is not formed on the substrate lateral 114, the sealing resin 82 directly contacts the substrate lateral 114. The sealing resin 82 also directly contacts the end surface 221 of the second glaze layer 22. The connector 83 is fixed on the second substrate 12. The connector 83 provides power for the thermal printer head 101 from outside the thermal printer head 101, or controls the driving IC.

An application of the thermal printer head 101 is briefly illustrated below.

The thermal printer head 101 is assembled in a printer for use. Referring to FIG. 2, in the printer, each heat dissipation portion 41 of the thermal printer head 101 is opposite to a platen 802. When the printer works, the platen 802 rotates, and the print medium 801 is fed at a fixed speed between the platen 802 and each heat dissipation portion 41 along the direction X. The print medium 801 is pressed against a part of the first protection portion 57 covered on each heat dissipation portion 41 through the platen 802. In another aspect, a potential is selectively designated to each individual electrode 33 shown in FIG. 3 through the driving IC 7. Therefore, a voltage is applied between the common electrode 35 and each individual electrode 31 The current selectively passes through the heat dissipation portions 41 to generate heat. Then, the heat generated by each heat dissipation portion 41 is transferred to the print medium 801 through the first protection portion 57. Thereby, dots are printed in a first line area extending linearly on the print medium 801 in the direction Y. Moreover, the heat generated by each heat dissipation portion 41 is also transferred to the first glaze layer 21, and accumulated in the first glaze layer 21.

Further, with the rotation of the platen 802, the print medium 801 is continuously fed at a fixed speed along the direction X. Thereby, similar to the printing in the first line area, a second line area adjacent to the first line area and extending linearly on the print medium 801 in the direction Y is also printed. When the second line area is printed, in addition to the heat generated by each heat dissipation portion 41, the heat accumulated in the first glaze layer 21 when the first line area is printed is also transferred to the print medium 801. Thus, the second line area is printed. In this manner, a plurality of dots are printed in each line area extending linearly on the print medium 801 in the direction Y, so that the print medium 801 is printed.

A manufacturing method of the thermal printer head 101 is illustrated below with reference to FIG. 8 to FIG. 26.

Figure 8:
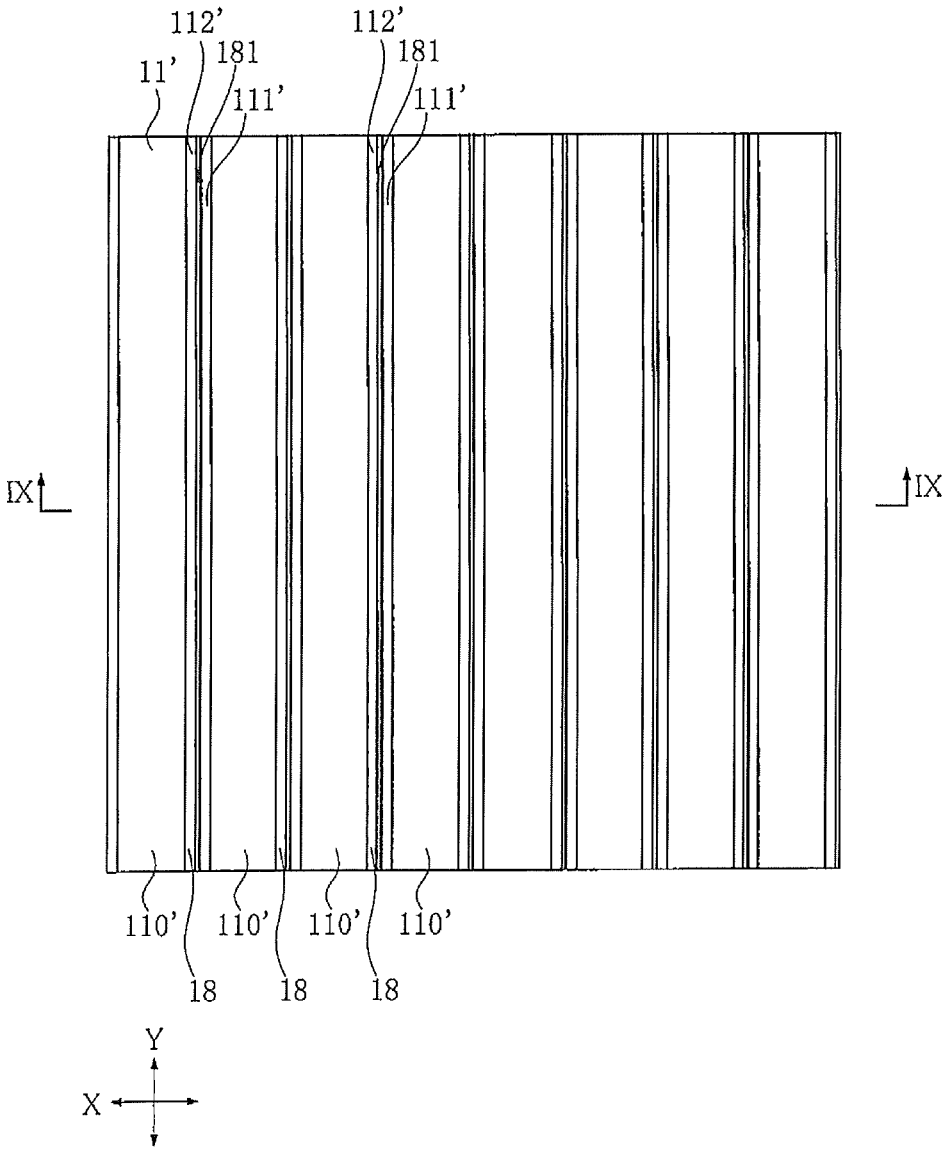
FIG. 8 is a top view of grooves formed on a base material in the manufacturing process of the thermal printer head according to the first embodiment of the present invention.
Figure 9:
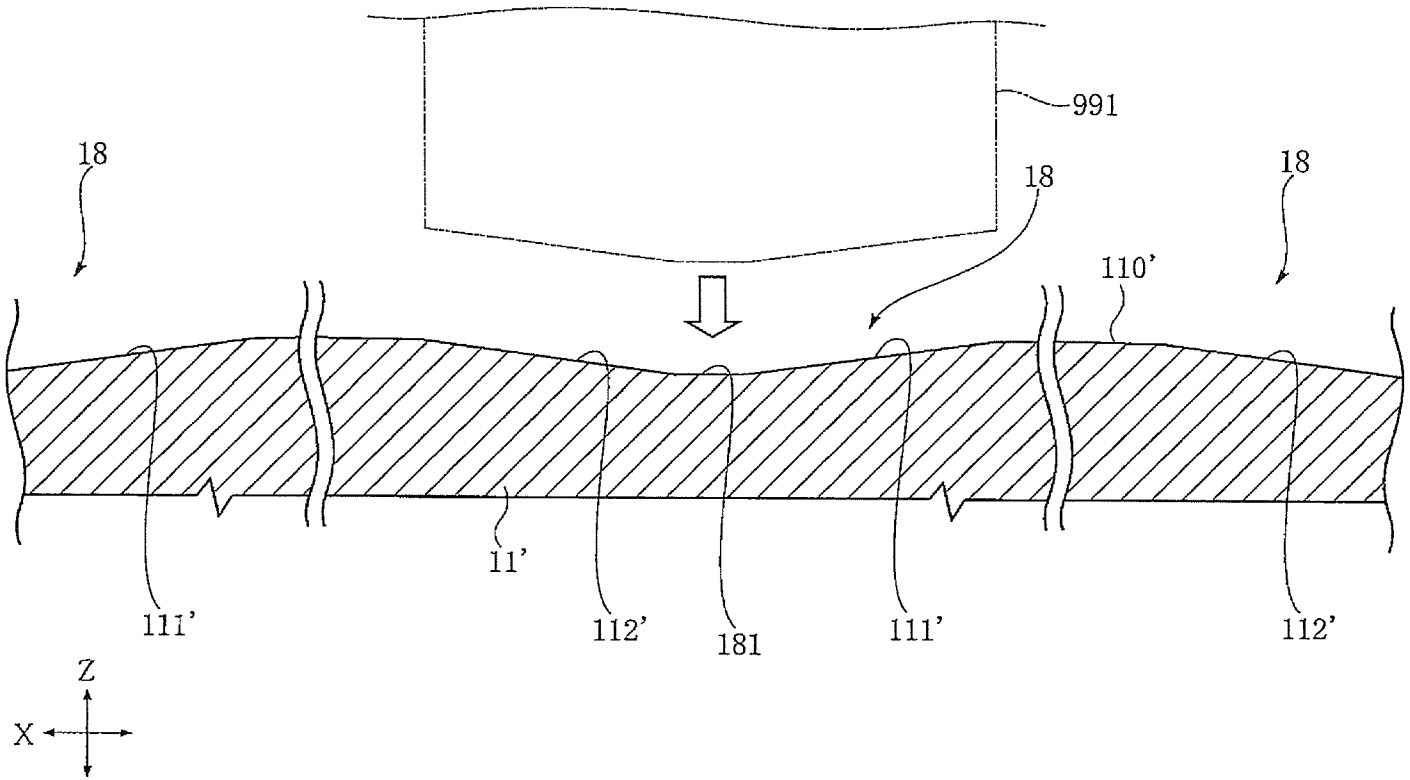
FIG. 9 is a cross-sectional view of the main parts along Line IX-IX in FIG. 8.

Firstly, referring to FIG. 8 and FIG. 9, a base material 11' is prepared. The thickness of the base material 11' is, for example, 0.6 mm to 1.0 mm. A plurality of grooves 18 are formed on the base material 11'. The grooves 18 are separated from each other in a direction X and respectively extended in a direction Y. By forming the grooves 18, a surface of the base material 11' is divided into a plurality of first main surfaces 110' respectively extending in the direction Y. Each groove 18 is defined by a first inclined surface 111', a second inclined surface 112', and a flat surface 181. The first inclined surface 111', the second inclined surface 112', and the flat surface 181 are respectively in a plane and extend in a stripe shape along the direction Y. Each first inclined surface 111' is connected to an end edge of any of the first main surfaces 110' in the direction X. In another aspect, each second inclined surface 112' is connected to another end edge of any of the first main surfaces 110' in the direction X. In each groove 18, the flat surface 181 is located between the first inclined surface 111' and the second inclined surface 112', and is connected to the first inclined surface 111' and the second inclined surface 112'. The grooves 18 are formed by pressing, for example, a substantially V-shaped blade 991 on the base material 11'.

Figure 10:
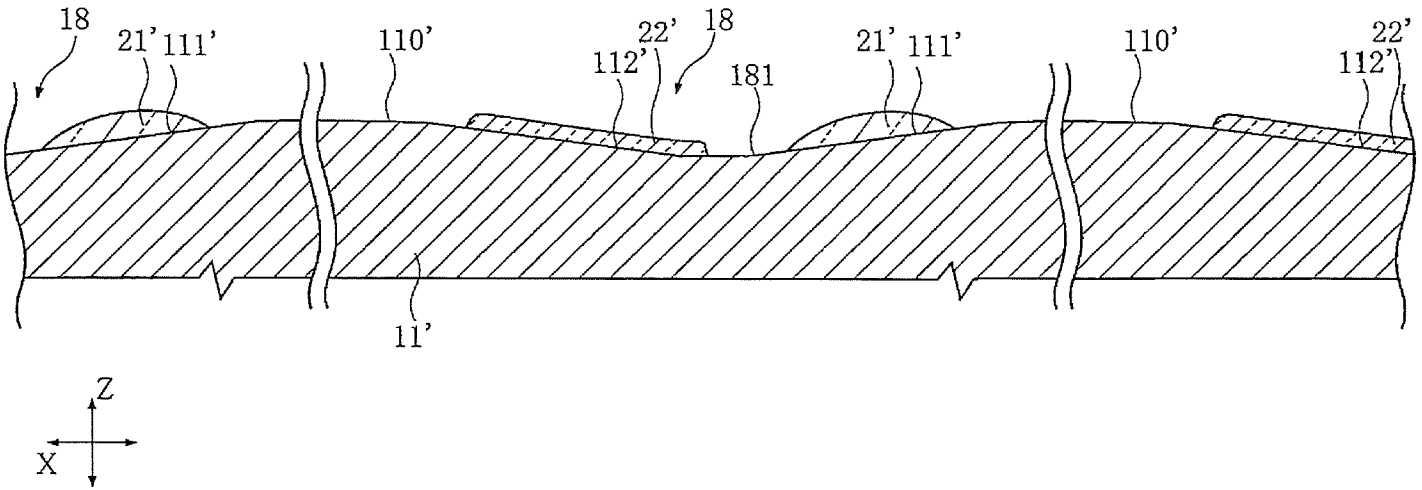
FIG. 10 is a cross-sectional view of the main parts aimed with a first glaze layer and a second glaze layer in the manufacturing process of the thermal printer head according to the first embodiment of the present invention.

Next, referring to FIG. 10, a first glaze layer 21' is formed on the first inclined surface 111', and a second glaze layer 22' is formed on the second inclined surface 112'. The first glaze layer 21' and the second glaze layer 22' both extend in the direction Y. Specifically, the first glaze layer 21' is formed on the first inclined surface 111'. For example, a paste containing glass is thick-film printed on the first inclined surface 111', and the thick-film printed paste is burned to form the first glaze layer 21'. The paste is burned at a temperature of, for example, 800° C. to 850° C. After the first glaze layer 21' is formed, the second glaze layer 22' is formed on the second inclined surface 112'. For example, a paste containing glass is thick-film printed on the second inclined surface 112' or on the first main surface 110' and the second inclined surface 112', and the thick-film printed paste is burned to form the second glaze layer 22'. The paste is burned at a temperature of, for example, 800° C. to 850° C. The first glaze layer 21' and the second glaze layer 22' may be formed in a reverse sequence, that is, the first glaze layer 21' may be formed after the second glaze layer 22'.

Figure 11:
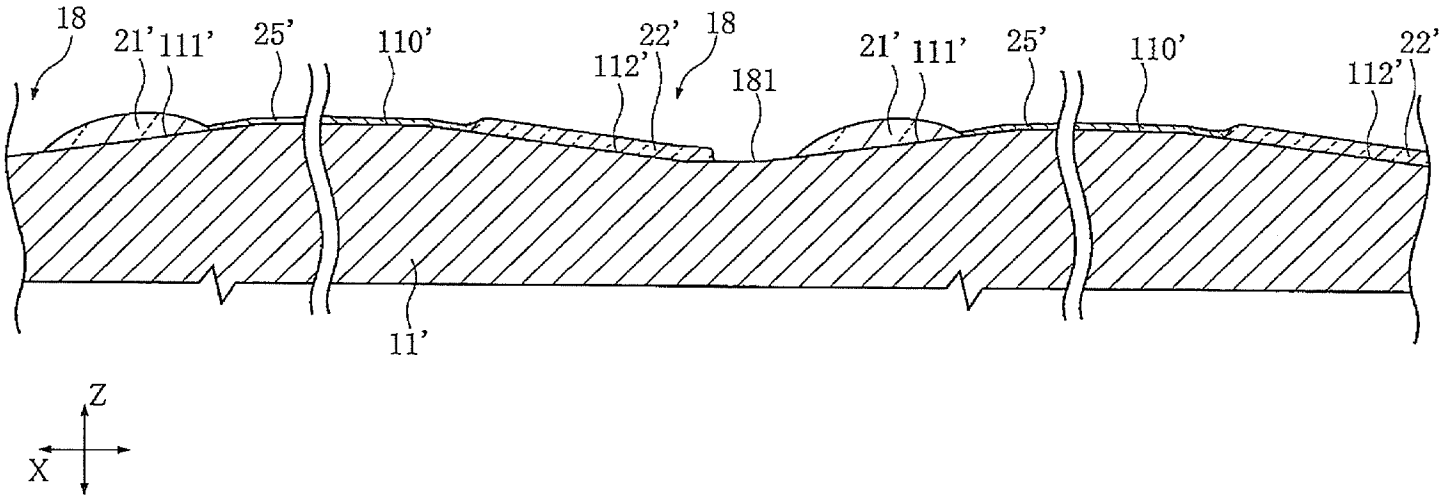
FIG. 11 is a cross-sectional view of the main parts formed with an intermediate glass layer in the manufacturing process of the thermal printer head according to the first embodiment of the present invention.

Then, referring to FIG. 11, an intermediate glass layer 25' is formed. When the intermediate glass layer 25' is formed, a paste containing glass is thick-film printed between the first glaze layer 21' and the second glaze layer 22'. In this embodiment, the paste containing glass is formed on the first inclined surface 111', the first main surface 110', and the second inclined surface 112'. The paste is a fluid having certain viscosity. Thus, the surface exposing the paste is a flat surface or a curved surface, and may not be easily bent. After the paste is thick-film printed, the thick-film printed paste is burned. The paste is burned at a temperature of, for example, 790° C. to 800° C.

Figure 12:
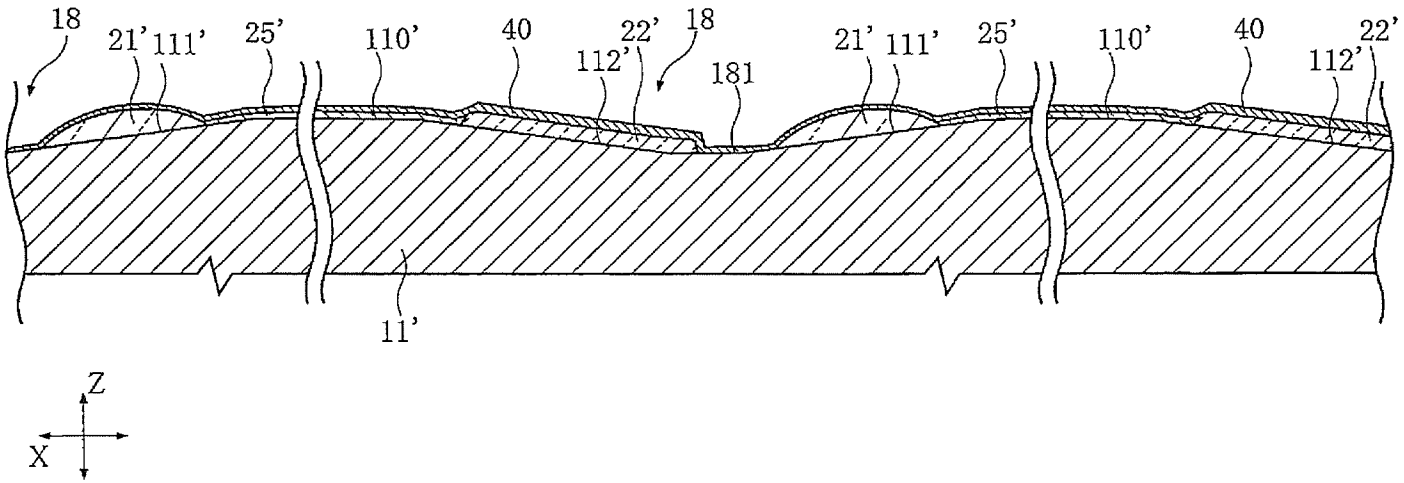
FIG. 12 is a cross-sectional view of the main parts formed with a resistor layer in the manufacturing process of the thermal printer head according to the first embodiment of the present invention.

Referring to FIG. 12, a resistor layer 40 is formed. The resistor layer 40 overlaps with the first main surface 110', the first inclined surface 111', the flat surface 181, and the second inclined surface 112'. The resistor layer 40 is formed by sputtering a material such as $TaSiO_2$ or TaN.

Figure 13:
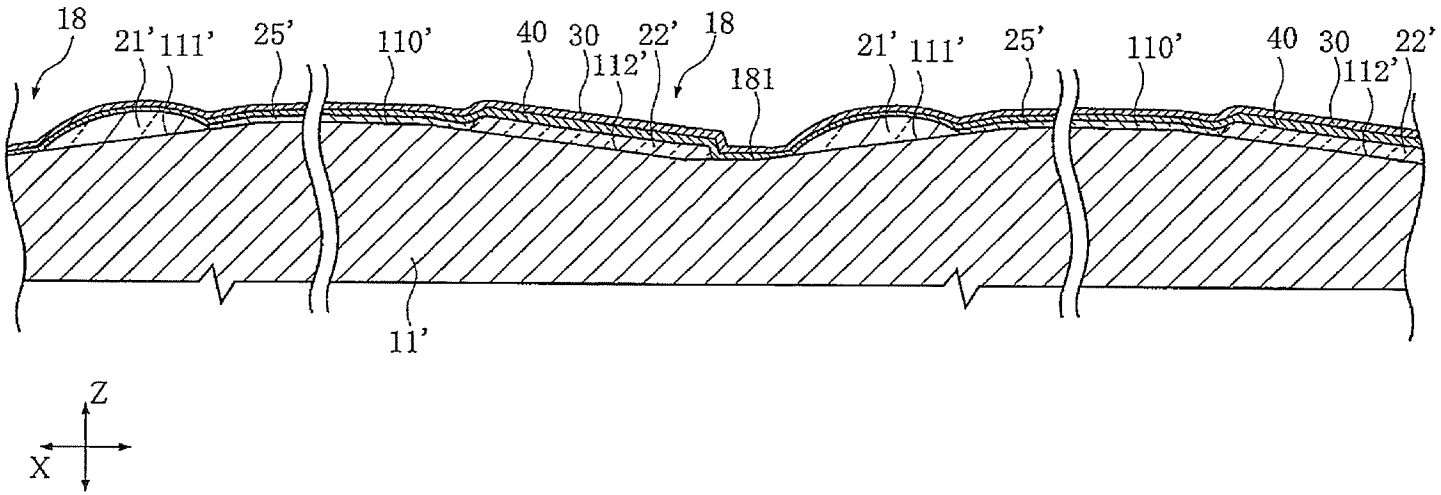
FIG. 13 is a cross-sectional view of the main parts formed with an electrode layer in the manufacturing process of the thermal printer head according to the first embodiment of the present invention.

Referring to FIG. 13, an electrode layer 30 is formed on the resistor layer 40. The electrode layer 30 overlaps with the first main surface 110', the first inclined surface 111', the flat surface 181, and the second inclined surface 112'. The electrode layer 30 is formed by, for example, sputtering a conductor material.

Figure 14:
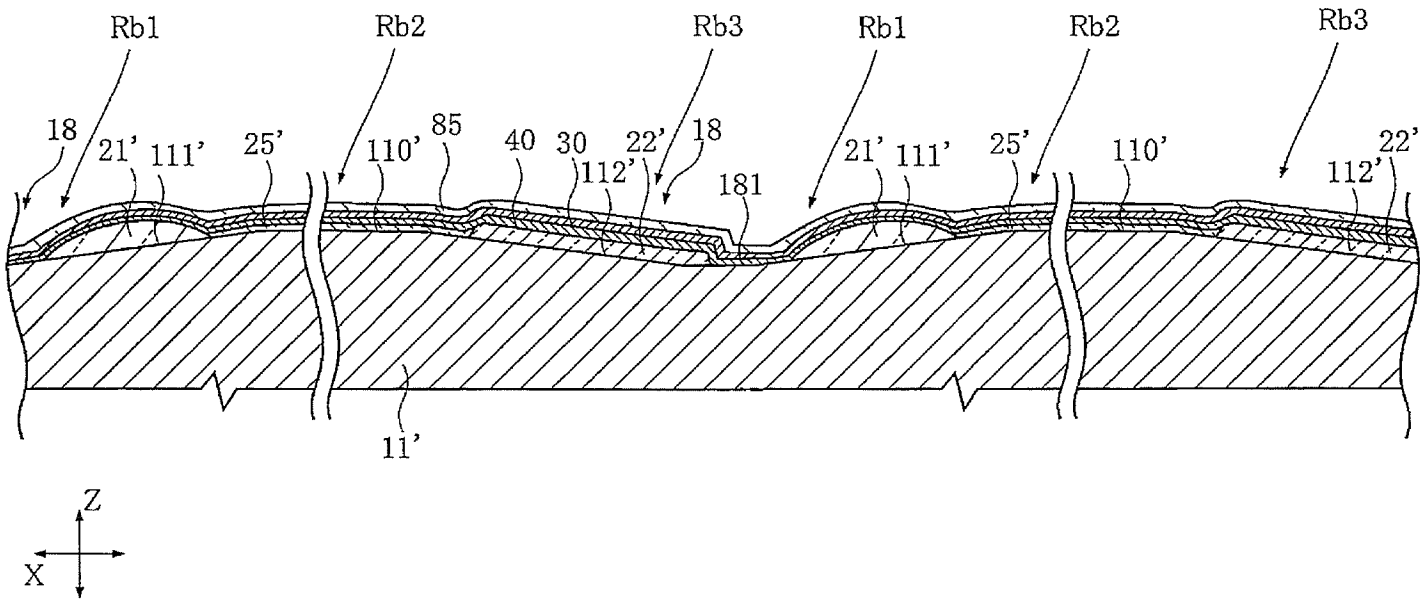
FIG. 14 is a cross-sectional view of the main parts formed with an anti-corrosion layer in the manufacturing process of the thermal printer head according to the first embodiment of the present invention.

Referring to FIG. 14, an anti-corrosion layer 85 is formed on the electrode layer 30. The anti-corrosion layer 85 overlaps with the main surface 110', the first inclined surface 111', the flat surface 181, and the second inclined surface 112'. For example, a roller coater is used to form the anti-corrosion layer 85. In this embodiment, a part of the anti-corrosion layer 85 formed on the first inclined surface 111' that may serve as a laminated surface of the heat dissipation portion is set to a first part Rb1. A part of the anti-corrosion layer 85 formed on the first main surface 110' is set to a second part Rb2. A part of the anti-corrosion layer 85 formed on the second inclined surface 112' that may serve as a joint surface of the wires is set to a third part Rb3.

Figure 15:
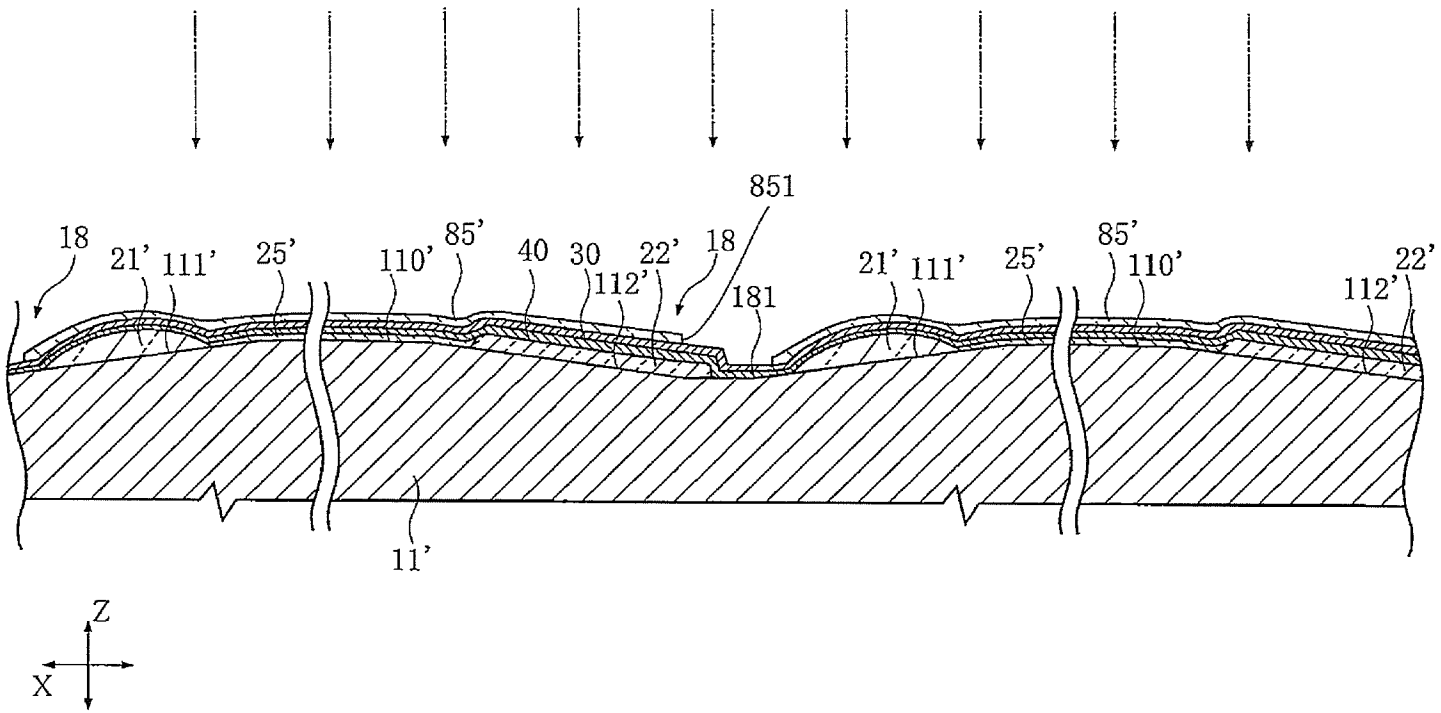
FIG. 15 is a cross-sectional view of the main parts with a part of the anti-corrosion layer removed in the manufacturing process of the thermal printer head according to the first embodiment of the present invention.

Referring to FIG. 15, the anti-corrosion layer 85 is exposed. A first mask having a certain pattern (not shown) is used for exposing the anti-corrosion layer 85. When the anti-corrosion layer 85 is exposed, the first mask is disposed opposite to the anti-corrosion layer 85. The first mask irradiates light (for example, UV light) on the anti-corrosion layer 85. In FIG. 15, arrows are marked to show the irradiation direction of the light. Through the light irradiation on the anti-corrosion layer 85, the pattern on the first mask is transferred to the anti-corrosion layer. 85. In this embodiment, light is also irradiated on areas in the anti-corrosion layer 85 overlapping with the first main surface 110', the first inclined surface 111', the second inclined surface 112', and the flat surface 181, so as to transfer the pattern on the first mask. After that, areas in the anti-corrosion layer 85 that are not irradiated by the light are selectively developed. Thus, an anti-corrosion layer 85' having an opening 851 that exposes the electrode layer 30 is formed.

Figure 16:
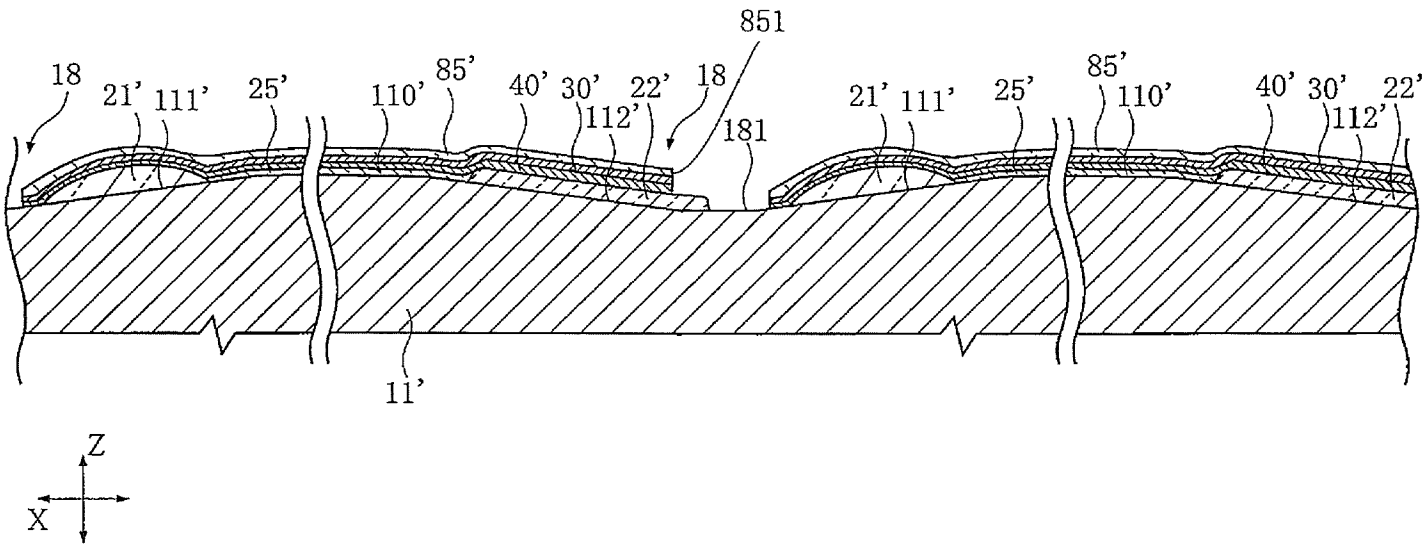
FIG. 16 is a cross-sectional view of the main parts with the resistor layer and the electrode layer etched in the manufacturing process of the thermal printer head according to the first embodiment of the present invention.

Referring to FIG. 16, the electrode layer 30 and the resistor layer 40 are etched together. Therefore, parts of the electrode layer 30 and the resistor layer 40 overlapping with the opening 851 are all etched. The electrode layer 30 and the resistor layer 40 may be etched by, for example, dry etching. Thus, an etched resistor layer 40' and an etched electrode layer 30' are formed.

Figure 17:
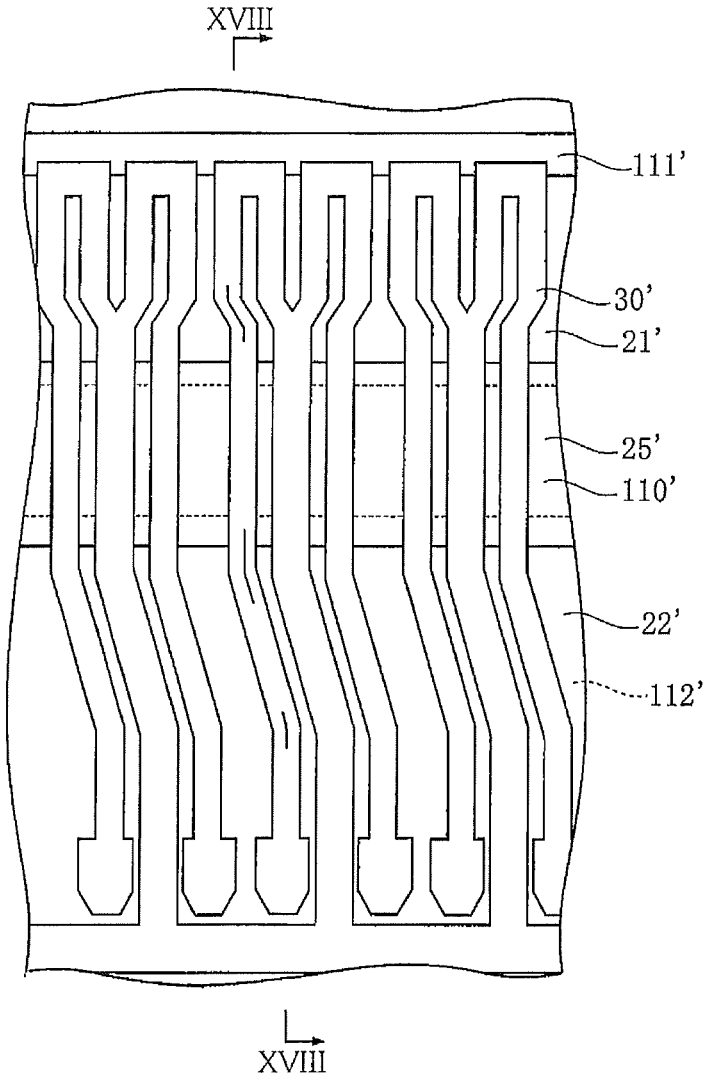
FIG. 17 is a top view of the main parts with the anti-corrosion layer removed in the manufacturing process of the thermal printer head according to the first embodiment of the present invention.
Figure 18:
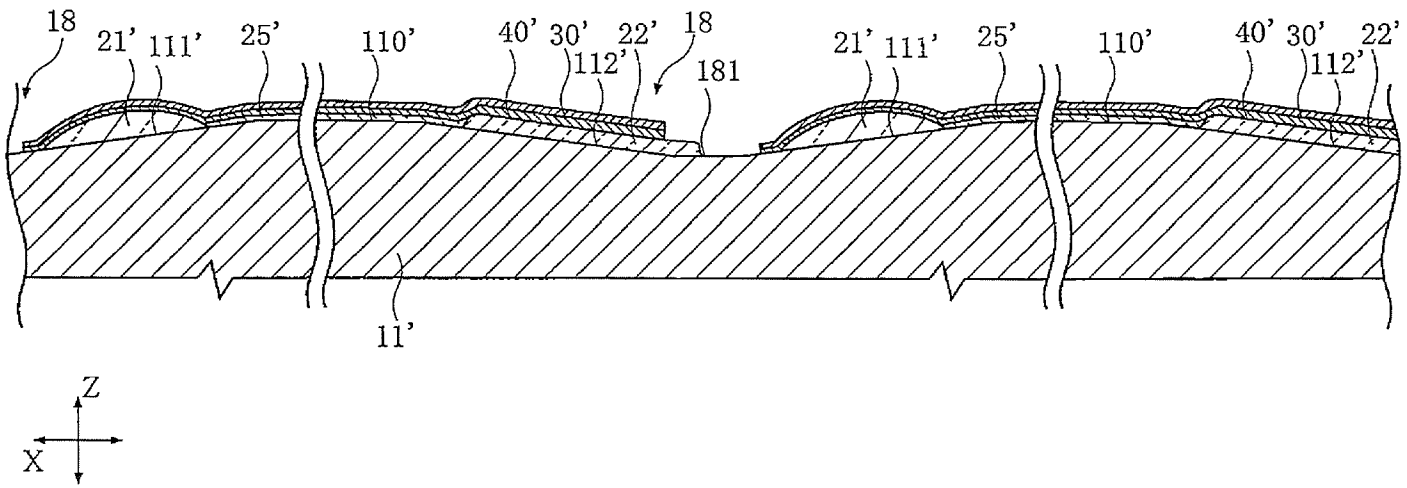
FIG. 18 is a cross-sectional view of the main parts along Line XVIII-XVIII in FIG. 17.

Referring to FIG. 17 and FIG. 18, the anti-corrosion layer 85' is removed, and the electrode layer 30' is exposed.

Figure 19:
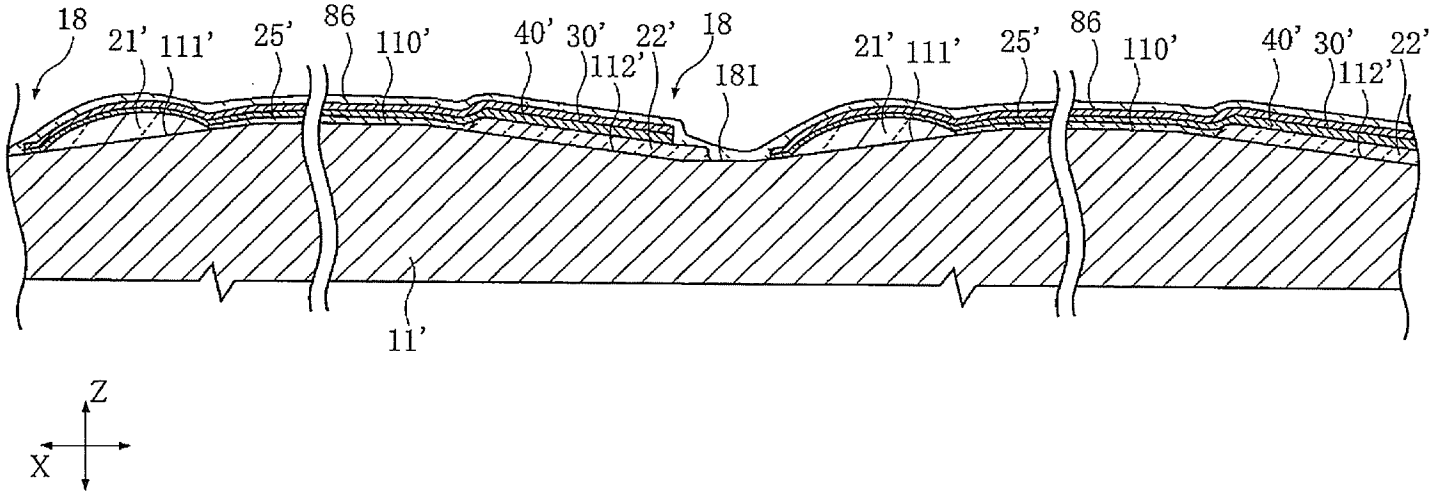
FIG. 19 is a cross-sectional view of the main parts formed with the anti-corrosion layer in the manufacturing process of the thermal printer head according to the first embodiment of the present invention.

Referring to FIG. 19, an anti-corrosion layer 86 is formed on the electrode layer 30'. The anti-corrosion layer 86 overlaps with the first main surface 110', the first inclined surface 111', the flat surface 181, and the second inclined surface 112'. The anti-corrosion layer 86 is formed by, for example, a roller coater.

Figure 20:
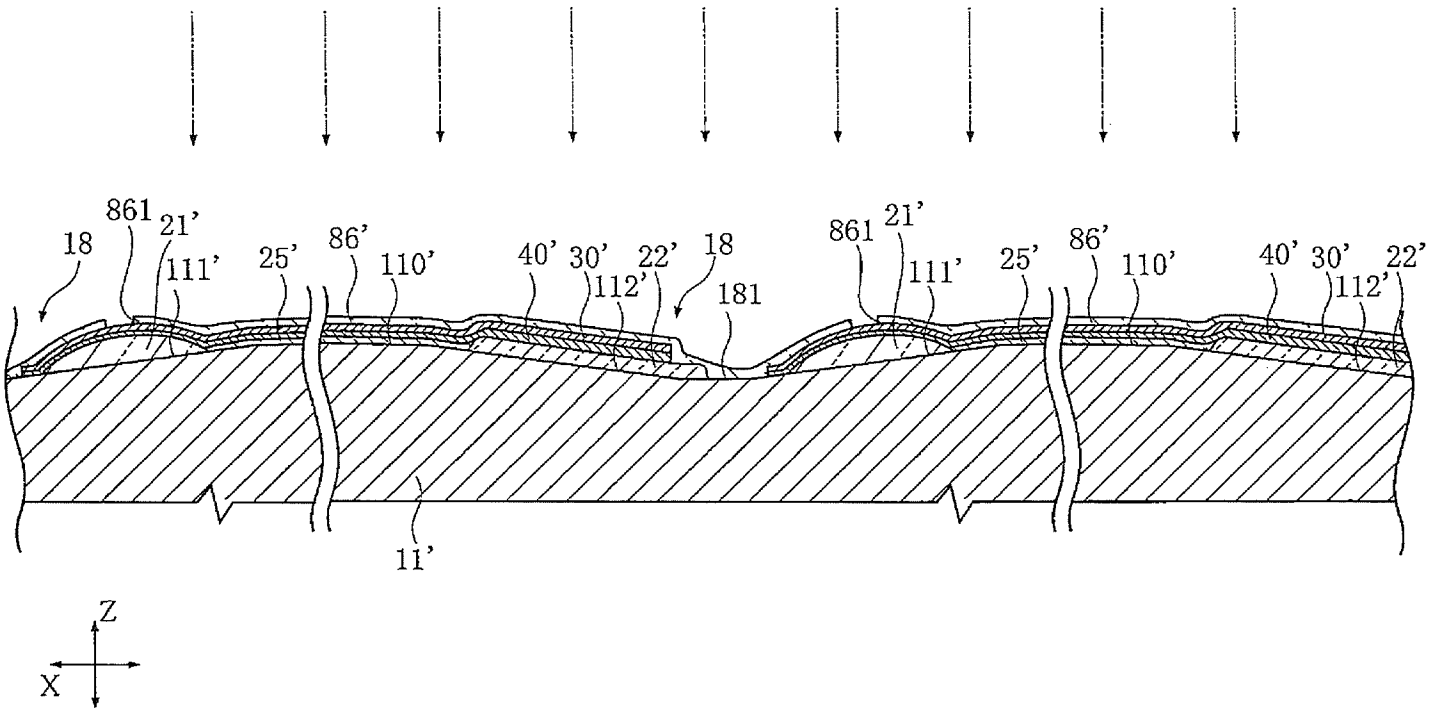
FIG. 20 is a cross-sectional view of the main parts with a part of the anti-corrosion layer removed in the manufacturing process of the thermal printer head according to the first embodiment of the present invention.

Referring to FIG. 20, the anti-corrosion layer 86 is exposed. A second mask having a certain pattern (not shown) is used for exposing the anti-corrosion layer 86. When the anti-corrosion layer 86 is exposed, the second mask is disposed opposite to the anti-corrosion layer 86. The second mask irradiates light (for example, UV light) on the anti-corrosion layer 86. In FIG. 20, arrows are marked to show the irradiation direction of the light. Through the light irradiation on the anti-corrosion layer 86, the pattern on the second mask is transferred to an area of the anti-corrosion layer 86 overlapping with the first inclined surface 111' (an area overlapping with a part of the resistor layer 40' that serves as the heat dissipation portion 41). After that, areas in the anti-corrosion layer 86 that are not irradiated by the light are selectively developed. Thus, an anti-corrosion layer 86' having an opening 861 that exposes the electrode layer 30' is formed.

Figure 21:
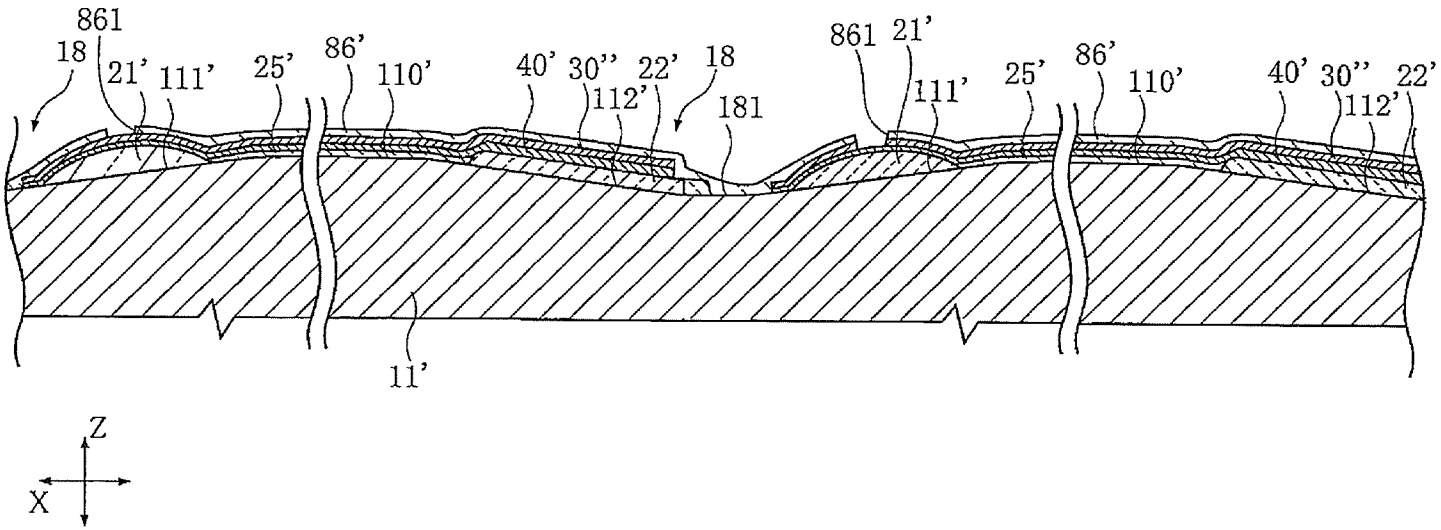
FIG. 21 is a cross-sectional view of the main parts with the electrode layer etched in the manufacturing process of the thermal printer head according to the first embodiment of the present invention.

Referring to FIG. 21, the resistor layer 40' remains, and only the electrode layer 30' is etched. The electrode layer 30' may be etched by, for example, dry etching. Thus, an etched electrode layer 30" is formed.

Figure 22:
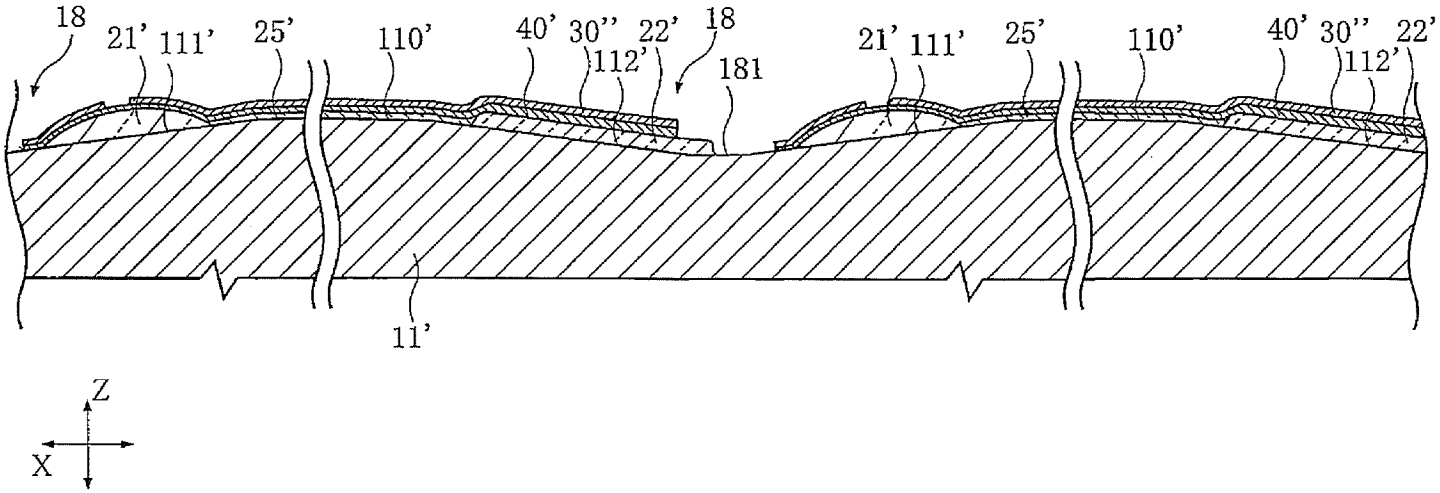
FIG. 22 is a cross-sectional view of the main parts with the anti-corrosion layer removed in the manufacturing process of the thermal printer head according to the first embodiment of the present invention.

Referring to FIG. 22, the anti-corrosion layer 86' is removed, and the electrode layer 30" is exposed.

Figure 23:
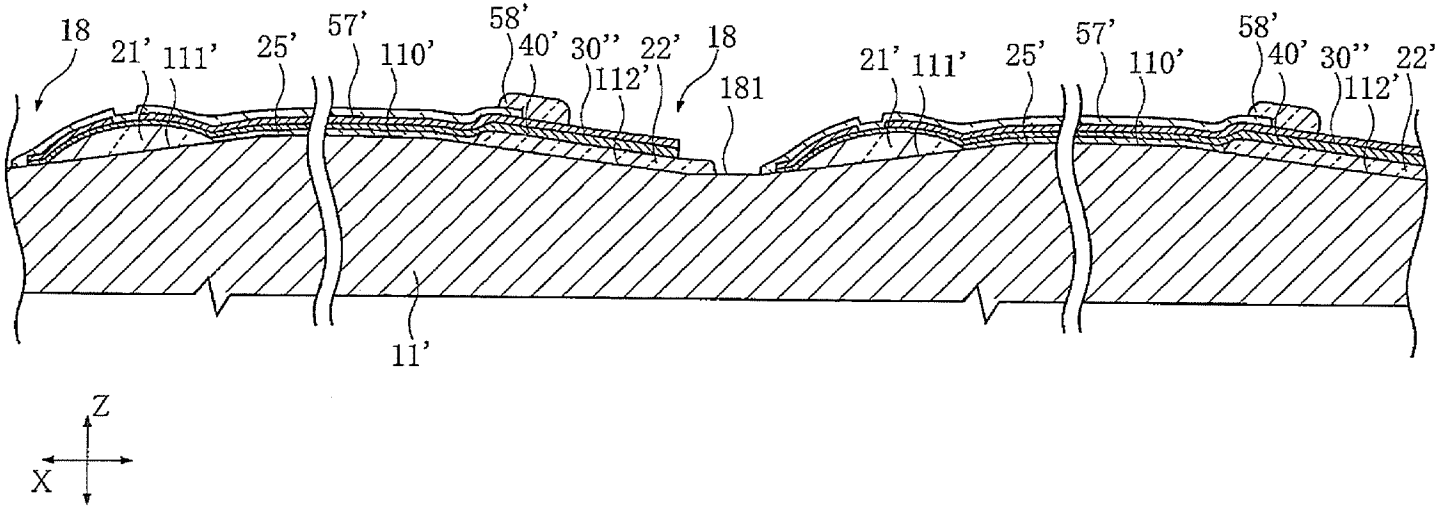
FIG. 23 is a cross-sectional view of the main parts formed with a first protection portion and a second protection portion in the manufacturing process of the thermal printer head according to the first embodiment of the present invention.

Referring to FIG. 23, a first protection portion 57' is formed. After the masks used for exposing the desired areas are formed, in this embodiment, for example, sputtering or Chemical Vapor Deposition (CVD) is performed on $SiO_2$ to form the first protection portion 57'. Then, a second protection portion 58' is formed. For example, a resin material is coated on a part of the first protection portion 57' and a part of the electrode layer 30" to form the second protection portion 58'.

Figure 24:
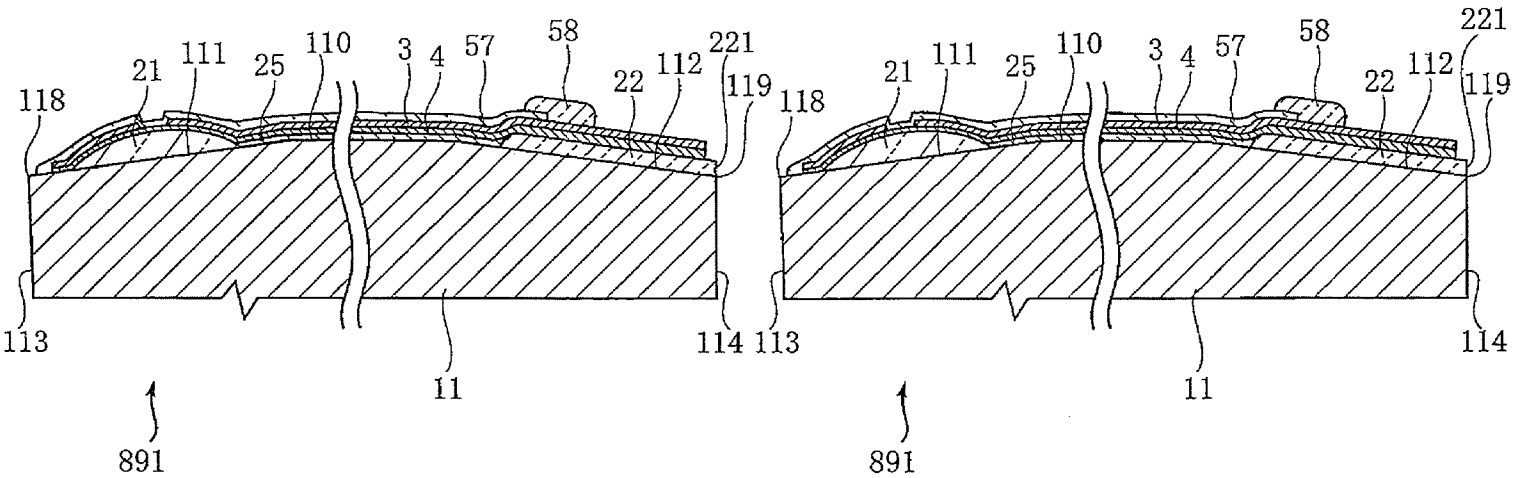
FIG. 24 is a cross-sectional view of the main parts with the base material cut in the manufacturing process of the thermal printer head according to the first embodiment of the present invention.

Referring to FIG. 24, the base material 11' is cut along the grooves 18 and the direction X (the figure showing that the base material 11' is cut along the direction X is omitted). Therefore, fixed plates 891 having the electrode layer 3 and the resistor layer 4 are formed on the first substrates 11. When the base material 11' is cut, the substrate lateral 113 and the substrate lateral 114 are formed on the first substrate 11. The substrate laterals 113 and 114 are cross-sections when the base material 11' is cut. In this embodiment, as described above, the first protection portion 57 or the second protection portion 58 is formed on the base material 11' before the base material 11' is cut. Thus, the first protection portion 57 or the second protection portion 58 is not formed on the substrate lateral 113 and the substrate lateral 114. Further, in this embodiment, when the base material 11' is cut, the second glaze layer 22' is cut at the same time. Thus, the end surface 221 coplanar with the substrate lateral 114 of the first substrate 11 is formed on the second glaze layer 22.

Figure 25:
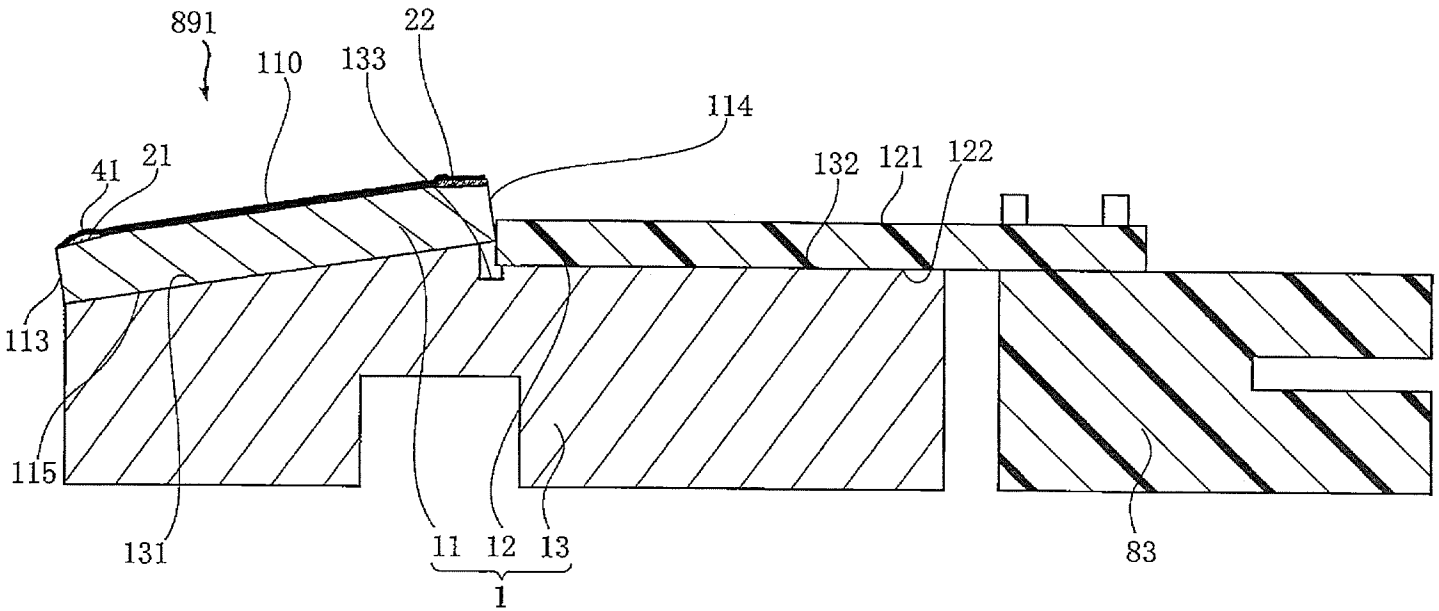
FIG. 25 is a cross-sectional view of the main parts with a fixed plate and a second substrate joined to a heat dissipation plate in the manufacturing process of the thermal printer head according to the first embodiment of the present invention.
Figure 26:
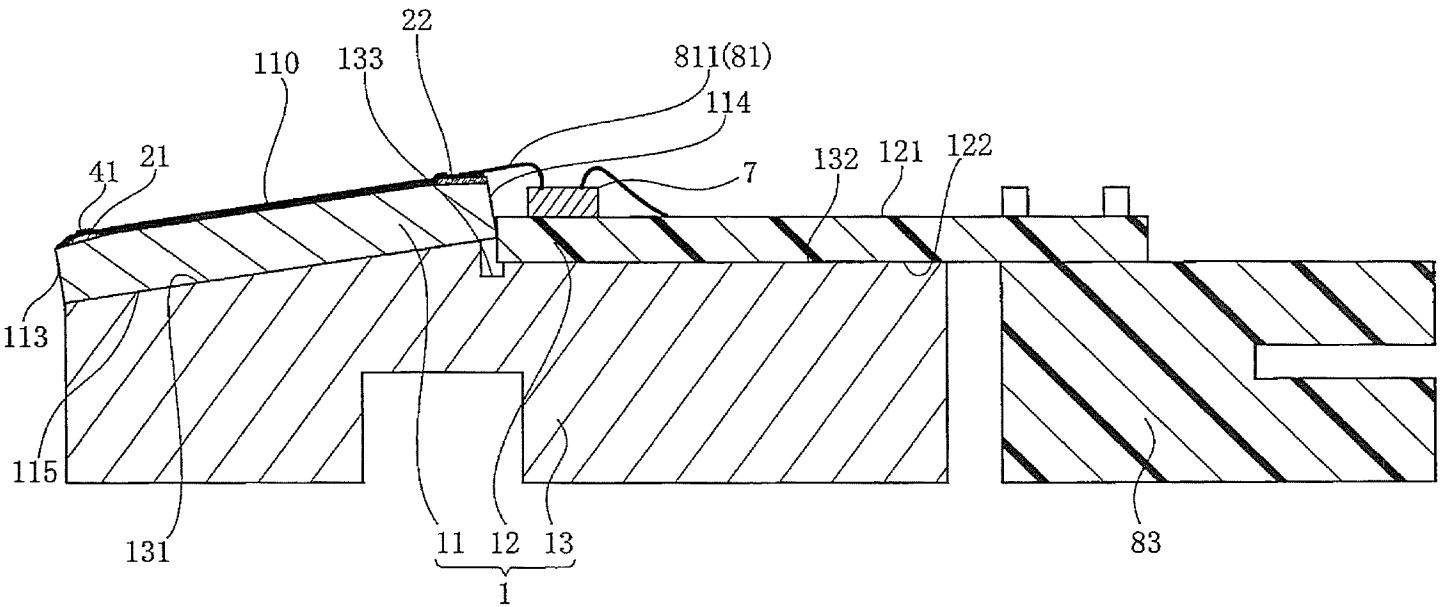
FIG. 26 is a cross-sectional view of the main parts disposed with a driving IC and wires in the manufacturing process of the thermal printer head according to the first embodiment of the present invention.

Referring to FIG. 25, the fixed plate 891 and the second substrate 12 installed with the connector 83 are joined to the heat dissipation plate 13. Referring to FIG. 26, the driving IC 7 is disposed on the second substrate 12. After the wires 81 are respectively joined to the driving IC 7 and the second inclined surface 112, the sealing resin 82 (referring to FIG. 2) is used to cover the wires 81 and the driving IC 7. Thereby, the thermal printer head 101 is manufactured.

The effects of this embodiment are illustrated below.

The thermal printer head 101 of this embodiment facilitates high manufacturing efficiency in the following aspects.

Generally, when the anti-corrosion layers used for forming the electrode layer on the substrate are exposed, all the anti-corrosion layers may not be exposed at a time. The reason is that during one exposure process, only the parts of the anti-corrosion layer in the exposure areas can be exposed. The exposure areas refer to areas around a focus of an optical system that irradiates light for exposure. The exposure area is a thin (for example, below 200 μm) layered area along a plane perpendicular to the irradiation direction of the light for exposure. Since the parts outside the exposure areas deviate substantially from the focus of the optical system that irradiates light for exposure, the parts in the anti-corrosion layer outside the exposure areas are not appropriately exposed.

Figure 51:
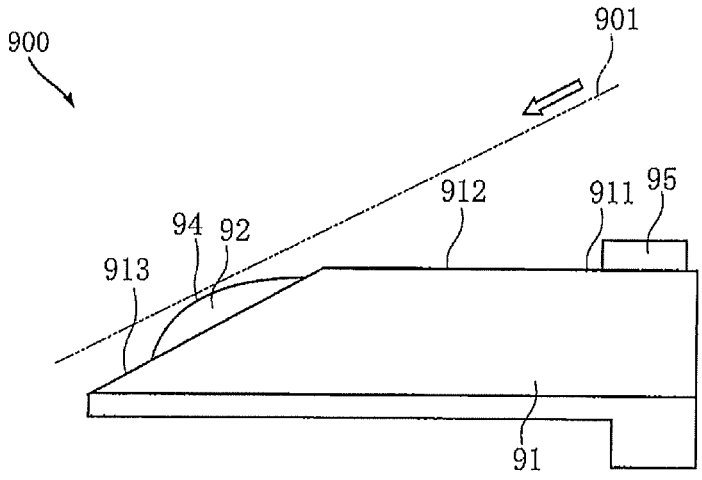
FIG. 51 is a side view of a conventional thermal printer head.

In the conventional thermal printer head 900 (referring to FIG. 51), the surface 911 that may serve as the joint surface of the wires is coplanar with the surface 912 located between the joint surface of the wires and the inclined surface 913 serving as the laminated surface of the heat dissipation portion. Therefore, when an inclined angle of the laminated surface of the heat dissipation portion relative to the joint surface of the wires is set to an angle θ1, an inclined angle of the inclined surface 913 relative to the surface 912 is also set to the angle θ1. In this construction, a part of the inclined surface 913 serving as the laminated surface of the heat dissipation portion (a first part Ra1, not shown) in the anti-corrosion layer (not shown) for aiming the electrode layer on the substrate 91, a part of the surface 912 (a second part Ra2, not shown) in the anti-corrosion layer, and a part of the surface 911 that may serve as the joint surface of the wires (a third part Ra3, not shown) in the anti-corrosion layer are exposed. Since the angle θ1 is large, a lower-left end portion of the inclined surface 913 in FIG. 51 is largely separated from the surface 912 in the irradiation direction of the light for exposure (the thickness direction of the substrate). Therefore, when the second part Ra2 and the third part Ra3 are located in the exposure area during an exposure process, one potential problem is that a lower-left end portion of the first part Ra1 in FIG. 51 leaves the exposure area. Therefore, it is difficult to expose the first part Ra1, the second part Ra2, and the third part Ra3 in an exposure process. In this case, to manufacture the thermal printer head, the first part Ra1 is exposed after the second part Ra2 and the third part Ra3 are exposed, so an additional exposure process needs to be performed. In order to perform the additional exposure process, the posture of the product formed with the anti-corrosion layer needs to be changed.

In another aspect, in the thermal printer head 101 of this embodiment, referring to FIG. 5, the first substrate 11 includes the second inclined surface 112, and the second inclined surface 112 is located on one side closer to the direction Xb than the first main surface 110 and inclined relative to the first main surface 110 in a manner of being distant from the first main surface 110 and facing an opposite direction as the first main surface 110. The electrode layer 3 is laminated on the second inclined surface 112. Each wire 811 is joined to the second inclined surface 112 through the electrode layer 3. In this construction, an inclined angle of the first inclined surface 111 serving as the laminated surface of the heat dissipation portion relative to the second inclined surface 112 serving as the joint surface of the wires is set to the angle θ1 the same as the inclined angle of the laminated surface of the heat dissipation portion in the conventional thermal printer head 900 relative to the joint surface of the wires. In this case, the inclined angle θ2 of the first inclined surface 111 relative to the first main surface 110 located between the joint surface of the wires and the laminated surface of the heat dissipation portion plus the inclined angle θ3 of the second inclined surface 112 relative to the first main surface 110 is the angle θ1. Therefore, the inclined angle θ2 of the first inclined surface 111 relative to the first main surface 110 and the inclined angle θ3 of the second inclined surface 112 relative to the first main surface 110 are both smaller than the angle θ1.

According to this construction, even if the inclined angle of the first inclined surface 111' relative to the second inclined surface 112' in FIG. 14 and FIG. 15 is the larger angle θ1 (for example, around 20°), the inclined angle of the first inclined surface 111' relative to the first main surface 110' (the same as the inclined angle θ2) and the inclined angle of the second inclined surface 112' relative to the first main surface 110' (the same as the inclined angle θ3) are both smaller than the angle θ1, and are, for example, around 10°. Therefore, it is not necessary to make a lower-left end portion of the first inclined surface 111' in FIG. 14 and a lower-right end portion of the second inclined surface 112' in this figure largely separated from the first main surface 110' in the irradiation direction of the light for exposure (the thickness direction of the base material 11'). In this case, the first part Rb1, the second part Rb2, and the third part Rb3 may be located in the exposure areas in an exposure process. Thus, the first part Rb1, the second part Rb2, and the third part Rb3 may all be exposed in an exposure process. Therefore, the exposure times during the manufacturing of the thermal printer head 101 of this embodiment are reduced, so that the thermal printer head 101 can be manufactured with high efficiency.

In view of the above, to easily change the posture of the product formed with the anti-corrosion layer, the anti-corrosion layer is exposed after the fixed plates are obtained. In another aspect, in this embodiment, as described above, the first part Rb1, the second part Rb2, and the third part Rb3 may all be exposed in an exposure process. That is, the first part Rb1, the second part Rb2, and the third part Rb3 may be exposed without changing the posture of the product formed with the anti-corrosion layer 85. Thus, as shown in FIG. 15, the anti-corrosion layer 85 is exposed before the fixed plates 891 are obtained. The exposure before the fixed plates 891 are obtained improves the efficiency with which the thermal printer head 101 may be manufactured. Moreover, the exposure before the fixed plates 891 are obtained reduces the manufacturing cost and achieves a stable process of manufacturing the thermal printer head 101. In addition, though the exposure before the fixed plates 891 are obtained results in improved manufacturing efficiency, it may also be performed after the fixed plates 891 are obtained.

Referring to FIG. 5, the thermal printer head 101 includes the first glaze layer 21 located between the heat dissipation portions 41 and the first inclined surface 111 and the second glaze layer 22 located between the electrode layer 3 and the second inclined surface 112. As described above, in the thermal printer head 101, the inclined angle 02 of the first inclined surface 111 serving as the laminated surface of the heat dissipation portion relative to the first main surface 110 and the inclined angle 03 of the second inclined surface 112 serving as the joint surface of the wires relative to the first main surface 110 are both set small. Therefore, when the thermal printer head 101 is manufactured, even if the first glaze layer 21' is formed on the first inclined surface 111' when the first main surface 110' is substantially in the horizontal direction as shown in FIG. 10, the first glaze layer 21' does not easily drop. Similarly, even if the second glaze layer 22' is formed on the second inclined surface 112' when the first main surface 110' is substantially in the horizontal direction, the second glaze layer 22' does not easily drop. In this case, when the thermal printer head 101 is manufactured, the first glaze layer 21' and the second glaze layer 22' are formed without changing the posture of the base material 11' when the first main surface 110' is substantially in the horizontal direction. Thus, the thermal printer head 101 facilitates high manufacturing efficiency.

Referring to FIG. 5, the thermal printer head 101 includes the intermediate glass layer 25 laminated on the first main surface 110, the first inclined surface 111, and the second inclined surface 112 and crossing the first glaze layer 21 and the second glaze layer 22. In this construction, the intermediate glass layer 25 is covered on the boundary 116 of the first main surface 110 and the first inclined surface 111 and on the boundary 117 of the first main surface 110 and the second inclined surface 112. As shown in FIG. 11, a fluid having certain viscosity is coated on the first main surface 110 and the first inclined surface 111 to form the intermediate glass layer 25. Thereby, the curved surfaces 251 and 252 are formed on the intermediate glass layer 25. Moreover, in this embodiment, the resistor layer 4 is located between the electrode layer 3 and the first substrate 11. Thus, the electrode layer 3 does not directly contact the sharp boundaries 116 and 117. In this case, the electrode layer 3 does not need to cover a large step, and the electrode layer 3 of the thermal printer head 101 is prevented from disconnection.

Referring to FIG. 7, the thermal printer head 101 includes the second substrate 12 having the second main surface 121 disposed with the driving IC 7. The second inclined surface 112 is located in the thickness direction of the second substrate 12, and on one side of the second main surface 121 facing the driving IC 7 relative to the second main surface 121. According to this construction, a vertical distance from each wire 811 to the second inclined surface 112 is set small. The wire 811 (or the sealing resin 82) may not easily hinder the feed of the print medium 801. Therefore, it is unnecessary to set the inclined angle of the first inclined surface 111 relative to the second inclined surface 112 to be excessively large in order to prevent the wire 811 (or the sealing resin 82) from hindering the feed of the print medium 801. Therefore, the inclined angle θ2 and the inclined angle θ3 may both be set small. In this manner, the first part Rb1, the second part Rb2, and the third part Rb3 may be truly located in the exposure areas in an exposure process. Thus, the thermal printer head 101 of this embodiment can be more efficiently manufactured.

In the thermal printer head 101, since the driving IC 7 is disposed on both the first substrate 11 and the second substrate 12, space is not required to accommodate the driving IC 7 on the first substrate 11. Thus, the first substrate 11 can be miniaturized.

Referring to FIG. 7, the thermal printer head 101 includes the heat dissipation plate 13 installed with the first substrate 11 and the second substrate 12. The first substrate 11 has the rear surface 115 facing an opposite direction of the first main surface 110. Seen from the thickness direction of the second substrate 12, the rear surface 115 overlaps with the second inclined surface 112 and has a part that connects against the heat dissipation plate 13. In this construction, ultrasonic vibration is additionally applied to make the second inclined surface 112 join with the wires 811.

Preferably, the second inclined surface 112 is substantially parallel with the second main surface 121. That is, in the thermal printer head 101, the second inclined surface 112 and the second main surface 121 preferably form an angle of 0° to 5°. In this construction, a widely used wire joining device can be employed to stably and rapidly join the wires 811.

In the thermal printer head 101, the first glaze layer 21 may be made with the same thickness as the conventional thermal printer head 900, so that printing can be performed rapidly.

[Second Embodiment]

The second embodiment of the present invention is illustrated with reference to FIG. 27 to FIG. 50.

Figure 27:
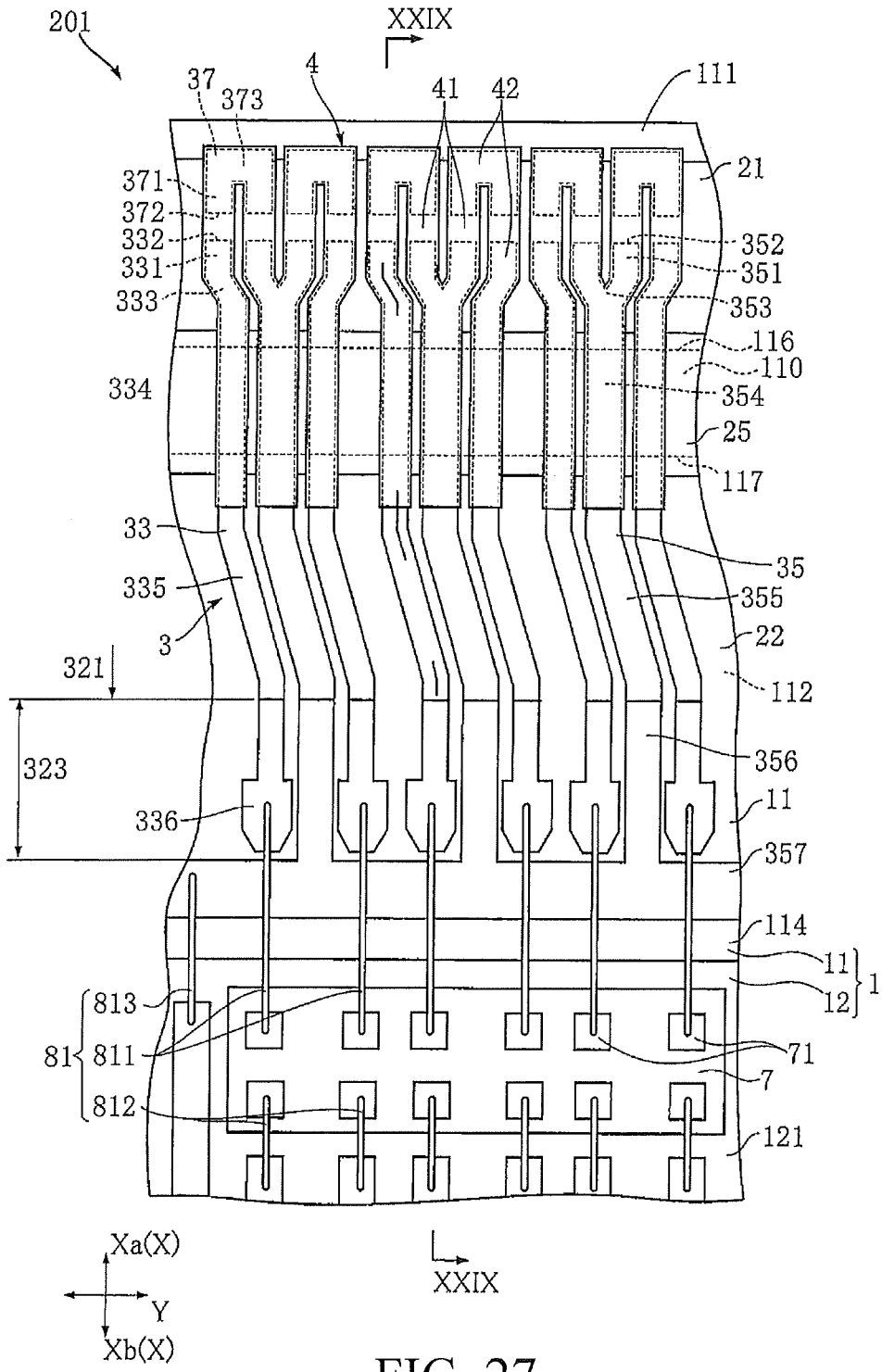
FIG. 27 is a top view of main parts of a thermal printer head according to a second embodiment of the present invention.
Figure 28:
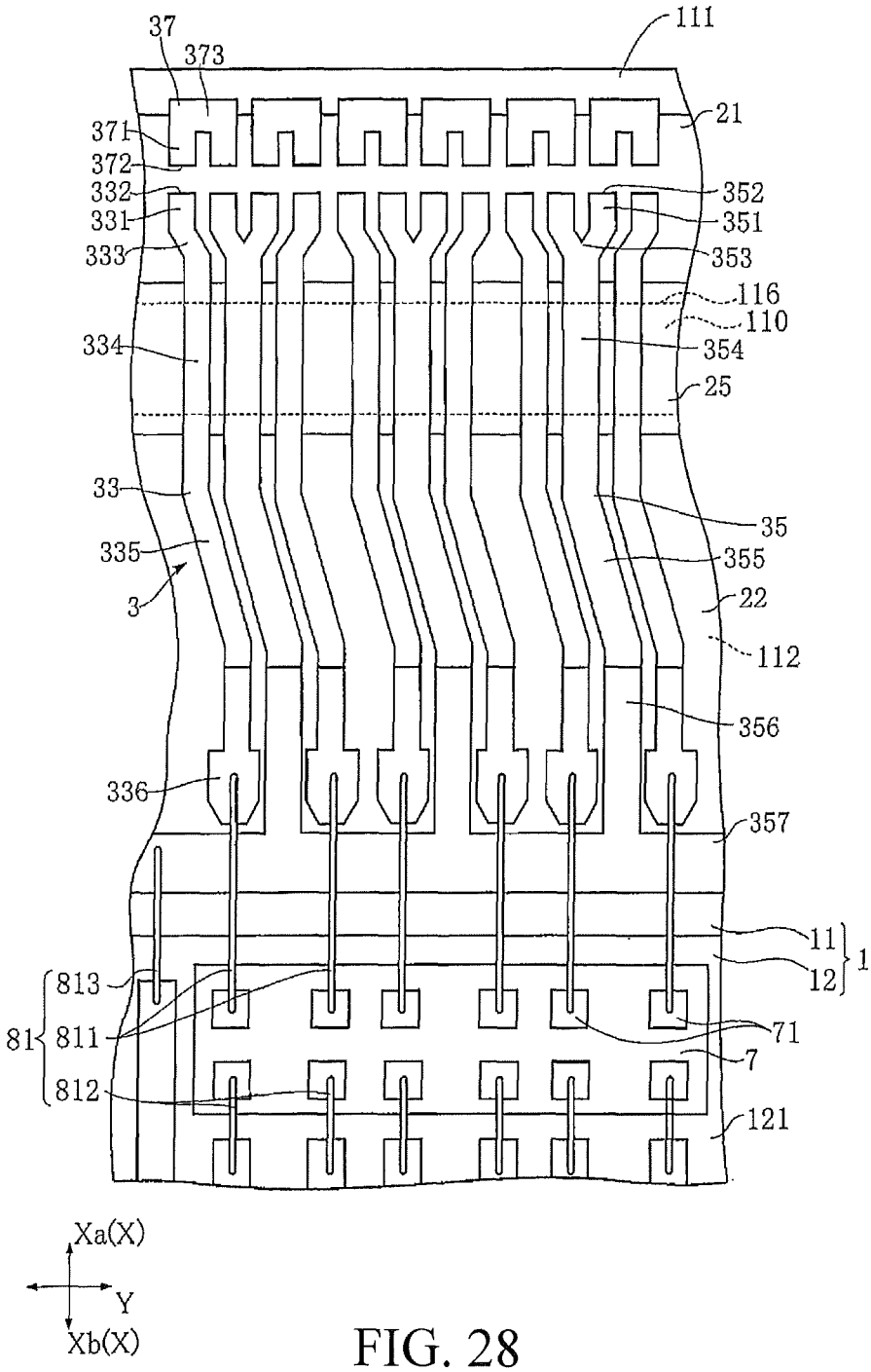
FIG. 28 is a top view of the main parts of the thermal printer head shown in FIG. 27 with a part being omitted.
Figure 29:
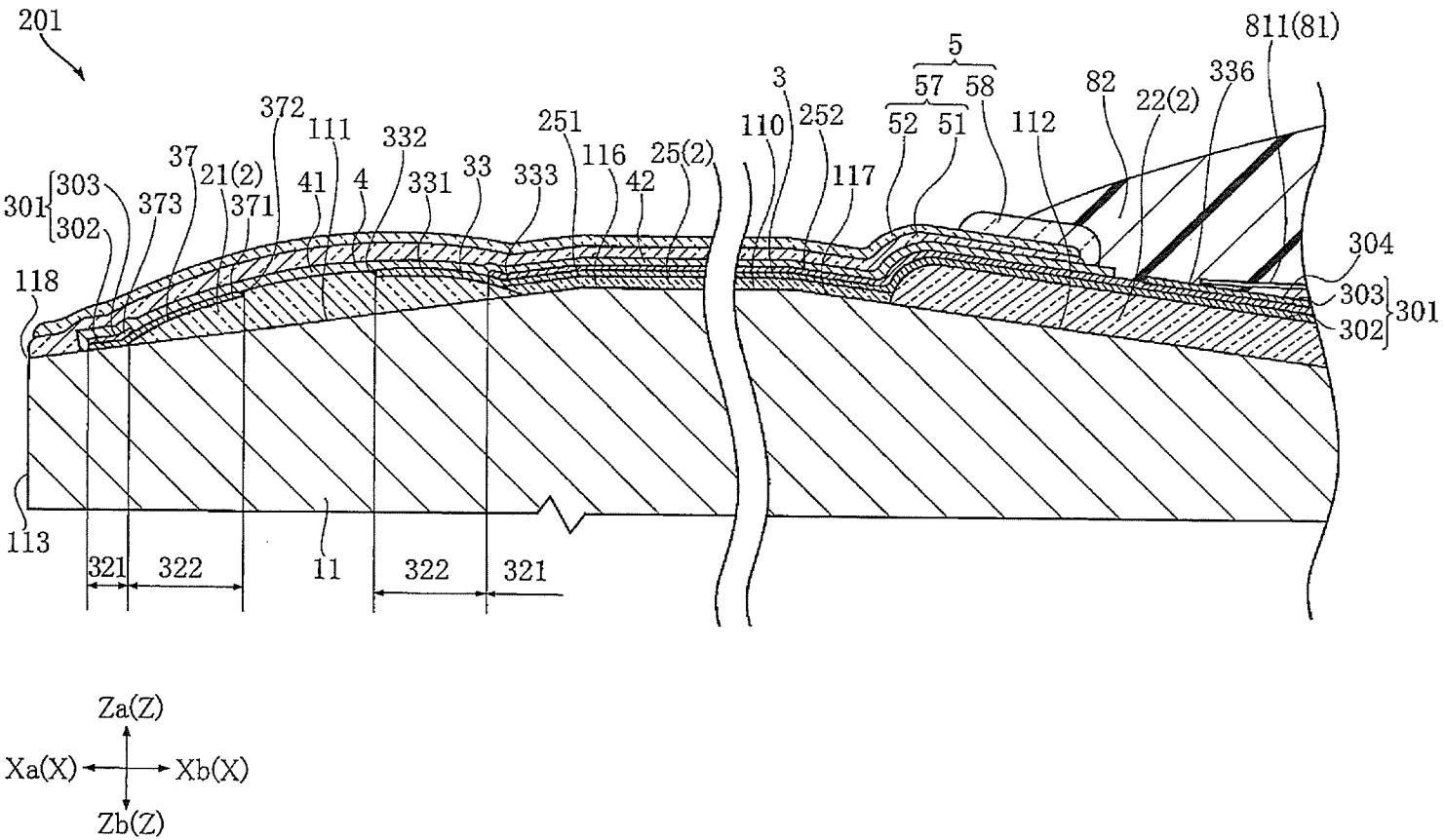
FIG. 29 is a cross-sectional view of the main parts along Line XXIX-XXIX in FIG. 27.
Figure 30:
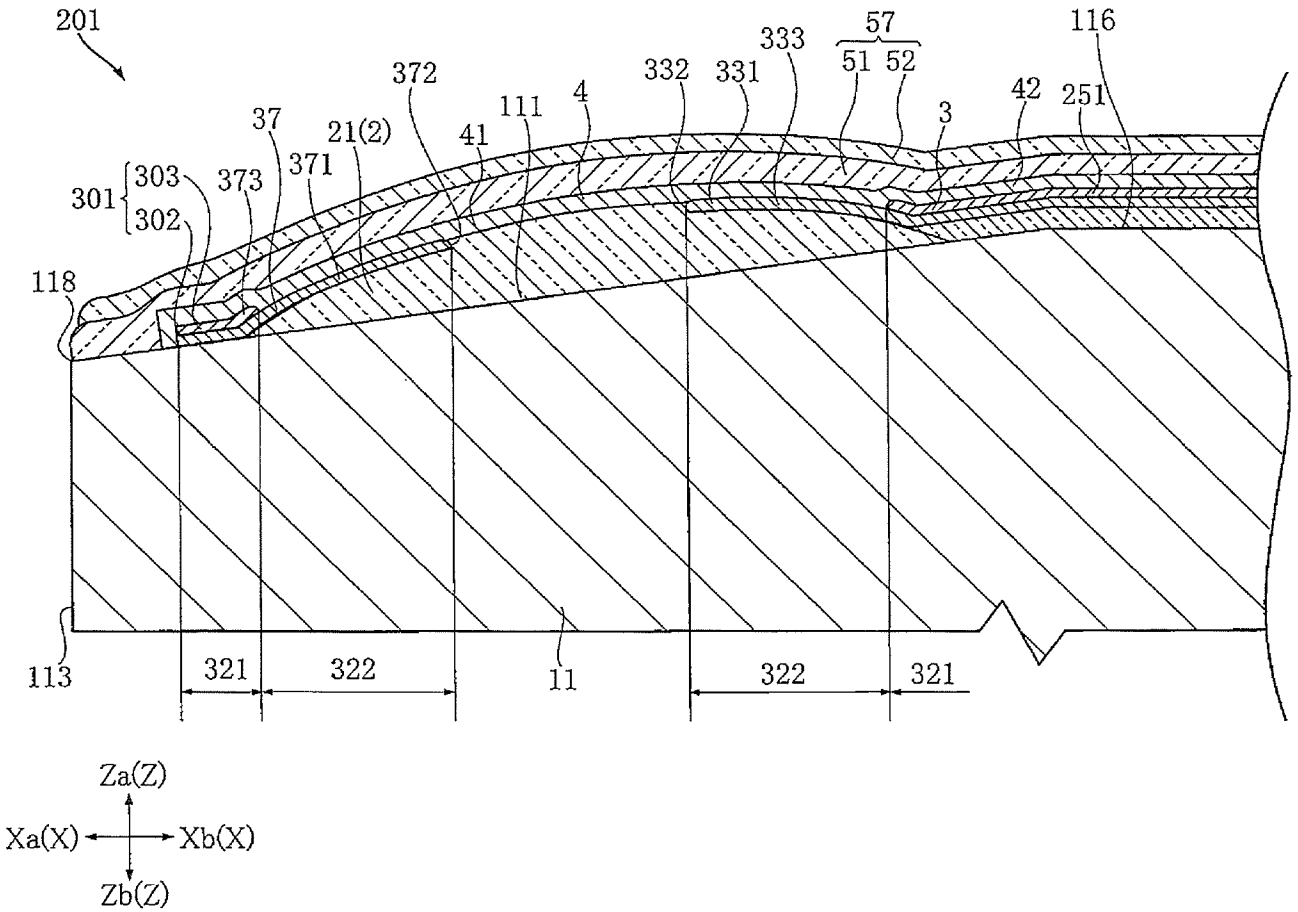
FIG. 30 is a partial enlarged view of the thermal printer head shown in FIG. 29.
Figure 31:
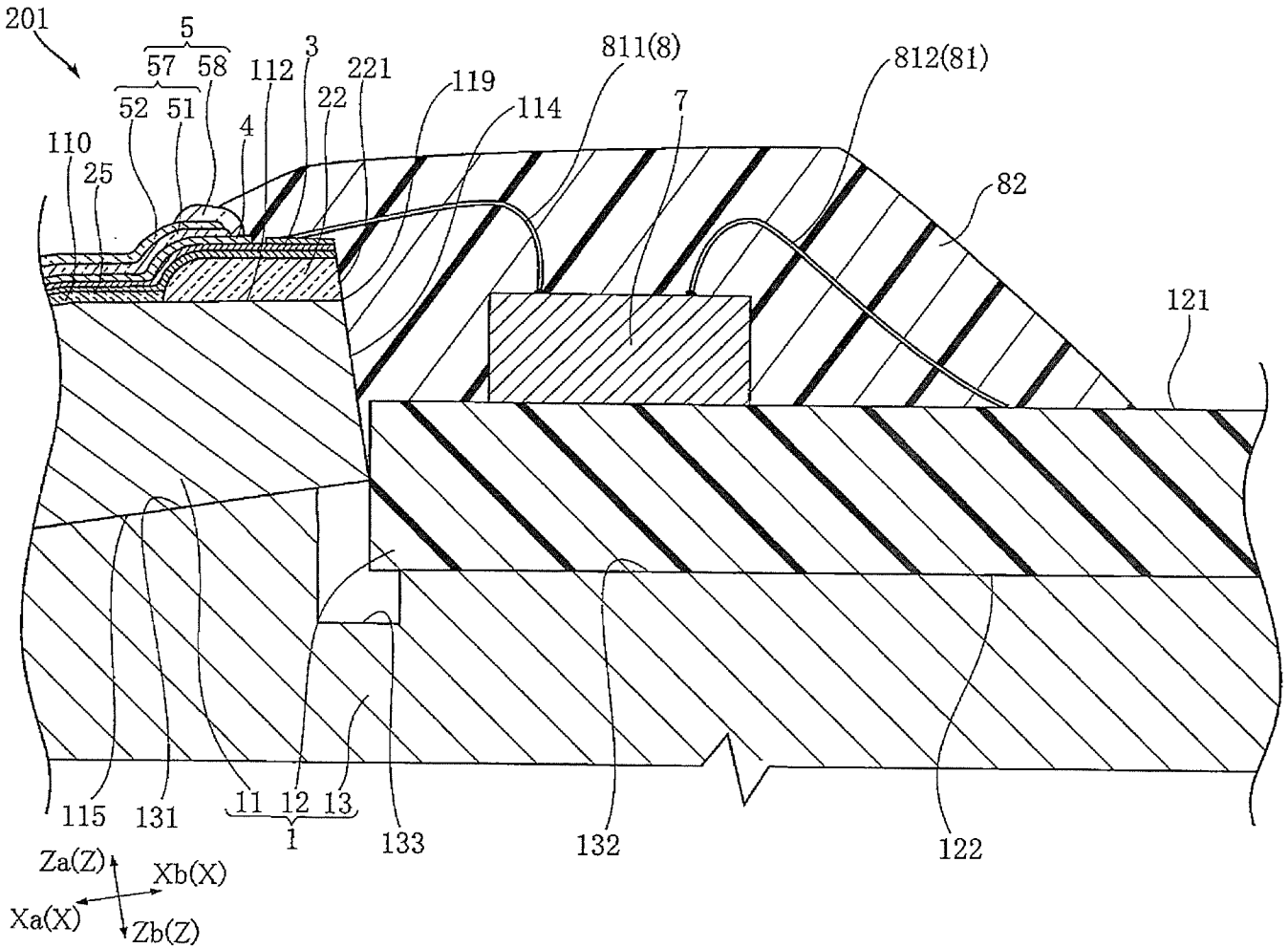
FIG. 31 is a cross-sectional partial enlarged view of the thermal printer head according to the second embodiment of the present invention.

FIG. 27 is a top view of main parts of a thermal printer head according to a second embodiment of the present invention. FIG. 28 is a top view of the main parts of the thermal printer head shown in FIG. 27 with a resistor layer being omitted. FIG. 29 is a cross-sectional view of the main parts along Line XXIX-XXIX in FIG. 27. FIG. 30 is a partial enlarged view of the thermal printer head shown in FIG. 29. FIG. 31 is a cross-sectional partial enlarged view of the thermal printer head according to the second embodiment of the present invention.

Referring to the figures, the thermal printer head 201 includes a support portion 1, a glass layer 2, an electrode layer 3, a resistor layer 4, a protection layer 5, a driving IC 7, a plurality of wires 81, a sealing resin 82, and a connector 83 (not shown). In the thermal printer head 201, except for the electrode layer 3, the resistor layer 4, and the protection layer 5, the support portion 1, the glass layer 2, the driving IC 7, the wires 81, the sealing resin 82, and the connector 83 are all constructed in the same manner as the first embodiment, so the description thereof will not be repeated herein. In this embodiment, the glass layer 2 (including a first glaze layer 21, a second glaze layer 22, and an intermediate glass layer 25) provides a smooth surface suitable for forming the electrode layer 3.

Referring to FIG. 27 to FIG. 31, the electrode layer 3 faints a path for powering the resistor layer 4. Referring to FIG. 29 and FIG. 30, in this embodiment, the electrode layer 3 is located between the first substrate 11 and the resistor layer 4. The electrode layer 3 is laminated on the first glaze layer 21, the intermediate glass layer 25, and the second glaze layer 22. In this embodiment, the electrode layer 3 directly contacts any of the first glaze layer 21, the intermediate glass layer 25, and the second glaze layer 22. Referring to FIG. 27, the electrode layer 3 includes a plurality of individual electrodes 33 (six are shown in the figure), a common electrode 35, and a plurality of relay electrodes 37 (six are shown in the figure). The shapes of the individual electrodes 33, the common electrode 35, and the relay electrodes 37 when seen from above are substantially the same as those in the first embodiment, so the description thereof will not be repeated herein. Referring to FIG. 29 and FIG. 30, a front-end portion of an individual electrode stripe portion 331 of the individual electrode 33 and a front-end portion of a relay electrode stripe portion 371 of the relay electrode 37 (the same as a common electrode stripe portion 351 of the common electrode 35) are sunk relative to the first glaze layer 21. Upper surfaces of the front-end portions of the stripe portions 331, 351, and 371 are respectively sunk to be coplanar with the first glaze layer 21 or to positions slightly above the first glaze layer 21.

In this embodiment, referring to FIG. 29, the electrode layer 3 is formed of a main Au layer 301 and an auxiliary Au layer 304. The main Au layer 301 is formed of, for example, an Au-resinate consisting of around 97% of Au, and elements such as Rh, V, Bi, Si may be added therein. In this embodiment, the main Au layer 301 includes a lower layer 302 and an upper layer 303. The upper layer 303 is laminated on the lower layer 302. The thickness of the lower layer 302 and the upper layer 303 is, for example, around 0.3 μm. The auxiliary Au layer 304 is laminated on the main Au layer 301, and is formed of, for example, an Au-resinate consisting of around 99.7% of Au. The thickness of the auxiliary Au layer 304 is around 0.3 μm. In addition to the above material, the auxiliary Au layer 304 may also be made of a material consisting of, for example, around 60% of Au and mixed with glass powder. In this case, the thickness of the auxiliary Au layer 304 is around 1.1 μm.

Referring to FIG. 27 and FIG. 29, the electrode layer 3 is divided into a normal thick portion 321, a wall thin portion 322, and a wall thick portion 323. The normal thick portion 321 is formed of the main Au layer 301, and takes most parts of the electrode layer 3. The wall thin portion 322 is formed of the lower layer 302, and is equivalent to the parts of opposite edges 332, 352, and 372 of the stripe portions 331, 351, and 371. The wall thick portion 323 is an overlapping part of the main Au layer 301 and the auxiliary Au layer 304, and is equivalent to a joint portion 336, an extending portion 356, and a base portion 357. In this embodiment, the thickness of the normal thick portion 321 is around 0.6 μm, a thickness of the wall thin portion 322 is around 0.3 μm, and a thickness of the wall thick portion 323 is around 0.9 μm. Further, when the auxiliary Au layer 304 is made of a material mixed with the glass powder, the thickness of the wall thick portion 323 is around 1.7 μm. The joint portion 336 is joined to wires 811.

Parts in the resistor layer 4 that the current from the electrode layer 3 passes through dissipate heat. Print dots are formed by the heat dissipation. The resistor layer 4 is made of a material having a resistivity greater than that of the electrode layer 3. Such material may be $TaSiO_2$ or TaN. The thickness of the resistor layer 4 is, for example, around 0.05 μm to 0.2 μm as a thick film. In this embodiment, the electrode layer 3 is located between the resistor layer 4 and the first glaze layer 21. The resistor layer 4 is located between the electrode layer 3 and a first protection portion 57 of the protection layer 5.

Referring to FIG. 27, FIG. 29, and FIG. 30, each heat dissipation portion 41 is laminated on the first glaze layer 21. Each heat dissipation portion 41 crosses separated parts in the electrode layer 3. Specifically, each heat dissipation portion 41 crosses the common electrode stripe portion 351 and the relay electrode stripe portion 371 or crosses the individual electrode stripe portion 331 and the relay electrode stripe portion 371. Each heat dissipation portion 41 is located on the first glaze layer 21, and covers a space between the opposite edge 332 and the opposite edge 372 or covers a space between the opposite edge 352 and the opposite edge 372. The heat dissipation portions 41 are arranged along the direction Y.

Referring to FIG. 27 and FIG. 29, each non-heat dissipation portion 42 is connected to the heat dissipation portion 41. Each non-heat dissipation portion 42 is located between the electrode layer 3 and the protection layer 5. In this embodiment, the non-heat dissipation portion 42 is covered on all the relay electrodes 37, all the individual electrode stripe portions 331, all the common electrode stripe portions 351, all the bent portions 333, all the branch portions 353, and all the straight portions 334 and 354. The non-heat dissipation portion 42 protrudes from each of the stripe portions 331, 351, and 371 in the width direction by around 4 μm.

Referring to FIG. 29 and FIG. 30, the protection layer 5 includes the first protection portion 57 and a second protection portion 58. The construction of the second protection portion 58 is the same as that in the first embodiment, so the description thereof is omitted herein. The first protection portion 57 includes a lower layer 51 and an upper layer 52 laminated with each other. The lower layer 51 is formed of, for example, $SiO_2$, and the thickness thereof is around 2 μm. The upper layer 52 is made of a material consisting, for example, SiC, and the thickness thereof is around 6 μm. The upper layer 52 may further contain carbon. The first protection portion 57 is disposed in an area ranging from approximately one end in the direction X and covering the parts of the straight portions 334 and 354 formed on the second glaze layer 22. The non-heat dissipation portions 42 of the resistor layer 4 are located between the first protection portion 57 and the electrode layer 3. Thus, the first protection portion 57 does not contact the electrode layer 3. The first protection portion 57 may also be a single layer structure formed of TiN.

The application of the thermal printer head 201 is the same as the thermal printer head 101 in the first embodiment, so the details are omitted herein.

A manufacturing method of the thermal printer head 201 is illustrated below with reference to FIG. 32 to FIG. 50.

In this embodiment, steps identical to those in FIG. 8 to FIG. 11 of the first embodiment are performed first.

Figure 32:
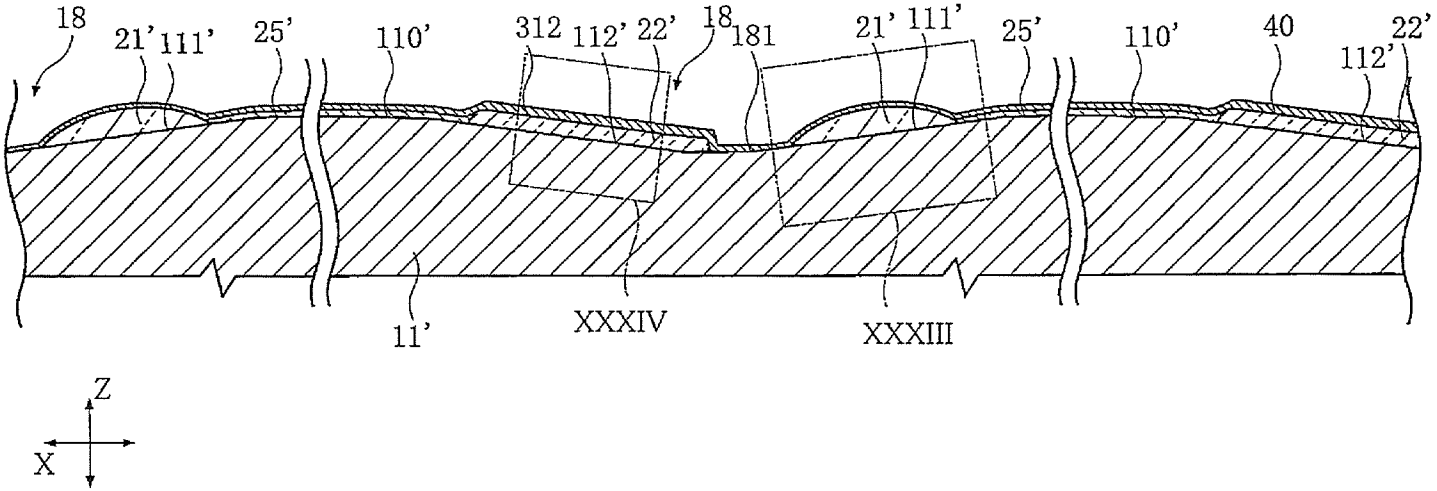
FIG. 32 is a cross-sectional view of the main parts formed with a lower layer of a main Au layer in the manufacturing process of the thermal printer head according to the second embodiment of the present invention.
Figure 33:
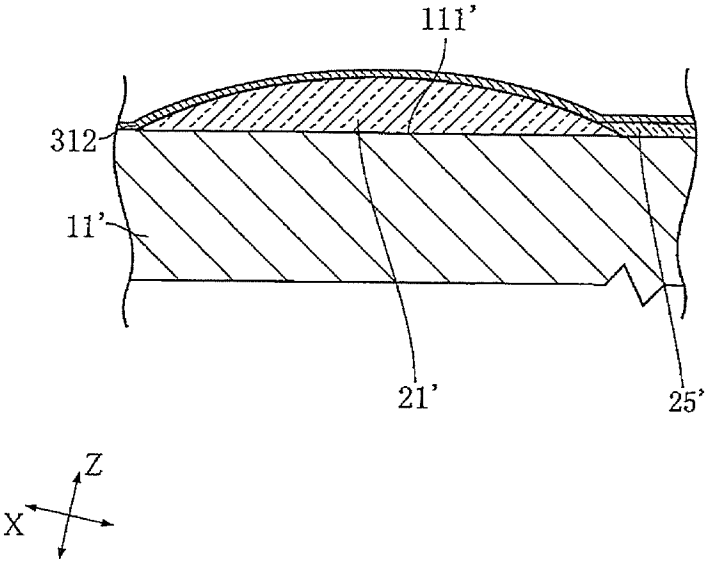
FIG. 33 is a partial enlarged view of an area XXXIII in FIG. 32.
Figure 34:
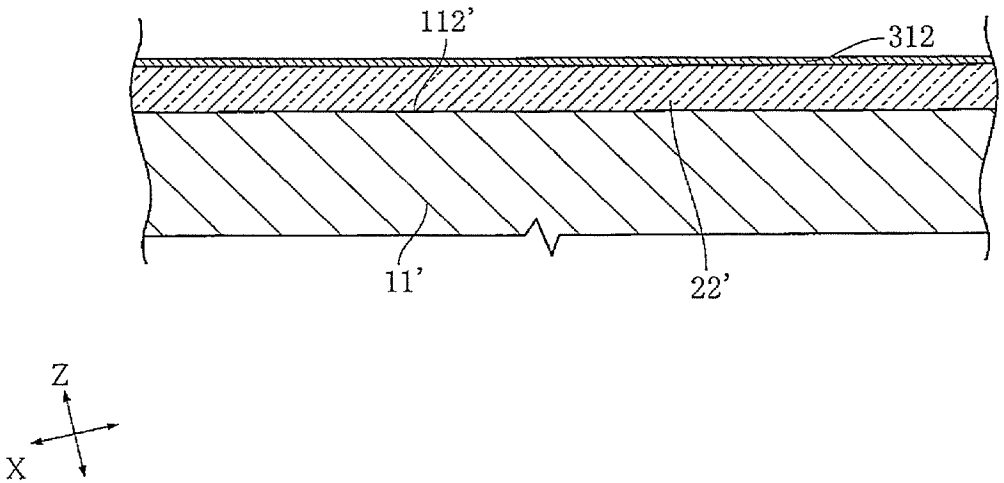
FIG. 34 is a partial enlarged view of an area XXXIV in FIG. 32.

Next, referring to FIG. 32 to FIG. 34, a lower layer 312 is formed. The lower layer 312 overlaps with, for example, the first main surface 110', the first inclined surface 111', the flat surface 181, and the second inclined surface 112'. For example, an Au-resinate paste is thick-film printed on the whole surface of the base material 11', and the thick-film printed Au-resinate paste is burned to faun the lower layer 312. The burning temperature is, for example, 790° C. to 800° C. The thickness of the lower layer 312 is, for example, 0.3 μm, and the content of Au is around 97%.

Figure 35:
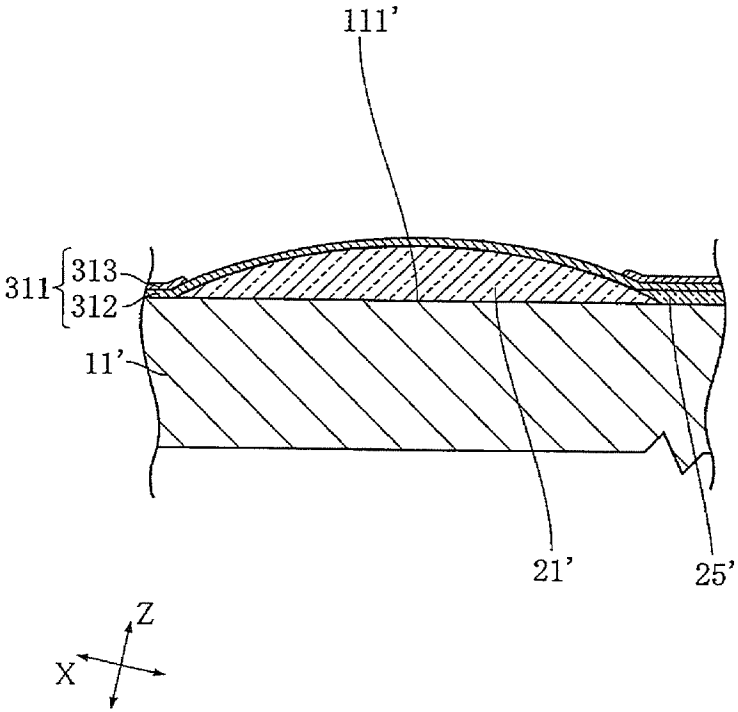
FIG. 35 is a cross-sectional view of the main parts formed with an upper layer of the main Au layer in the manufacturing process of the thermal printer head according to the second embodiment of the present invention.
Figure 36:
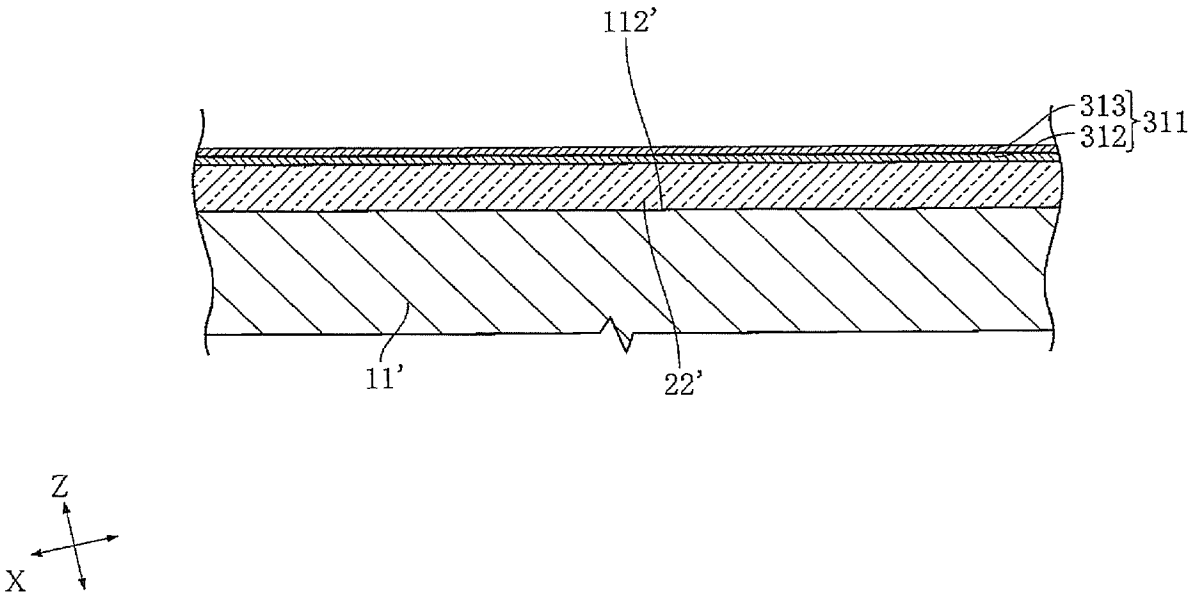
FIG. 36 is a cross-sectional view of the main parts formed with the upper layer of the main Au layer in the manufacturing process of the thermal printer head according to the second embodiment of the present invention.

Referring to FIG. 35 and FIG. 36, an upper layer 313 is formed. For example, an Au-resinate paste is thick-film printed on the lower layer 312, and the thick-film printed Au-resinate paste is burned to form the upper layer 313. When the Au-resinate paste is thick-film printed, as shown in FIG. 35, most of the part of the lower layer 312 covered on the first glaze layer 21' is exposed. The burning temperature is, for example, 790° C. The thickness of the upper layer 313 is, for example, around 0.3 μm, and the content of Au is around 97%. The lower layer 312 and the upper layer 313 are formed to obtain the main Au layer 311.

Figure 37:
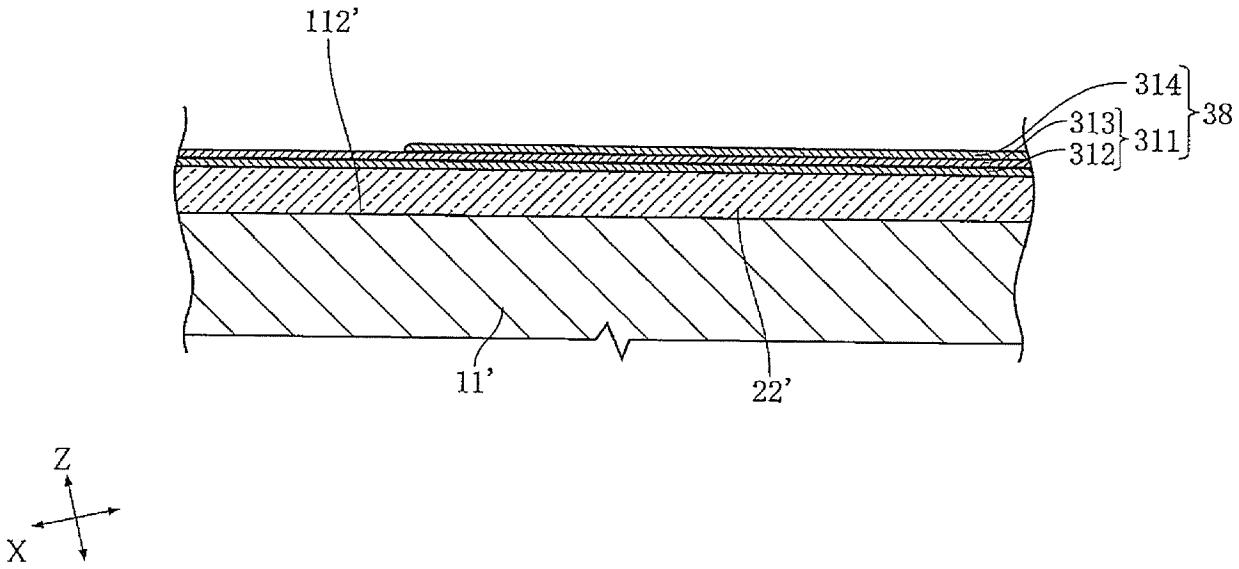
FIG. 37 is a cross-sectional view of the main parts formed with an auxiliary Au layer in the manufacturing process of the thermal printer head according to the second embodiment of the present invention.

Referring to FIG. 37, an auxiliary Au layer 314 is formed. For example, an Au-resinate paste is thick-film printed to cover a part of the main Au layer 311, and the thick-film printed Au-resinate paste is burned to form the auxiliary Au layer 314. The thickness of the auxiliary Au layer 314 is, for example, around 0.3 μm, and the content of Au is around 99.7%. The main Au layer 311 and the auxiliary Au layer 314 are formed to obtain an electrode layer 38 serving as the electrode layer 3 in FIG. 29. Further, a paste containing glass particles and Au may also be thick-film printed, and then burned to form the auxiliary Au layer 314. The thickness of the auxiliary Au layer 314 is around 1.1 μm, and the content of Au is around 60%.

Figure 38:
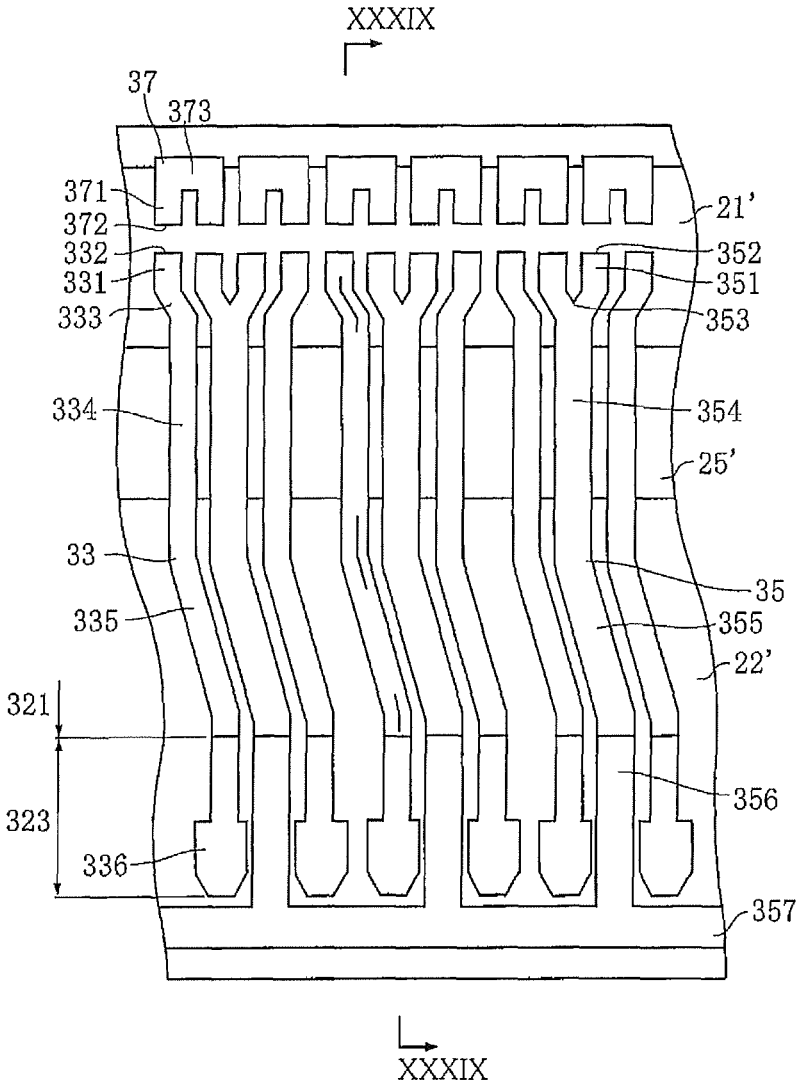
FIG. 38 is a top view of the main parts with the main Au layer and the auxiliary Au layer etched in the manufacturing process of the thermal printer head according to the second embodiment of the present invention.
Figure 38:
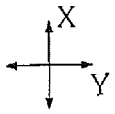
Figure 39:
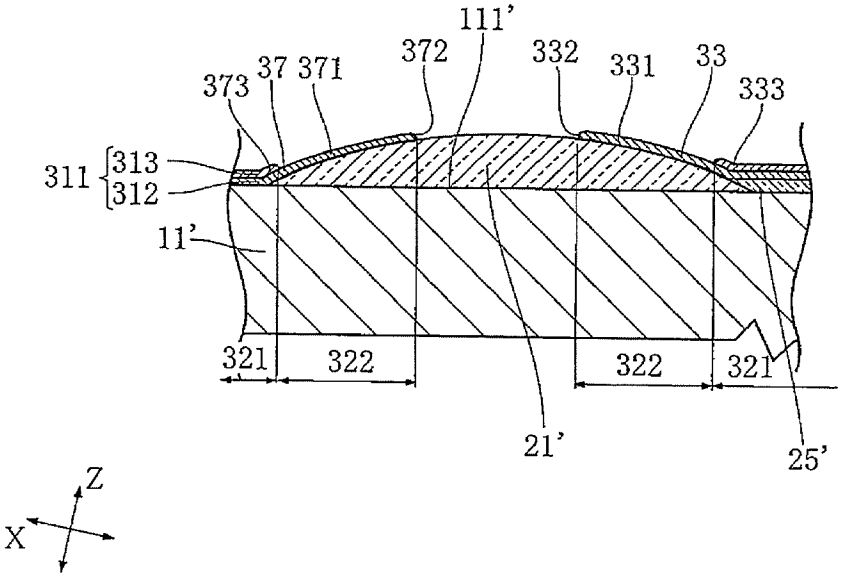
FIG. 39 is a cross-sectional view of the main parts along Line XXXIX-XXXIX in FIG. 38.
Figure 40:
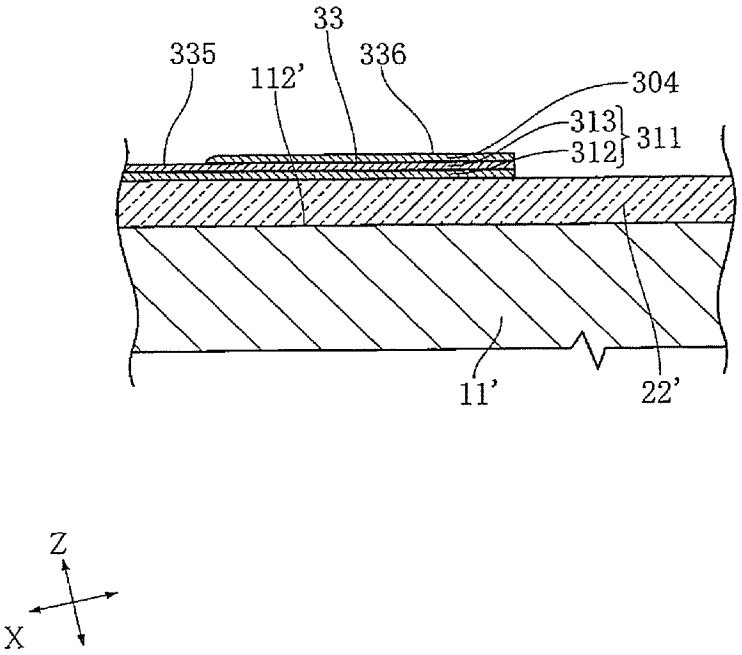
FIG. 40 is a cross-sectional view of the main parts along Line XXXIX-XXXIX in FIG. 38.

Referring to FIG. 38 to FIG. 40, the electrode layer 38 is etched through an exposure process the same as that in the first embodiment. In this manner, the construction shown in the figures is obtained.

Figure 41:
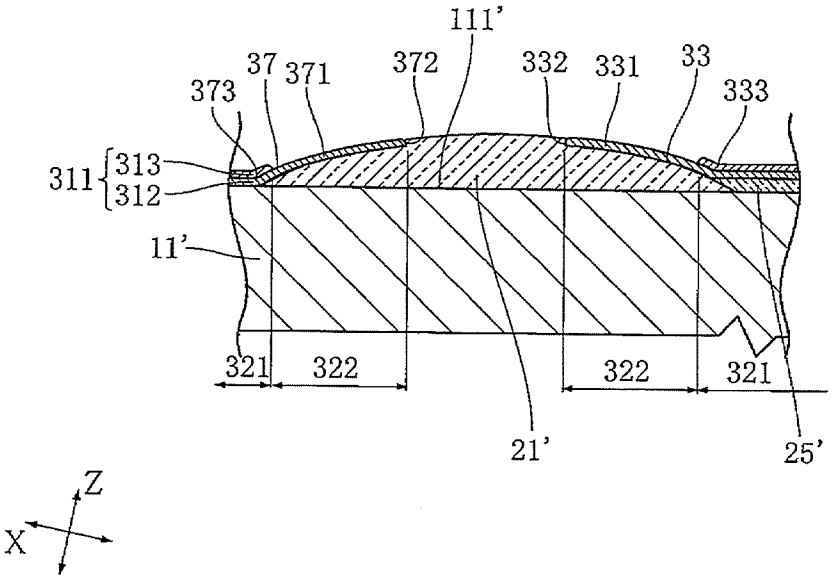
FIG. 41 is a cross-sectional view of the main parts with stripe portions sunk in the manufacturing process of the thermal printer head according to the second embodiment of the present invention.

Thermal treatment is then performed on the base material 11'. In the thermal treatment, for example, a step of heating the whole base material 11' to 830° C. is performed twice. Through the thermal treatment of the base material 11', the first glaze layer 21' is softened. Referring to FIG. 41, the stripe portions 331, 351, and 371 are slightly sunk relative to the first glaze layer 21'. In this embodiment, the thickness of the first glaze layer 21' is smaller, and is around 18 μm to 50 μm. Therefore, upper surfaces of the front-end portions of the stripe portions 331, 351, and 371 are respectively sunk to be coplanar with the upper surface of the first glaze layer 21', and the rear-end portions thereof are substantially not sunk relative to the first glaze layer 21'.

Figure 42:
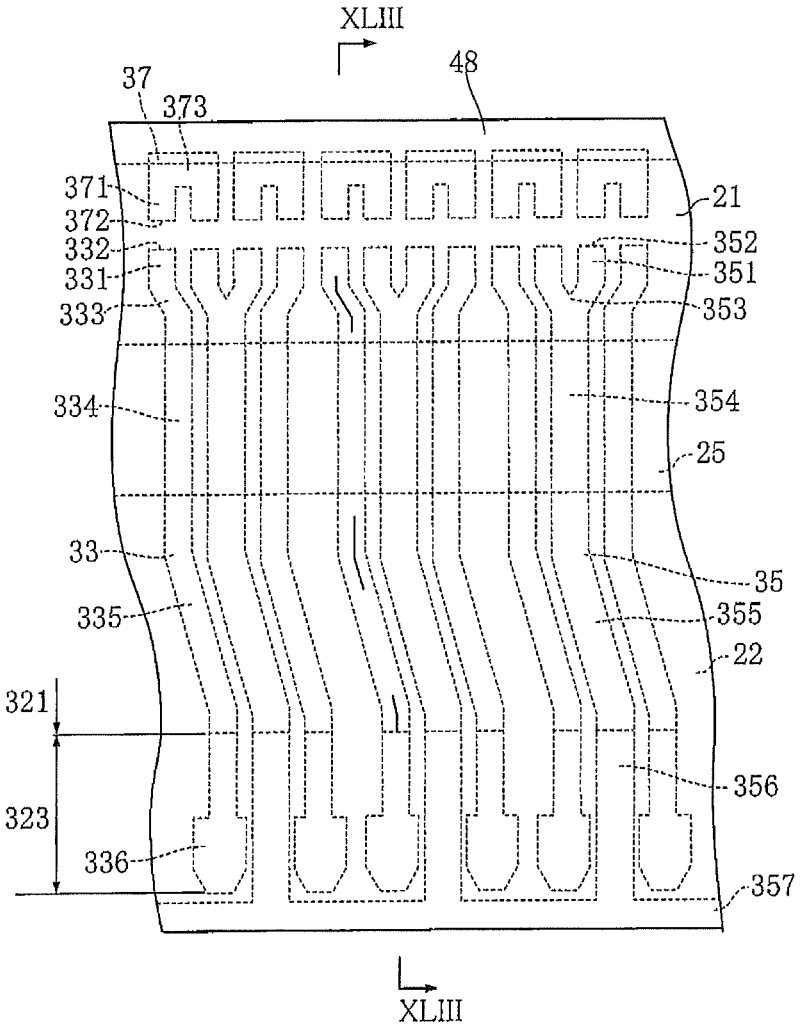
FIG. 42 is a top view of the main parts formed with a resistor layer in the manufacturing process of the thermal printer head according to the second embodiment of the present invention.
Figure 42:
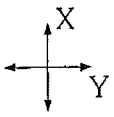
Figure 43:
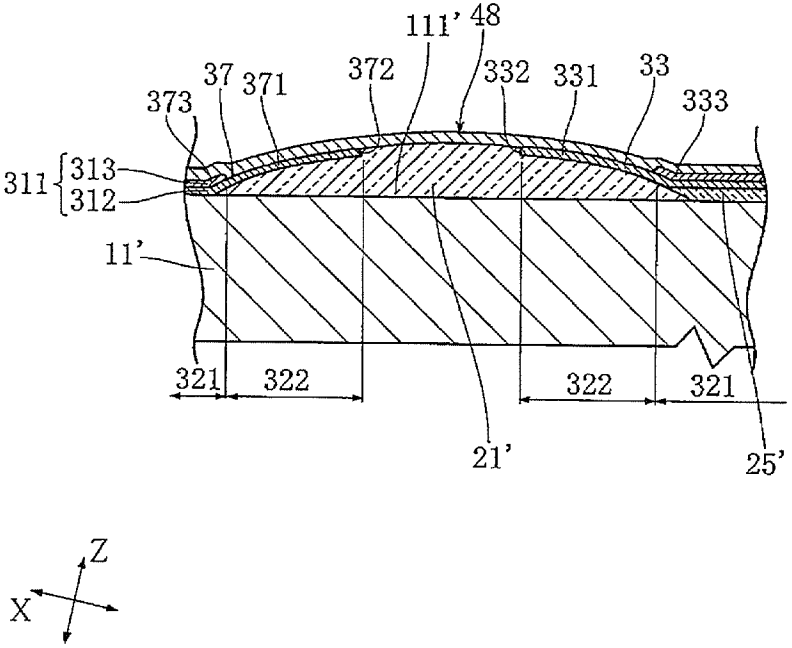
FIG. 43 is a cross-sectional view of the main parts along Line XLIII-XLIII in FIG. 42.

Referring to FIG. 42 and FIG. 43, a resistor layer 48 is formed. The resistor layer 48 overlaps with the main surface 110', the first inclined surface 111', the flat surface 181, and the second inclined surface 112'. For example, sputtering is performed on a material such as $TaSiO_2$ or TaN to form the resistor layer 48.

Figure 44:
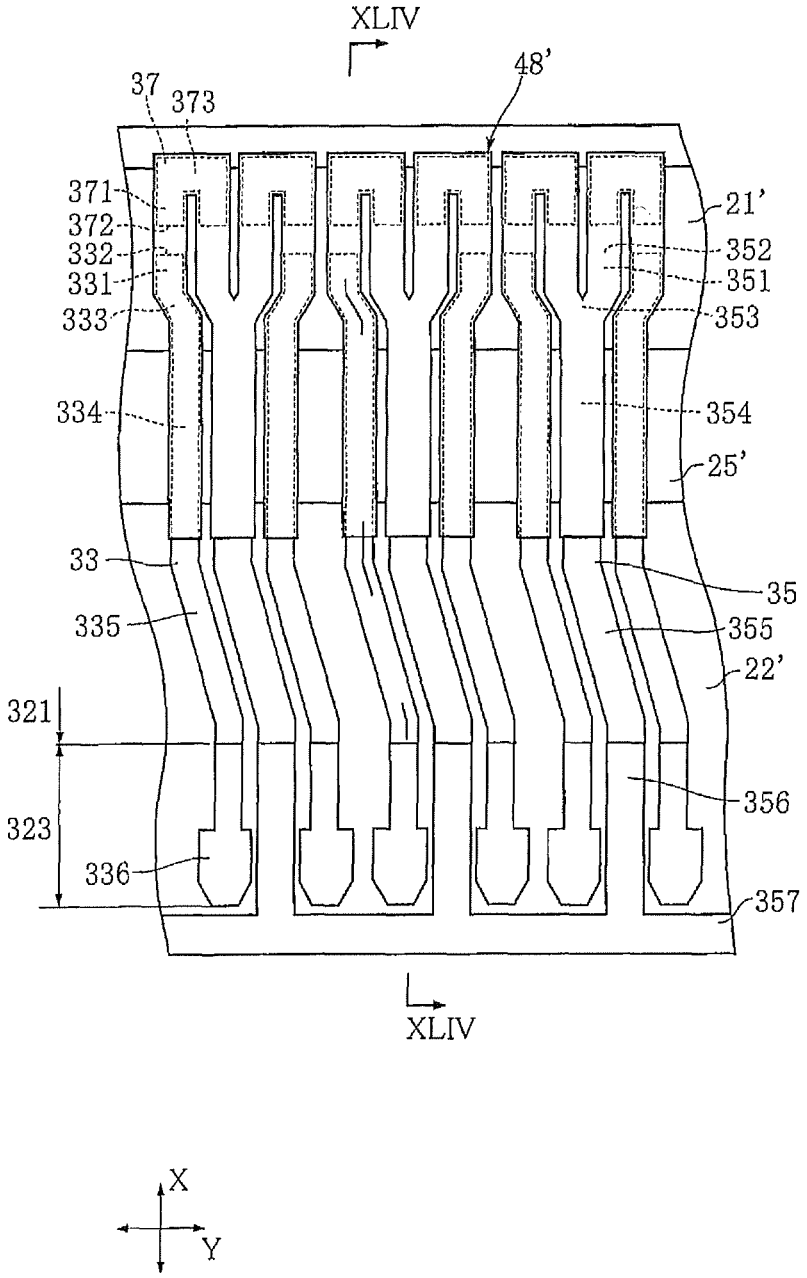
FIG. 44 is a top view of the main parts with the resistor layer etched in the manufacturing process of the thermal printer head according to the second embodiment of the present invention.
Figure 45:
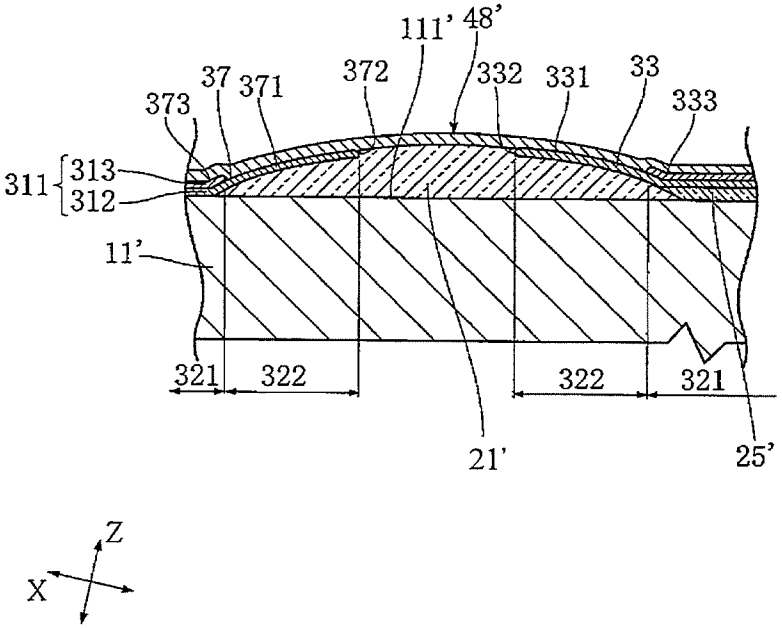
FIG. 45 is a cross-sectional view of the main parts along Line XLIV-XLIV in FIG. 44.

Referring to FIG. 44 and FIG. 45, the resistor layer 48 is etched through an exposure process the same as that in the first embodiment. In this manner, the construction shown in the figures is obtained.

Figure 46:
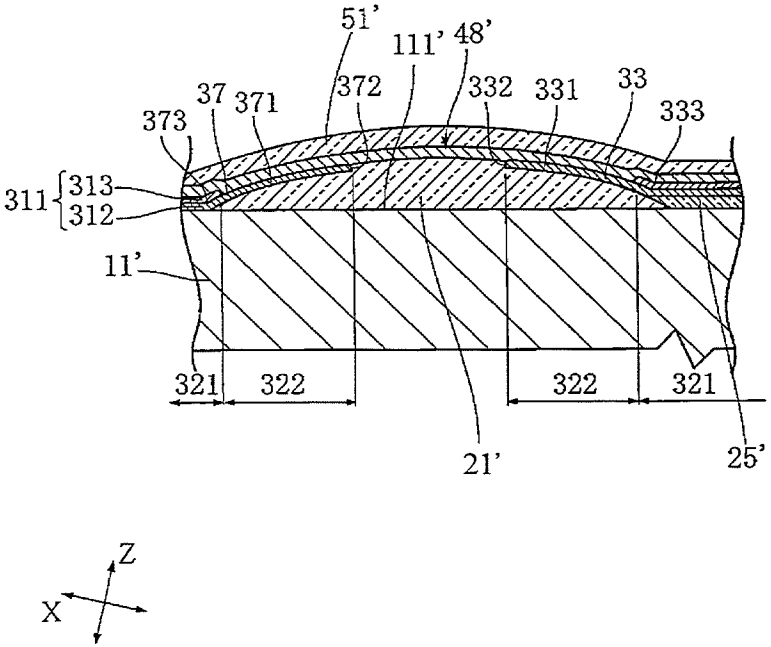
FIG. 46 is a cross-sectional view of the main parts formed with a lower layer of a protection layer in the manufacturing process of the thermal printer head according to the second embodiment of the present invention.

Referring to FIG. 46, a lower layer 51' is formed. After the masks used for exposing the desired areas are formed, in this embodiment, for example, sputtering or CVD is performed on $SiO_2$ to form the lower layer 51'. The thickness of the lower layer 51' is, for example, around 2.0 μm.

Figure 47:
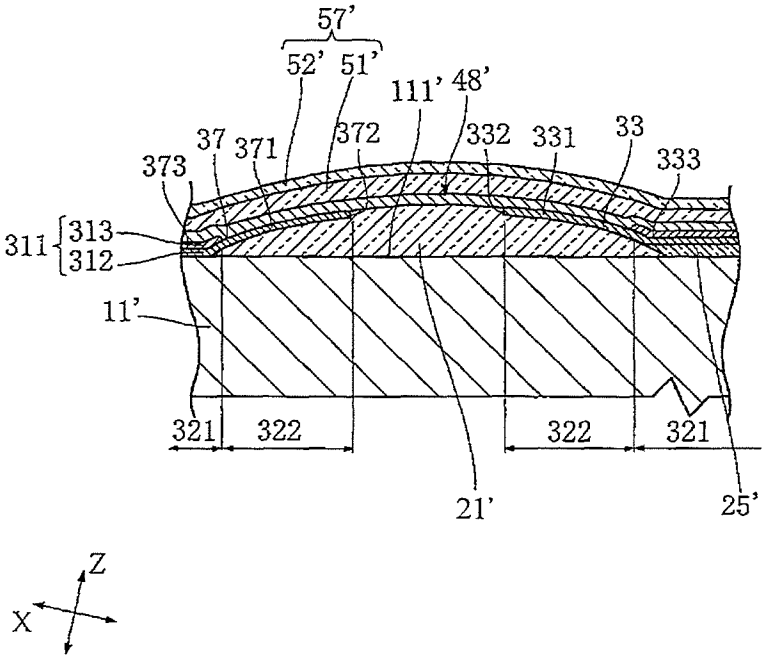
FIG. 47 is a cross-sectional view of the main parts formed with an upper layer of the protection layer in the manufacturing process of the thermal printer head according to the second embodiment of the present invention.

Referring to FIG. 47, an upper layer 52' is formed. For example, the upper layer 52' is formed by performing sputtering or CVD on SiC and overlaps with the lower layer 51'. The thickness of the upper layer 52' is, for example, around 6.0 μm. The lower layer 51' and the upper layer 52' are formed to obtain a first protection portion 57' having a thickness of, for example, around 8.0 μm.

Figure 48:
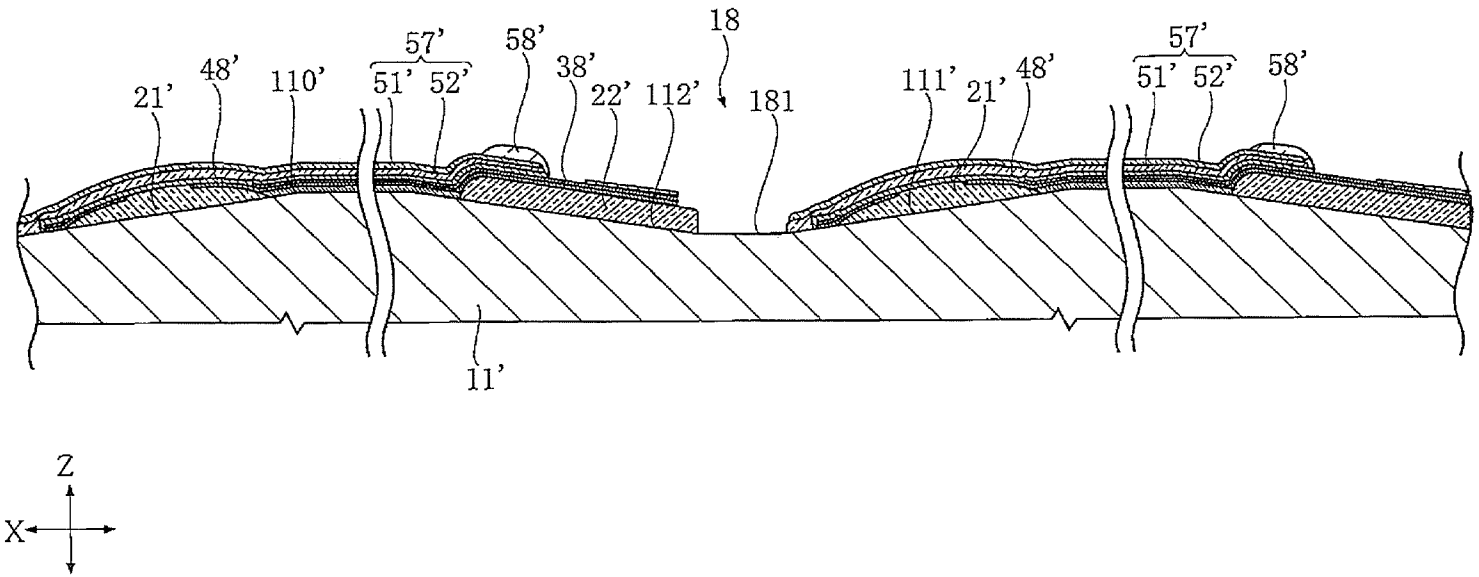
FIG. 48 is a cross-sectional view of the main parts formed with a second resin portion in the manufacturing process of the thermal printer head according to the second embodiment of the present invention.

Referring to FIG. 48, a second protection portion 58' is formed. For example, a resin material is coated on a part of the first protection portion 57' and a part of the electrode layer 30 to form the second protection portion 58'. Thereby, a product shown in FIG. 48 is formed.

Figure 49:
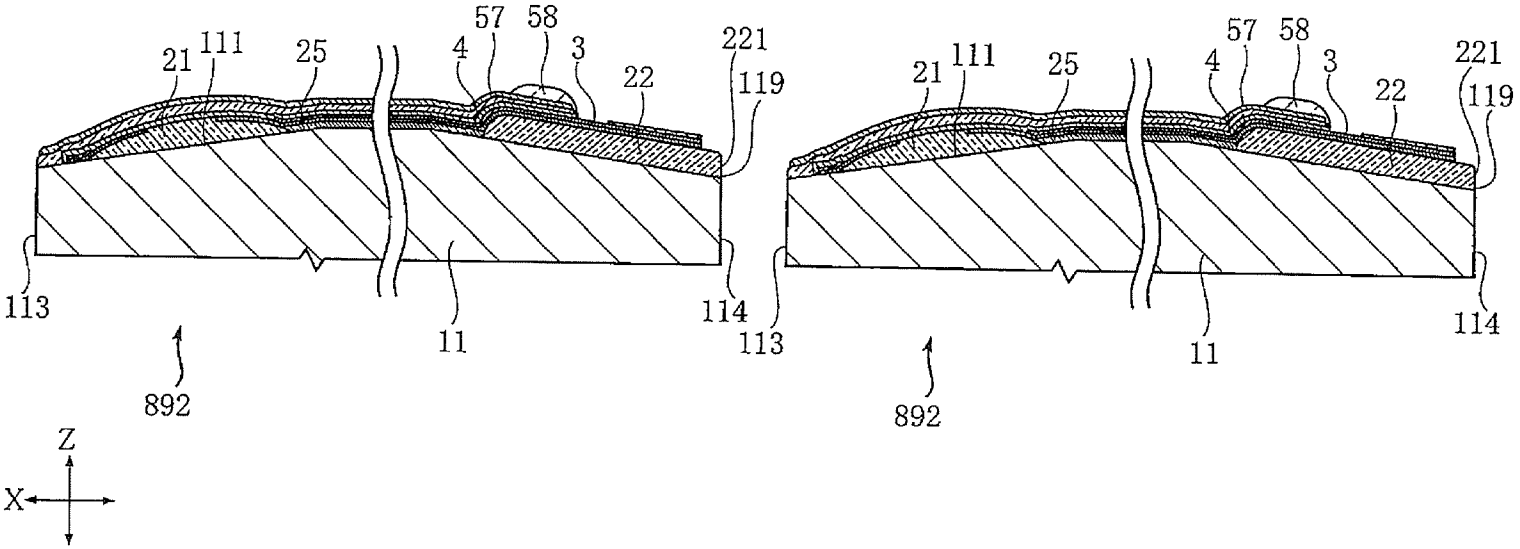
FIG. 49 is a cross-sectional view of the main parts with a base material cut in the manufacturing process of the thermal printer head according to the second embodiment of the present invention.

Referring to FIG. 49, the base material 11' is cut along the grooves 18 and the direction X. Therefore, fixed plates 892 having the electrode layer 38 and the resistor layer 4 are formed on the first substrates 11.

Figure 50:
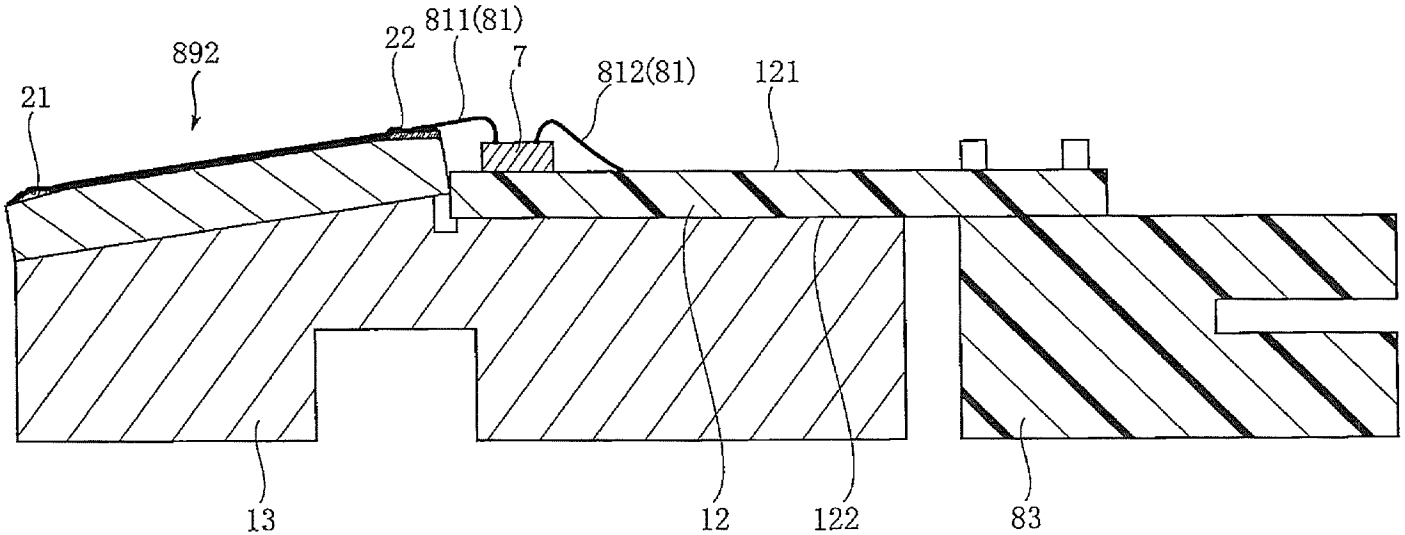
FIG. 50 is a cross-sectional view of the main parts disposed with a driving IC and wires in the manufacturing process of the thermal printer head according to the second embodiment of the present invention.

Referring to FIG. 50, the fixed plate 892 and the second substrate 12 installed with the connector 83 are joined to the heat dissipation plate 13. Then, the driving IC 7 is disposed on the second substrate 12. After the wires 81 are respectively joined to the driving IC 7 and the second inclined surface 112, the sealing resin 82 (referring to FIG. 31) is used to cover the wires 81 and the driving IC 7. Thereby, the thermal printer head 201 is manufactured.

The effects of this embodiment are illustrated below.

In this embodiment, due to the same reason as that in the first embodiment, the exposure times during the manufacturing of the thermal printer head 201 are reduced, so that the manufacturing of the thermal printer head 201 achieves high efficiency.

In this embodiment, due to the same reason as that in the first embodiment, the anti-corrosion layer for forming the electrode layer 38 is exposed before the fixed plates 892 are obtained. The exposure before the fixed plates 892 are obtained improves the efficiency of manufacturing the thermal printer head 201. Moreover, the exposure before the fixed plates 892 are obtained reduces the manufacturing cost and achieves a stable process of manufacturing the thermal printer head 201. In addition, though the exposure before the fixed plates 892 are obtained improves manufacturing efficiency, it may also be performed after the fixed plates 892 are obtained.

In the thermal printer head 201, due to the same reason as that in the first embodiment, the first glaze layer 21' and the second glaze layer 22' are formed without changing the posture of the base material 11' when the first main surface 110' is substantially in the horizontal direction. Thus, the thermal printer head 201 is highly efficient to manufacture.

The thermal printer head 201 includes the intermediate glass layer 25 laminated on the first main surface 110, the first inclined surface 111, and the second inclined surface 112 and crossing the first glaze layer 21 and the second glaze layer 22. In this construction, the intermediate glass layer 25 is covered on the boundary 116 of the first main surface 110 and the first inclined surface 111 and on the boundary 117 of the first main surface 110 and the second inclined surface 112. A fluid having certain viscosity is coated on the first main surface 110' and the first inclined surface 111' to form the intermediate glass layer 25. Thereby, the curved surfaces 251 and 252 are formed on the intermediate glass layer 25. In this case, the electrode layer 3 does not directly contact the sharp boundaries 116 and 117. Therefore, a potential high-order difference is avoided in the electrode layer 3, thus preventing disconnection of the electrode layer 3 of the thermal printer head 201.

The thermal printer head 201 includes the second substrate 12 having the second main surface 121 disposed with the driving IC 7. The second inclined surface 112 is located in the thickness direction of the second substrate 12, and on one side of the second main surface 121 facing the driving IC 7 relative to the second main surface 121. Therefore, due to the same reason as that in the first embodiment, the thermal printer head 201 of this embodiment is highly efficient to manufacture.

Due to the same reason as that in the first embodiment, ultrasonic vibration is applied to the thermal printer head 201 to make the second inclined surface 112 join with the wires 811.

The second inclined surface 112 is substantially parallel with the second main surface 121. That is, in the thermal printer head 201, the second inclined surface 112 and the second main surface 121 form an angle of 0° to 5°. In this construction, a widely used wire joining device can be employed to stably and rapidly join the wires 811.

In the thermal printer head 201, the first glaze layer 21 may be made with the same thickness as the conventional thermal printer head 900, so that printing can be performed rapidly.

In this embodiment, the joint portion 336 is formed red of the wall thick portion 323. The thickness of the normal thick portion 321 is around 0.6 μm, and the thickness of the wall thick portion 323 is greater, and may be around 0.9 μm (or around 1.7 μm). Therefore, even if a heavy load exists when the wires 811 are joined, the probability of suffering wear is low. Moreover, the stress generated by wires 811 exerting tension on the joint portion 336 is reduced in concentration at a joint part between the wires 811 and the joint portion 336. In this manner, the wires 811 are prevented from falling off the joint portion 336.

The wall thick portion 323 is formed of the main Au layer 301 and the auxiliary Au layer 304. The auxiliary Au layer 304 is higher in Au content than the main Au layer 301, thereby enhancing the strength of joints with the wires 811 made of Au. Moreover, when the auxiliary Au layer 304 is composed of a mixture of Au and glass, the surface of the auxiliary Au layer 304 can easily become uneven. In this case, the contact area between the joint portion 336 and the wires 811 is increased, and the strength of the joints between the wires 811 and the joint portion 336 is also increased.

Further, in this embodiment, the front-end portions of the stripe portions 331, 351, and 371 are formed by the wall thin portion 322. Thus, the front-end edges 332, 352, and 372 of the stripe portions 331, 351, and 371 are prevented from generating an apparent order difference. This construction prevents the resistor layer 4 from coving an apparent order difference, thereby protecting the resistor layer 4 against damage.

The end portions of the stripe portions 331, 351, and 371 or the parts of the electrode layer 3 connected thereto are formed by the normal thick portion 321. Thus, the resistance of the electrode layer 3 is prevented from increasing inappropriately.

The front-end portions of the stripe portions 331, 351, and 371 are sunk relative to the first glaze layer 21, so that a step is prevented from occurring at the boundaries of the first glaze layer 21 and the stripe portions 331, 351, and 371. The order difference may be effectively eliminated by arranging the front-end portions of the stripe portions 331, 351, and 371 to be coplanar with the first glaze layer 21.

The normal thick portion 321 is formed of the main Au layer 301, including the lower layer 302 and the upper layer 303; merely the lower layer 302 is used to form the wall thin portion 322, so that the boundary of the normal thick portion 321 and the wall thin portion 322 can be set at a desired position. The position of the boundary may be defined through thick-film printing, thereby ensuring precision.

Further, in this embodiment, the protection layer 5 does not have a part directly contacting the electrode layer 3. The bonding force between the electrode layer 3 mainly made of Au and the protection layer 5 made of glass by sputtering is weak. The bonding force between the resistor layer 4 made of, for example, $TaSiO_2$ or TaN and the protection layer 5 is strong. Therefore, the protection layer 5 is prevented from falling off.

Further, in this embodiment, the electrode layer 3 is formed on the intermediate glass layer 25. Since the part of the electrode layer 3 on the intermediate glass layer 25 is stripe-shaped, unexpected problems such as disconnection may easily occur if the base is rough. The intermediate glass layer 25 is made of glass having a softening point lower than the glass for making the first glaze layer 21, so that the surface thereof is smooth. Therefore, the electrode layer 3 is prevented from disconnecting. Only the straight portions 334 and 354 of the electrode layer are located on the intermediate glass layer 25. The straight portions 334 and 354 are linear, so that there is no need to worry about the deviatoric stress generated by the bent portion, thereby preventing inappropriate offset or bending of the straight portions 334 and 354.

The straight portions 334 and 354 are parallel with each other, and extend along the direction X. When a plurality of straight portions 334 and 354 of the same number are disposed, the interval between them may be maximized, to prevent unexpected problems such as contact between the straight portions 334 and 354.

In addition, in this embodiment, the non-heat dissipation portions 42 of the resistor layer 4 are covered on the straight portions 334 and 354. The non-heat dissipation portions 42 are stripe-shaped. Since the straight portions 334 and 354 may not be easily offset or bent, the non-heat dissipation portions 42 are prevented from contacting each other.

The scope of the present invention is not limited to the above embodiments. Modifications and variations can be made to the specific construction of each part of the present invention. For example, the thermal printer heads 101 and 201 are preferably used for printing a print medium 801 that cannot be easily bent, but may also be used for printing a print medium 801 that can be easily bent, such as paper.

What is claimed is:

1. A thermal printer head, comprising:

a first substrate, having a first main surface expanded in a first direction and a second direction intersecting the first direction, a first inclined surface located on one side of the first direction relative to the first main surface and inclined relative to the first main surface in a manner of being distant from the first main surface and facing an opposite direction as the first main surface, and a second inclined surface located on another side of the first direction relative to the first main surface and inclined relative to the first main surface in a manner of being distant from the first main surface and facing an opposite direction as the first main surface;

an electrode layer, laminated on the first main surface, the first inclined surface, and the second inclined surface;

a resistor layer, having a plurality of heat dissipation portions respectively laminated on the first inclined surface and crossing separated parts in the electrode layer;

a driving integrated circuit (IC), for controlling the current passing through each heat dissipation portion; and a plurality of wires, respectively joined to the driving IC and joined to the second inclined surface through the electrode layer.

2. The thermal printer head according to claim 1, further comprising:

a first glaze layer, located between the heat dissipation portions and the first inclined surface; and a second glaze layer, located between the electrode layer and the second inclined surface.

3. The thermal printer head according to claim 2, further comprising an intermediate glass layer laminated on the first main surface, the first inclined surface, and the second inclined surface and crossing the first glaze layer and the second glaze layer.

4. The thermal printer head according to claim 3, wherein the intermediate glass layer has a first curved surface facing the same direction as the first main surface and overlapping with a boundary of the first main surface and the first inclined surface.

5. The thermal printer head according to claim 3, wherein the intermediate glass layer has a second curved surface facing the same direction as the first main surface and overlapping with a boundary of the first main surface and the second inclined surface.

6. The thermal printer head according to claim 2, wherein the first substrate further comprises a substrate lateral facing another side of the first direction; and the second glaze layer has an end surface coplanar with the substrate lateral.

7. The thermal printer head according to claim 2, wherein the second glaze layer is located between the electrode layer and the first main surface.

8. The thermal printer head according to claim 1, further comprising a second substrate having a second main surface disposed with the driving IC, wherein the second inclined surface is located in a thickness direction of the second substrate, and on one side of the second main surface facing the driving IC relative to the second main surface.

9. The thermal printer head according to claim 8, further comprising a heat dissipation plate installed with the first substrate and the second substrate, wherein the first substrate has a rear surface facing an opposite direction as the first main surface, and seen from the thickness direction of the second substrate, the rear surface overlaps with the second inclined surface and has a part that connects against the heat dissipation plate.

10. The thermal printer head according to claim 8, wherein the second inclined surface and the second main surface form an angle of 0° to 5°.

11. The thermal printer head according to claim 10, wherein the second inclined surface is parallel with the second main surface.

12. The thermal printer head according to claim 1, further comprising a sealing resin covering the driving IC and the wires.

13. The thermal printer head according to claim 1, further comprising protection portions covering the heat dissipation portions and having insulation property, wherein the protection portions overlap with the first substrate in the first direction.

14. The thermal printer head according to claim 1, wherein the first inclined surface and the second inclined surface are both inclined relative to the first main surface by an angle of 1° to 15°.

15. The thermal printer head according to claim 1, wherein in a third direction orthogonal to the first direction and the second direction, an end portion of the first inclined surface on one side of the first direction and an end portion of the second inclined surface on another side of the first direction are both separated from the first main surface by 150 μm to 200 μm.

16. The thermal printer head according to claim 1, wherein the resistor layer is located between the electrode layer and the first substrate.

17. The thermal printer head according to claim 1, wherein the resistor layer is located between the electrode layer and the first main surface and between the electrode layer and the second inclined surface.

18. The thermal printer head according to claim 1, wherein the electrode layer is located between the resistor layer and the first substrate.

19. The thermal printer head according to claim 1, wherein the electrode layer comprises a common electrode, a plurality of relay electrodes, and a plurality of individual electrodes;

the common electrode has a plurality of common electrode stripe portions separated from and conducted with each other in the second direction;

each relay electrode comprises two relay electrode stripe portions separated from each other in the second direction and a relay electrode connecting portion connected to the two relay electrode stripe portions;

each individual electrode comprises an individual electrode stripe portion; and each common electrode stripe portion is separated from one of the two relay electrode stripe portions in the first direction by any of the heat dissipation portions, and each individual electrode stripe portion is separated from any of the common electrode stripe portions in the second direction and separated from the other one of the two relay electrode stripe portions in the first direction by any of the heat dissipation portions.

20. The thermal printer head according to claim 19, wherein the common electrode further comprises branch portions connected to adjacent ones among the common electrode stripe portions and extended in the first direction.

21. A manufacturing method of a thermal printer head, comprising:

forming a plurality of grooves that are separated from each other in a first direction and respectively extended in a second direction intersecting the first direction on a base material, so as to divide a surface of the base material into a plurality of main surfaces extending in the second direction;

laminating an electrode layer on the main surfaces, a plurality of first inclined surfaces respectively connected to an end edge of any of the main surfaces on one side of the first direction and defined any of the grooves, and a plurality of second inclined surfaces respectively connected to an end edge of any of the main surfaces on another side of the first direction and defined any of the grooves;

laminating a resistor layer at least on the first inclined surfaces;

laminating an anti-corrosion layer on the electrode layer;

exposing parts of the anti-corrosion layer laminated on the first inclined surfaces, the second inclined surfaces, and the main surfaces at the same time;

etching the electrode layer after the exposure; and cutting the base material along the grooves and the first direction to generate a plurality of fixed plates.

22. The manufacturing method of the thermal printer head according to claim 21, further comprising forming a first glaze layer on each first inclined surface and a second glaze layer on each second inclined surface before forming the electrode layer.

23. The manufacturing method of the thermal printer head according to claim 22, wherein the electrode layer is laminated after laminating the resistor layer; and the electrode layer and the resistor layer are etched together when the electrode layer is etched.

24. The manufacturing method of the thermal printer head according to claim 23, wherein the exposure is performed after laminating the electrode layer and in a state that the electrode layer is laminated on the resistor layer.

* * * * *